US005818170A

United States Patent [19]

Kikunaga et al.

[11] Patent Number: 5,818,170

[45] Date of Patent: Oct. 6, 1998

[54] GYROTRON SYSTEM HAVING ADJUSTABLE FLUX DENSITY

[75] Inventors: Toshiyuki Kikunaga; Hiroyuki Asano, both of Hyogo, Japan

[73] Assignee: Mitsubishi Denki Kabushiki Kaisha, Tokyo, Japan

[21] Appl. No.: 400,332

[22] Filed: Mar. 7, 1995

[30] Foreign Application Priority Data

Mar. 17, 1994 [JP] Japan ..... 6-047017
Dec. 19, 1994 [JP] Japan ..... 6-315133

[51] Int. Cl.[6] ..... H01J 25/00; H01J 23/08

[52] U.S. Cl. ..... 315/5; 315/5.35

[58] Field of Search ..... 315/4.5, 5.35; 331/79

[56] References Cited

U.S. PATENT DOCUMENTS

| | | | |
|---|---|---|---|
| 4,395,655 | 7/1983 | Wurthman | 315/5.35 X |
| 4,482,843 | 11/1984 | Perring | 315/5 X |
| 4,533,875 | 8/1985 | Lau et al. | 315/5.35 X |
| 4,839,561 | 6/1989 | Ito | 315/4 |
| 5,052,003 | 9/1991 | Mathews | 315/5 X |
| 5,113,162 | 5/1992 | Umehara et al. | 315/5.35 X |
| 5,550,432 | 8/1996 | Barker | 315/5 |

FOREIGN PATENT DOCUMENTS

| | | | |
|---|---|---|---|
| 56-102045 | 8/1981 | Japan . | |
| 276541 | 11/1989 | Japan | 315/4 |

OTHER PUBLICATIONS

A.N.Kuftin, et al "Theory of Helical Electron Beams in Gyrotrons" International Journal of Infrared & Millimeter Waves vol. 14, No. 4, 1993, pp. 783–817.

Permanentmagnete und ihre Weiterent Wicklung, von K. Ruschmeyer, Valvo Berichte Oct. 1985, pp. 1–11.

*Primary Examiner*—Benny T. Lee
*Attorney, Agent, or Firm*—Wolf, Greenfield & Sacks, P.C.

[57] ABSTRACT

A gyrotron system comprises an electron gun that produces an electron beam, a magnetic field generating unit comprising a permanent magnet and two electromagnets and capable of generating an axial magnetic field that drives electrons emitted from the electron gun for revolving motion, a cavity resonator that causes cyclotron resonance maser interaction between the revolving electrons and a high-frequency electromagnetic field resonating in a natural mode, a collector for collecting the electron beam traveled through the cavity resonator, and an output window through which a high-frequency wave produced by the cyclotron resonance maser interaction propagates. The gyrotron system can be fabricated at a comparatively low cost, is easy to operate, has a comparatively small size and is capable of operating at a comparatively low running cost.

56 Claims, 34 Drawing Sheets

GYROTRON SYSTEM HAVING ADJUSTABLE FLUX DENSITY

BACKGROUND OF THE INVENTION

1. Field of the Invention

The present invention relates to a gyrotron system in which microwave or millimeter wave generation results from cyclotron resonance maser interaction between an electron beam and a high-frequency electromagnetic field in the natural mode of a cavity resonator.

2. Description of the Related Art

Referring FIG. 49 showing the configuration of a known gyrotron system disclosed in Japanese Patent Laid-open (Kokai) No. 56-102045, there are shown an electron gun 1, that produces an electron beam 9, comprising a cathode 2, an electron emission member 3 provided on the cathode 2, a first anode 4 and a second anode 5; a cavity resonator 6 in which a high-frequency wave is generated by the resonance coupling of the electron beam 9 and a high-frequency electromagnetic field; a collector 7 for collecting the electron beam after the interaction with the high-frequency electromagnetic field; and an output window 8 through which the high-frequency wave is obtained. A gyrotron system 200 comprises a gyrotron 100 comprising the electron gun 1, the cavity resonator 6, the collector 7 and the output window 8, a main electromagnet 11 that generates a magnetic field along the axis of the gyrotron 100, and an electron gun electromagnet 12.

In operation, the electron beam 9 emitted from the electron emitting part 3 on the cathode 2 of the electron gun 1 is accelerated by an electric field between the cathode 2 and the first anode 4 and is driven for revolving motion and axial drifting by a magnetic field generated by the electron gun electromagnet 12. Then the electron beam is compressed by an intense magnetic field generated by the main electromagnet 11 and, consequently, the velocity of electrons perpendicular to the magnetic field is enhanced and the velocity of the same parallel to the magnetic field is reduced before the electrons travel into the cavity resonator 6. Part of the normal velocity energy of the electrons is converted into high-frequency energy by the cyclotron resonance maser interaction between the high-frequency magnetic field in the natural mode of the cavity resonator 6 generally having a cylindrical cavity and the electrons in cyclotron motion caused by the axial magnetic field generated by the main electromagnet 11. The electron beam 9 which has undergone the cyclotron resonance maser interaction in the cavity resonator 6 is collected by the collector 7, and the high-frequency wave generated in the cavity resonator 6 travels outside through the output window 8.

The energy of the electron beam can be efficiently converted into high-frequency energy in the cavity resonator 6 when the following inequality is satisfied.

$$\omega - k_z \cdot V_z > s\Omega_c \quad (1)$$

where $\omega$ is the resonance angular frequency of the cavity resonator 6 in the natural mode, $k_z$ is the axial wave number of the natural mode, $V_z$ is the axial velocity of electrons, s is the order of a higher harmonic, and $\Omega_c$ is defined by:

$$\Omega_c = e \cdot B / \gamma \cdot m_0 \quad (2)$$

where e is the charge (absolute value) of the electron, B is the axial magnetic flux density in the cavity resonator 6, $\gamma$ is the relativistic coefficient and $m_0$ is the rest mass of the electron.

As is obvious from expression (1), the energy of the electron beam is converted efficiently into high-frequency energy to generate an intense electromagnetic wave when the right side of the expression (1) is slightly smaller than the left side of the same.

Thus, the magnetic field plays an essential part in the gyrotron system and hence it is important to adjust the magnetic field accurately for the efficient operation of the gyrotron system.

In this known gyrotron system, the main electromagnet 11 and the electron gun electromagnet 12 for revolving the electrons are superconducting magnets, normal conduction magnets, or magnets each comprising a superconducting magnet and a normal conduction magnet, and the magnetic flux density is adjusted to an optimum value by adjusting the currents supplied to the electromagnets according to the electron beam accelerating voltage. As is obvious from expressions (1) and (2), an intense magnetic field must be generated in the cavity resonator to generate high-frequency oscillation. Therefore, a superconducting magnet is employed as the main electromagnet to generate an oscillation of, for example, about 30 GHz or higher and a normal conduction magnet is employed as the main electromagnet to generate an oscillation of 30 GHz or lower in most cases. However, a superconducting magnet generally is expensive, it is awkward to cool the superconducting magnet with liquid helium or the like or by a refrigerator to a very low temperature when it is excited, and it is very difficult to change the magnetic field suddenly. On the other hand, the normal conduction magnet needs an exciting power supply having a very large capacity, consumes large power, and the normal conduction magnet and the exciting power supply needs to be water-cooled, which increases the running costs.

SUMMARY OF THE INVENTION

Accordingly, it is an object of the present invention to provide a gyrotron system easy to operate facilitating the maintenance thereof, requiring an exciting power supply having a comparatively small capacity and capable of operating at a comparatively low running costs.

According to the present invention, a gyrotron system is provided with a magnetic field generating unit comprising a permanent magnet for generating most part of an axial magnetic field necessary for the oscillation of a gyrotron and at least one electromagnet for adjusting the axial magnetic field. In operation, the electromagnet generates the minimum magnetic field among the necessary axial magnetic field. Consequently, the exciting power supply having a comparatively small capacity can be used, and the gyrotron system is able to operate at a reduced power consumption and a reduced running costs.

In a preferred mode, the electromagnet is formed so as to adjust the axial magnetic flux density distribution in the cavity resonator of the gyrotron system, which corrects the spatial disturbance of the magnetic flux density of the magnetic field produced by the permanent magnet and enables the fine adjustment of the magnetic flux density according to the electron beam accelerating voltage.

Preferably, the electromagnet adjusts the axial magnetic flux density distribution at an electron emitting part on the cathode of the electron gun of the gyrotron, which enables the adjustment of total axial magnetic flux density near the electron gun to shape the axial magnetic flux density distribution.

In another preferred mode, the magnetic field generating unit comprises an electromagnet for adjusting the axial magnetic flux density distribution in the cavity resonator of the gyrotron, and an electromagnet for adjusting the axial magnetic flux density distribution at the electron emitting part on the cathode of the electron gun of the gyrotron.

Preferably, the gyrotron system further comprises a high-frequency wave detector for detecting the high-frequency wave outputted through the output window of the gyrotron, and a feedback means for feeding back detection signals provided by the high-frequency wave detector to a power supply control circuit for controlling the power supply for supplying a current to the electromagnet to adjust the magnetic field generated by the electromagnet by adjusting the current flowing through the electromagnet so that the gyrotron system provides the maximum output or a predetermined output. The feedback means may be constituted so as to adjust the electromagnet for adjusting the axial magnetic flux density distribution in the cavity resonator of the gyrotron, and the electromagnet for adjusting the axial magnetic flux density distribution at the electron emitting part on the cathode of the electron gun of the gyrotron. When the magnetic fields generated by the electromagnets are thus adjusted, the oscillation output of the gyrotron can be automatically adjusted to the maximum output or the predetermined output.

In a further preferred mode, the gyrotron system further comprises a detecting means for detecting the variation of the magnetic field produced by the permanent magnet due to the aging of the permanent magnet and is capable of compensating the variation of the intensity of the magnetic field due to the aging of the permanent magnet by the electromagnet.

Preferably, the gyrotron system further comprises a detecting means for detecting the variation of the magnetic field due to the variation of the temperature of the permanent magnet and compensates the variation of the intensity of the magnetic field by the electromagnet.

In a still further preferred mode, the magnetic flux density of the magnetic field produced by the permanent magnet is not less than 90% and not greater than 110% of the axial magnetic flux density in the central portion of the cavity resonator while the gyrotron is in oscillation. Since the majority of the magnetic flux density necessary for the oscillation of the gyrotron results from of the magnetic field produced by the permanent magnet, the electromagnet and the exciting power supply are able to start the gyrotron for oscillation and stabilize the oscillation of the gyrotron and able to induce magnetic flux density necessary for adjusting the oscillation output. The range of magnetic field adjustment can be expanded by increasing the ratio of the magnetic flux density induced by the electromagnet to the total magnetic flux density.

In a still further preferred mode, the permanent magnet induces not less than 50% and not greater than 150% of the axial magnetic flux density at the electron emitting part of the electron gun, whereby the magnetic field to be generated by the electromagnet among the axial magnetic field needed at the electron emitting part can be reduced.

Preferably, the gyrotron system further comprises an electromagnet for generating an axial magnetic field near the collector of the gyrotron, whereby the position on the collector at which the electron beam falls on the collector can be shifted.

In a still further preferred mode, all the materials for connecting insulating members insulating the principal components of the gyrotron of the gyrotron system from each other and connecting the same together and the metal members of the principal components are nonmagnetic materials, so that the magnetic flux density of the magnetic field generated by the magnetic field generating unit or the magnetic flux density distribution is not disturbed. Preferably, all the main materials forming connecting parts connecting the components of the electron gun are nonmagnetic materials. The insulating members may be formed of insulating materials capable of being directly connected to the nonmagnetic metal members.

In a still further preferred mode, the gyrotron system further comprises a frame confining a region in which the magnetic flux density of the magnetic field generated by the magnetic field generating unit is 5 G (gauss) or above to prevent dangers attributable to the magnetic field continuously maintained by the magnetic field generating unit. The frame may be formed so as to confine a region in which the magnetic flux density of the magnetic field generated by the permanent magnet is 5 G or above. Preferably, the outer surface of the frame is coated with a cushioning material.

Preferably, if the axial magnetic field distribution formed by the permanent magnet has a position where the direction of the magnetic field is inverted, the electron emitting part on the cathode of the electron gun of the gyrotron is positioned on the side of the cavity resonator with respect to the position where the direction of the magnetic field is inverted. When the electron emitting part is thus positioned, the electron beam emitted from the electron emitting part does not travel through the position where the axial magnetic field is inverted.

Magnetic parts brazed to the opposite ends of the insulating member insulating the components of the electron gun may be disposed on the side opposite the side of the cavity resonator with respect to the position where the axial magnetic field is inverted. When the magnetic parts are thus positioned, the disturbance of the axial magnetic field around the electron emitting part on the cathode by the magnetic parts can be reduced and the magnetic parts will not affect adversely the electron beam emitted from the electron emitting part.

The above and other objects and effects of the present invention will become more apparent from the following description taken in connection with the accompanying drawings.

DETAILED DESCRIPTION OF THE PREFERRED EMBODIMENTS

Figure 1:
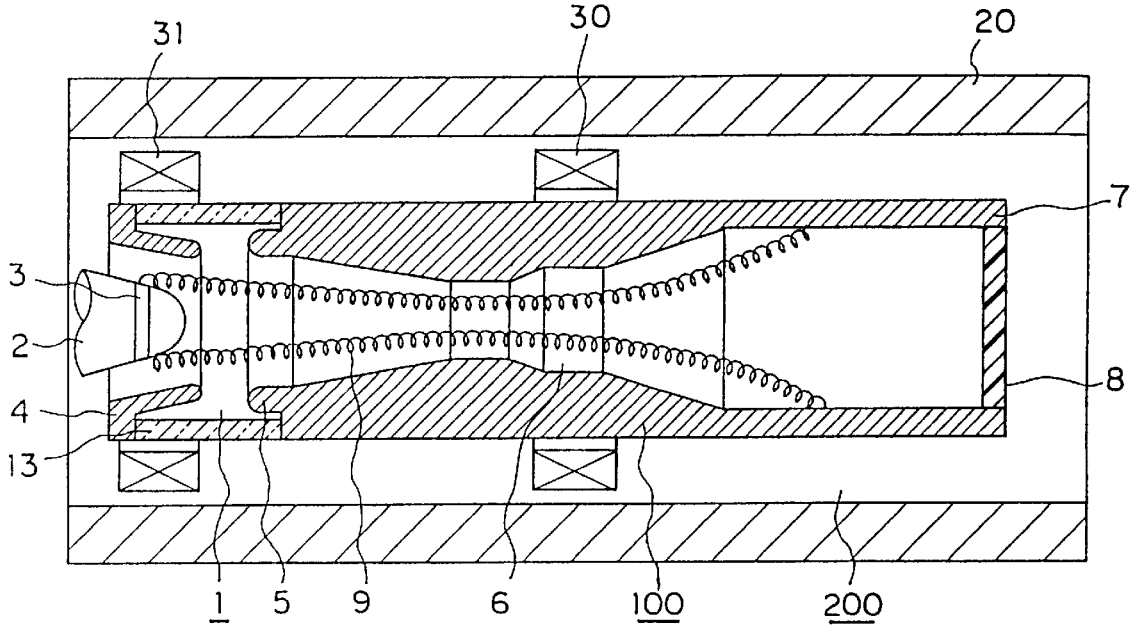
FIG. 1 is a schematic longitudinal sectional view of a gyrotron system in a preferred embodiment according to the present invention.

FIG. 1 shows a gyrotron system in a preferred embodiment according to the present invention, in which parts like or corresponding to those of the prior art gyrotron system are designated by the same reference characters and the description thereof will be omitted. A permanent magnet 20 produces an axial magnetic field by, for example, a method disclosed in International Journal of Infrared and Millimeter Waves, Vol. 14, No. 4, p. 783 (1993). The permanent magnet 20 produces the majority of a magnetic field necessary for the oscillating operation of a gyrotron 100. The permanent magnet 20 and a main magnetic field fine adjustment electromagnet 30 disposed near a cavity resonator 6 generate a magnetic field of an axial magnetic flux density necessary for the oscillating operation of the gyrotron 100. Indicated at 31 is an electron gun magnetic field fine adjustment electromagnet. A gyrotron system 200 comprises a magnetic field generating unit comprising the permanent magnet 20, the main magnetic field fine adjustment electromagnet 30 and the electron gun magnetic field fine adjustment electromagnet 31, and a gyrotron 100.

As mentioned above, the magnetic field is essential to the oscillating operation of the gyrotron 100 and it is important to adjust the magnetic field accurately according to the oscillation frequency in the natural mode of the cavity resonator 6 for the efficient operation of the gyrotron system 200. As is obvious from expressions (1) and (2), since a high-intensity magnetic field must be generated in the cavity resonator 6 to generate high-frequency oscillation, the prior art gyrotron system 200 employs normal conduction magnets, superconducting magnet, or a normal conduction magnet and a superconducting magnet. Since a magnetic field generated by an electromagnet is readily adjustable, it is convenient to use an electromagnet for adjusting oscillation output according to the electron beam accelerating voltage for accelerating an electron beam 9 and the beam current. However, a normal conduction magnet needs an exciting power supply having a large capacity, consumes large power, and the exciting power supply and the normal conduction magnet needs to be water-cooled. On the other hand, the superconducting magnet generally is expensive and needs to be cooled with a liquid helium or the like to a very low temperature. Either the superconducting magnet or the normal conduction magnet requires a high initial cost, high running costs and troublesome work for handling.

Those problems in the prior art gyrotron are solved by the magnetic field generating unit employing a permanent magnet and an electromagnet in accordance with the present invention. For example, when generating a 28 GHz second harmonic, s=2 in expression (1) and $\gamma \sim 1$, therefore from expressions (1) and (2), a necessary axial magnetic flux density in the cavity resonator 6 is about 5 kG magnetic flux density. If 4 kG magnetic flux density is allotted to the permanent magnet 20 and about 1 kG magnetic flux density is allotted to the electromagnet 30, the exciting power supply may be of a comparatively small capacity and the gyrotron system 200 consumes comparatively little power. As mentioned above, the magnetic field is important for cyclotron resonance maser interaction between electrons and an electromagnetic field within the cavity resonator 6 and a magnetic flux density that enables the gyrotron system 200 to operate at the maximum oscillation efficiency is dependent on the electron beam acceleration voltage for accelerating the electron beam 9 and the beam current, it is desirable that the fine adjustment of the magnetic flux density within the cavity resonator 6 is possible. The main magnetic field fine adjustment electromagnet 30 is used for the fine adjustment of the magnetic flux density within the cavity resonator 6.

As is generally known, the characteristics of an electron beam 9 produced by an electron gun 1 are dependent on magnetic flux density near the electron gun 1 as well as on the electron beam accelerating voltage for accelerating the electron beam 9 and the beam current, and affect delicately the high-frequency output of the cavity resonator 6. Therefore, it is difficult for the electron gun 1 of the gyrotron 100 to establish optimum operating characteristics of the gyrotron system 200 only by a stationary magnetic field generated by the permanent magnet 20 for different electron beam accelerating voltages for accelerating the electron beam 9 and different beam currents, and hence it is desirable that the magnetic flux density of the electron gun 1 is finely adjustable. Therefore, the gyrotron system 200 of FIG. 1 is provided with the electron gun magnetic field fine adjustment electromagnet 31. The gyrotron system 200 is provided with an insulating member 13 for electrical insulation to apply voltages to a cathode 2 and a first anode 4 included in the electron gun 1. The insulating member 13 insulates the first anode 4 and a second anode 5 from each other.

Generally, the insulating member 13 is formed of alumina, and Kovar (trademark of Westinghouse Electric Corp.) is brazed to the opposite ends of the alumina insulating member 13 to enable the alumina insulating member 13 to be connected to metal parts. However, there is the possibility that the magnetic field around the insulating member 13 is disturbed because Kovar is a magnetic substance. If a magnetic field is generated near the electron gun 1 only by the permanent magnet 20, the disturbed magnetic field distribution cannot be corrected and the disturbed magnetic field distribution may affect adversely to the electron beam 9. Therefore, the electron gun magnetic field fine adjustment electromagnet 31 corrects the disturbed magnetic field distribution.

Since the magnetic field generating unit of the gyrotron system 200 comprises the permanent magnet and the electromagnet, the capacity of an exciting power supply for magnetizing the electromagnet may be comparatively small and the power consumption of the gyrotron system can be reduced. Since the range of adjustment of magnetic flux density for the adjustment of oscillation output is comparatively narrow, the electromagnet capable of generating such a magnetic field is able to adjust the magnetic flux density effectively. Accordingly, the facility of oscillation output adjustment by the gyrotron system 200 of the present invention is not different from that by the prior art gyrotron system 200 at all. The main magnetic field fine adjustment electromagnet 30 and the electron gun magnetic field fine adjustment electromagnet 31 may be magnetized individually or the electromagnets 30 and 31 are connected in series for simultaneous magnetization taking the respective numbers of turns of the electromagnets 30 and 31 into consideration.

Although the electromagnets 30 and 31 are disposed respectively near the cavity resonator 6 and the electron gun 1 of the gyrotron 100 of FIG. 1, the electromagnets 30 and 31 may be disposed either near the cavity resonator 6 or near the electron gun 1 depending on the magnetic flux density of the magnetic field produced by the permanent magnet 20. A plurality of electromagnets may be disposed near the cavity resonator 6 and a plurality of electromagnets may be disposed near the electron gun 1.

Figure 2:
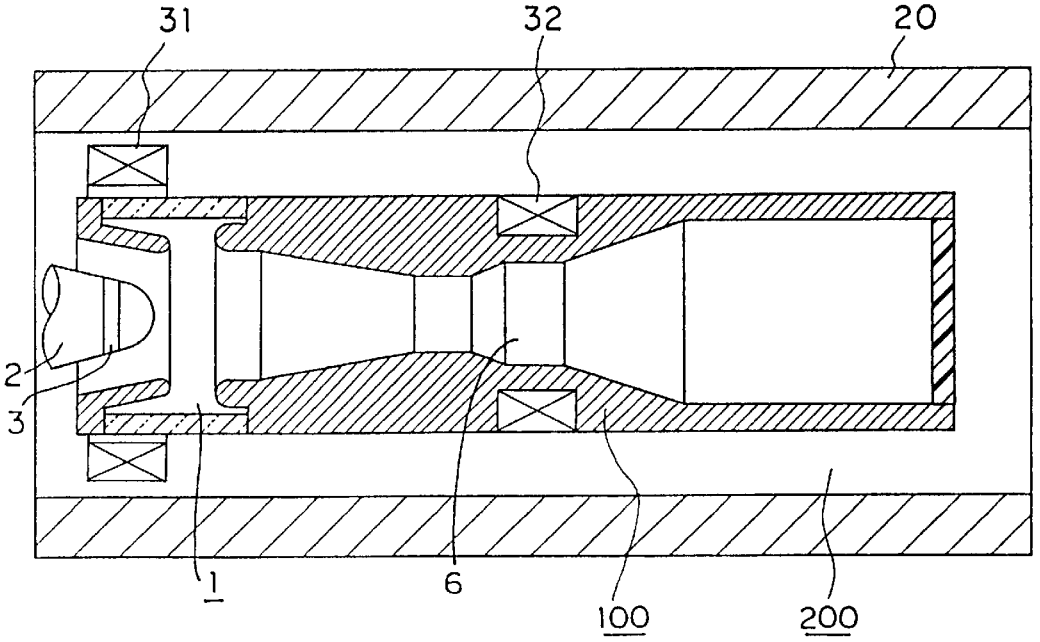
FIG. 2 is a schematic longitudinal sectional view of a gyrotron system in another embodiment according to the present invention.

FIG. 2 shows a gyrotron system in another embodiment according to the present invention, in which parts like or corresponding to those of the prior art gyrotron system are designated by the same reference characters and the description thereof will be omitted. Reference numeral 32 designates a main magnetic field fine adjustment electromagnet. The permanent magnet 20 of the first embodiment is able to produce an axial magnetic field more easily when the inside diameter of the permanent magnet 20 is smaller, and the permanent magnet 20 having a small inside diameter is small and lightweight, and can be obtained at a low cost. Therefore, if only a narrow space is available between the outer surface of the gyrotron 100 and the inner surface of the permanent magnet 20, the coils of the main magnetic field fine adjustment electromagnet 32 may be wound directly on the outer surface of the gyrotron 100 or the main magnetic field fine adjustment electromagnet 32 may be fitted in a groove formed in the outer surface of the gyrotron near to a cavity resonator 6 in the second embodiment as shown in FIG. 2. The smaller the inside diameter of the main magnetic field fine adjustment electromagnet 32, the less the power consumption of the main magnetic field fine adjustment electromagnet 32 for generating the same magnetic field. Therefore, the arrangement of the main magnetic field fine adjustment electromagnet 32 as shown in FIG. 2 is preferable.

Figure 3:
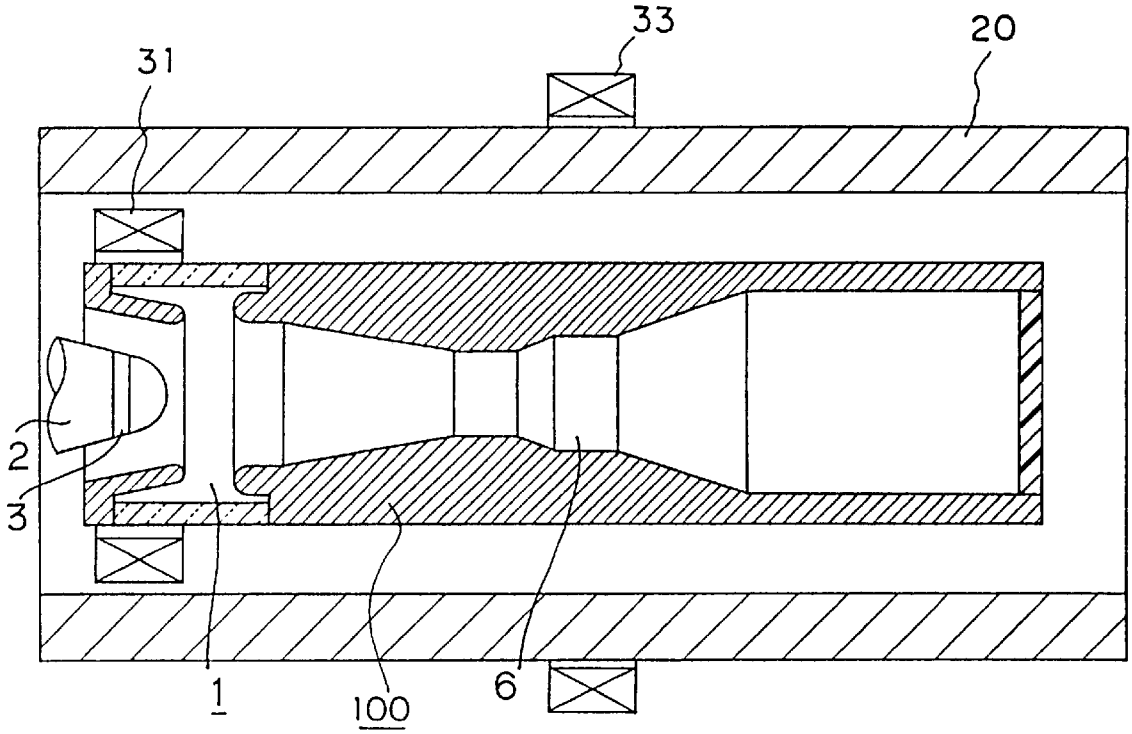
FIG. 3 is a schematic longitudinal sectional view of a gyrotron system in a further embodiment according to the present invention.

FIG. 3 shows a gyrotron system in a further embodiment according to the present invention, in which parts like or corresponding to those of the prior art gyrotron system are designated by the same reference characters and the description thereof will be omitted. Reference numeral 33 designates a main magnetic field fine adjustment electromagnet. As mentioned above, the permanent magnet 20 is able to generate an axial magnetic field more easily when the inside diameter of the permanent magnet 20 is smaller, and the permanent magnet 20 having a small inside diameter is small and lightweight, and can be obtained at a low cost. If the permanent magnet 20 has a comparatively small inside diameter and the space between the outer surface of a gyrotron 100 and the inner surface of the permanent magnet 20 is not wide enough to dispose the main magnetic field fine adjustment electromagnet 32 near a cavity resonator 6 in the space between the outer surface of the gyrotron 100 and the inner surface of the permanent magnet 20, the main magnetic field fine adjustment electromagnet 32 may be formed on the outer surface of the permanent magnet 20, as shown in FIG. 3.

Figure 4:
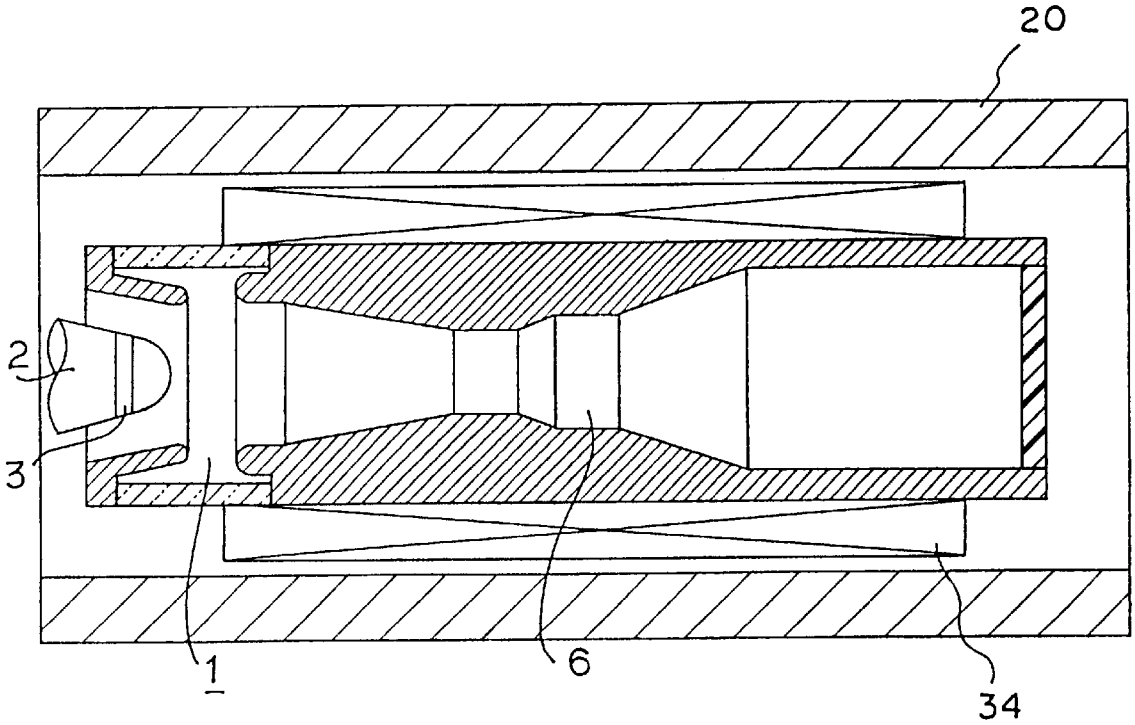
FIG. 4 is a schematic longitudinal sectional view of a gyrotron system in a still further embodiment according to the present invention.

FIG. 4 shows a gyrotron system in a still further embodiment according to the present invention, in which parts like or corresponding to those of the prior art gyrotron system are designated by the same reference characters and the description thereof will be omitted. Reference numeral 34 designates a magnetic field fine adjustment electromagnet, which replaces both the main magnetic field fine adjustment electromagnet 30 and the electron gun magnetic field fine adjustment electromagnet 31 of the first embodiment as shown in FIG. 1; that is the main magnetic field fine adjustment electromagnet 30 and the electron gun magnetic field fine adjustment electromagnet 31 of the first embodiment as shown in FIG. 1 are replaced with the magnetic field fine adjustment electron magnet 34 in the fourth embodiment. Although the axial magnetic flux densities in the electron gun and the cavity resonator 6 cannot be individually adjusted by the magnetic field fine adjustment electromagnet 34, the gyrotron system needs only a single exciting power supply.

Figure 5:
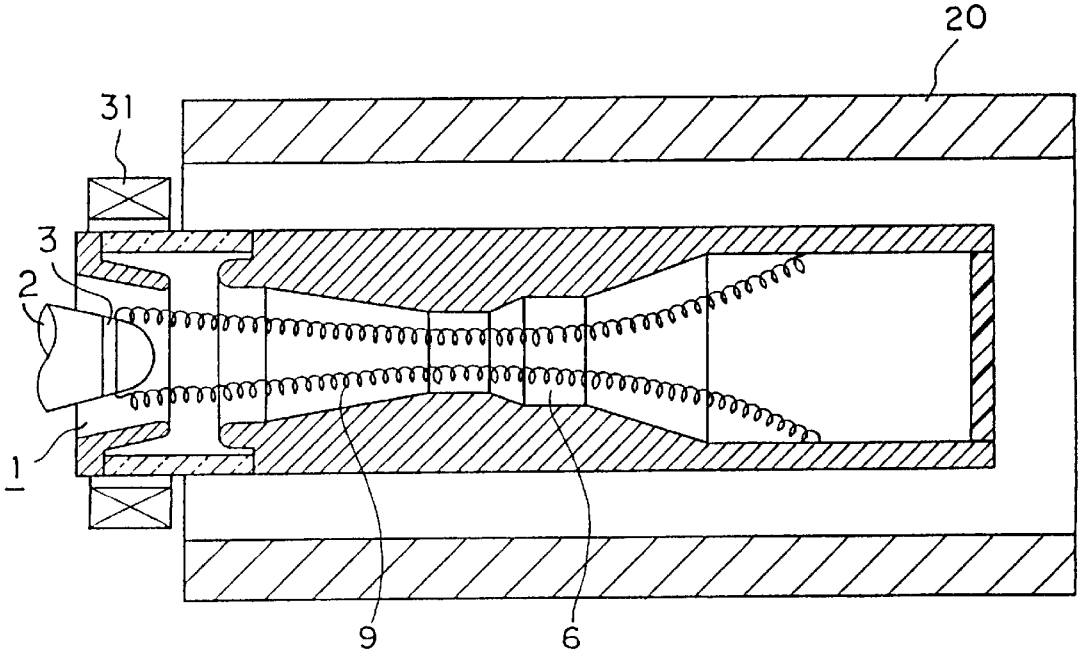
FIG. 5 is a schematic longitudinal sectional view of a gyrotron system in a still further embodiment according to the present invention.

FIG. 5 shows a gyrotron system in a still further embodiment according to the present invention, in which parts like or corresponding to those of the prior art gyrotron system are designated by the same reference characters and the description thereof will be omitted. While the electron gun 1 of each of the gyrotron systems in the first to the fourth embodiment is contained in the central bore of the permanent magnet 20, an electron gun 1 included in the gyrotron in the fifth embodiment is disposed outside one end of a permanent magnet 20. An electron gun magnetic field fine adjustment electromagnet 31 is disposed near the electron gun 1 to adjust a magnetic field generated around the electron gun 1 effectively. Although any main magnetic field fine adjustment electromagnet is not disposed near a cavity resonator 6, a main magnetic field fine adjustment electromagnet may be disposed near the cavity resonator 6 if need be.

Figure 6:
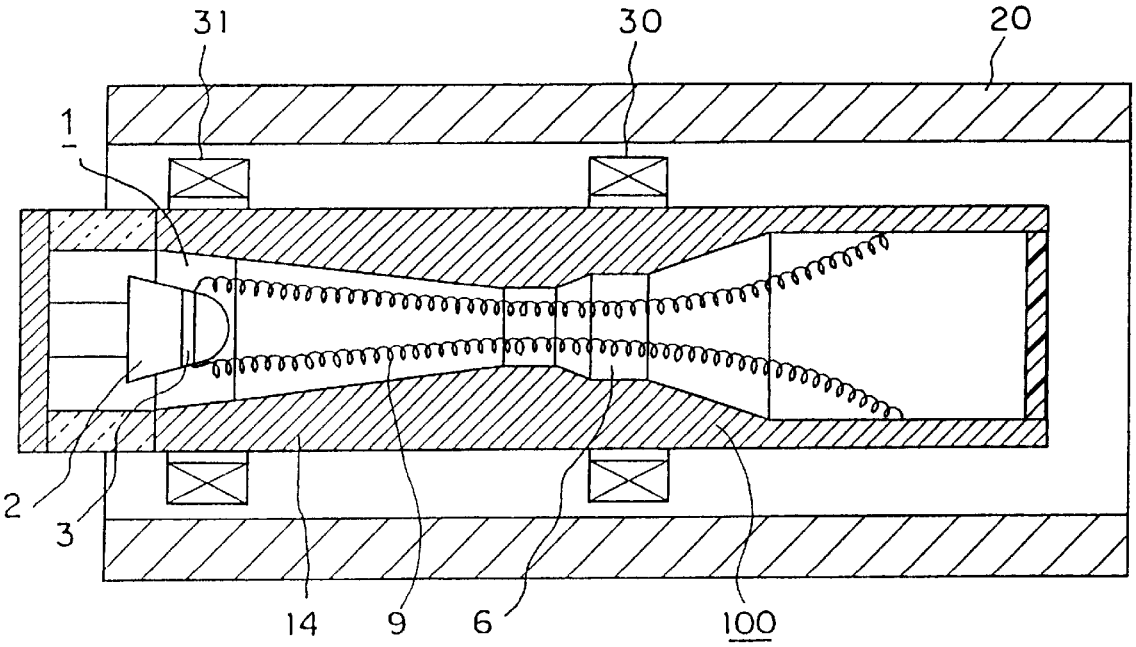
FIG. 6 is a schematic longitudinal sectional view of a gyrotron system in a still further embodiment according to the present invention.

FIG. 6 shows a gyrotron system in a still further embodiment according to the present invention, in which parts like or corresponding to those of the prior art gyrotron system are designated by the same reference characters and the description thereof will be omitted. The electron gun 1 of each of the gyrotron systems in the first to the fifth embodiment are a triode type electron gun comprising a cathode, a first anode and a second anode. The gyrotron system in FIG. 6 is provided with a gyrotron 100 employing a diode type electron gun 1 having a cathode 2 and an anode 14. The function of the diode type electron gun 1 for producing an electron beam 9 for cyclotron resonance maser interaction with an electromagnetic field of a natural mode in a cavity resonator 6 is similar to that of the triode type electron gun. Therefore, a gyrotron employing a diode type electron gun can be applied to gyrotron systems in the following embodiments even if the gyrotron systems in the following embodiments are described as employing a triode type electron gun.

Figure 7:
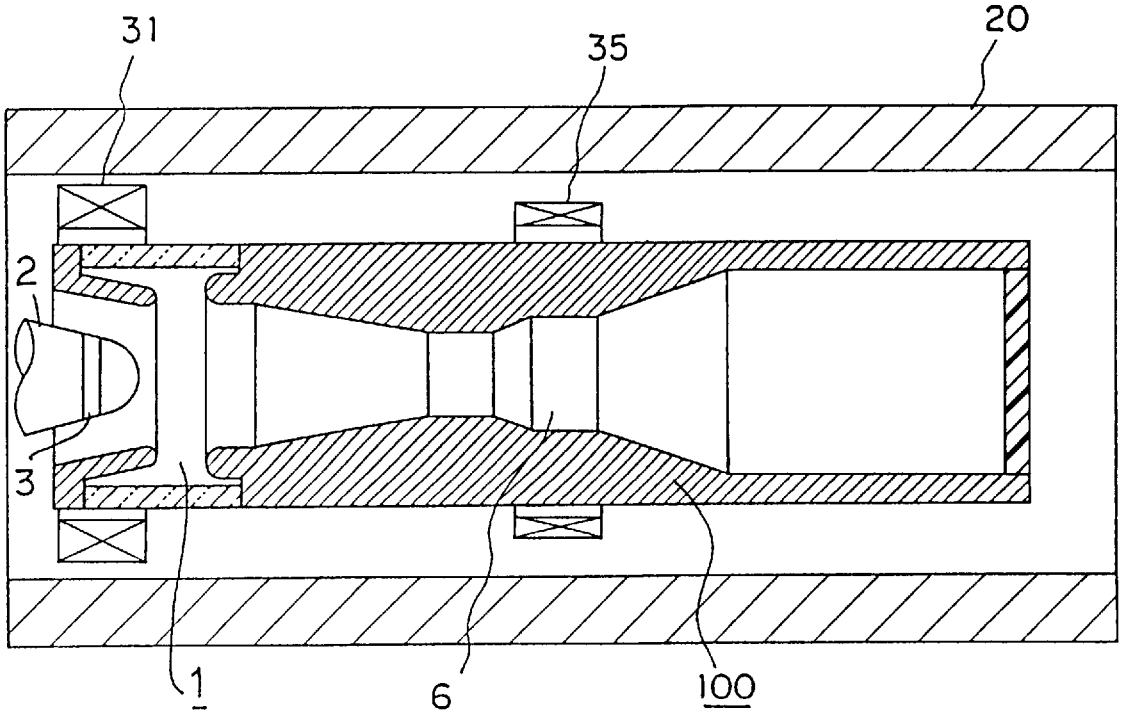
FIG. 7 is a schematic longitudinal sectional view of a gyrotron system in a still further embodiment according to the present invention.

FIG. 7 shows a gyrotron system in a still further embodiment according to the present invention, in which parts like or corresponding to those of the prior art gyrotron system are designated by the same reference characters and the description thereof will be omitted. Reference numeral 35 designates a main magnetic field fine adjustment electromagnet. Suppose that a gyrotron 100 generates a 28 GHz wave at second harmonic oscillation. Then, the relativistic coefficient $\gamma$ is expressed by:

$$\gamma=1+V_b/511 \tag{3}$$

where $V_b$ (kV) is the electron beam accelerating voltage. From expression (2), $\gamma=1.04$ when $V_b=20$ kV. From expression (2), the magnetic flux density is about 10.4 kG when the cyclotron frequency is 28 GHz. Therefore, from expression (1), a magnetic field of a magnetic flux density slightly lower than about 5.2 kG must be generated in the cavity resonator 6 to generate a 28 GHz wave at second harmonic oscillation.

When a magnetic field of a magnetic flux density not less than 90% and not greater than 110% of the magnetic flux density of about 5.2 kG is produced in the central portion of the cavity resonator 6 by a permanent magnet 20, the main magnetic field fine adjustment electromagnet 35 needs to generate a magnetic field of a magnetic flux density on the order of ±0.52 kG in the cavity resonator 6. Therefore, the main magnetic field adjustment electromagnet 35 and an exciting power supply for driving the main magnetic field fine adjustment electromagnet 35 may be small and lightweight, are able to operate at a low power consumption and a reduced running cost.

When the direction of a magnetic field generated by the main magnetic field fine adjustment electromagnet 35 is reverse to that of a magnetic field produced by the permanent magnet 20, the former magnetic field has a negative magnetic flux density. A current reverse to a current supplied to the main magnetic field fine adjustment electromagnet 35 for generating a magnetic field having the same direction as that of the magnetic field produced by the permanent magnet 20 may be supplied to the main magnetic field fine adjustment electromagnet 35 to generate a magnetic field having a negative magnetic flux density.

Figure 8:
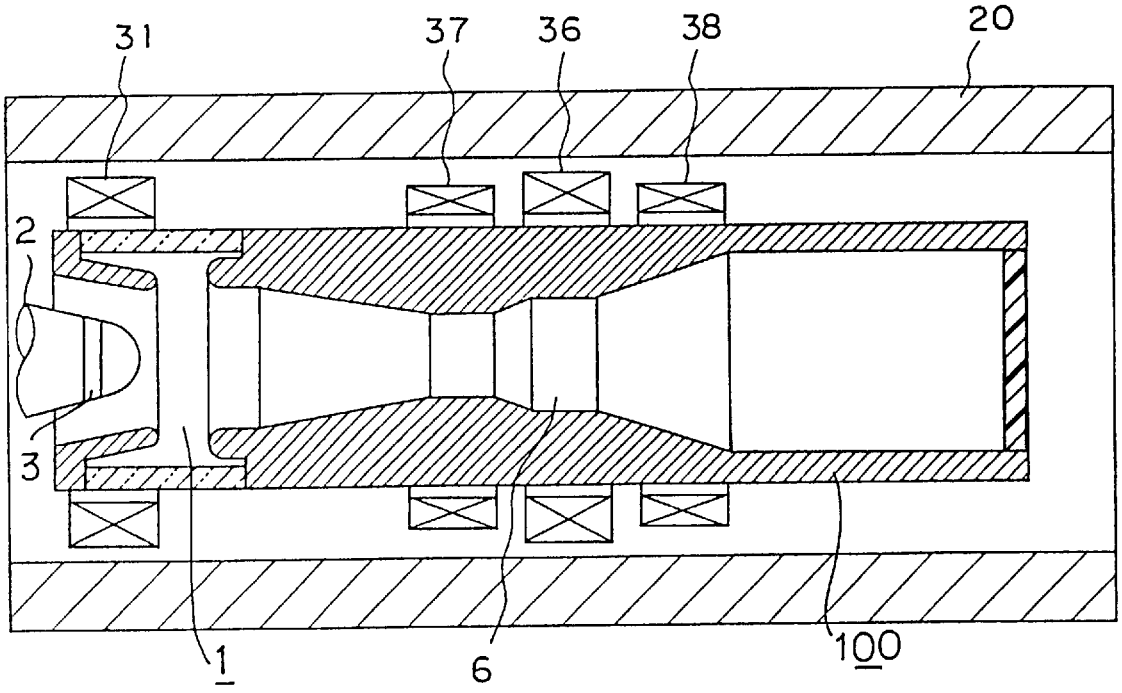
FIG. 8 is a schematic longitudinal sectional view of a gyrotron system in a still further embodiment according to the present invention.

FIG. 8 shows a gyrotron system in a still further embodiment according to the present invention, in which parts like or corresponding to those of the prior art gyrotron system are designated by the same reference characters and the description thereof will be omitted. Reference numerals 36, 37 and 38 designate main magnetic field fine adjustment electromagnets for adjusting the axial distribution of the magnetic flux density of a magnetic field generated in a cavity resonator 6.

As mentioned above, a magnetic field has an important effect on the oscillating operation of the gyrotron 100 and, particularly, the absolute value and the spatial distribution of the magnetic flux density within the cavity resonator 6 in which the interaction between an electron beam and an electromagnetic field occurs have a significant effect on the oscillation efficiency and the like. It is difficult to make the permanent magnet 20, as compared with an electromagnet, produce a design magnetic field accurately; for example, it is difficult to make the permanent magnet 20 produce an axial magnetic field having a uniform spatial magnetic flux density distribution over a long distance.

The eighth embodiment is provided with the main magnetic field fine adjustment electromagnets 36, 37 and 38 to shape the spatial distribution of the magnetic flux density in addition to the compensation of the deviation of the absolute value of the magnetic flux density from the design magnetic flux density. Thus, the disturbed spatial distribution of the magnetic flux density of the magnetic field produced by the permanent magnet 20 can be corrected. It is also possible to adjust the magnetic flux density finely according to the electron beam accelerating voltage for accelerating the electron beam 9 to increase the oscillation efficiency to a maximum, and the oscillation output can be adjusted.

Figure 9:
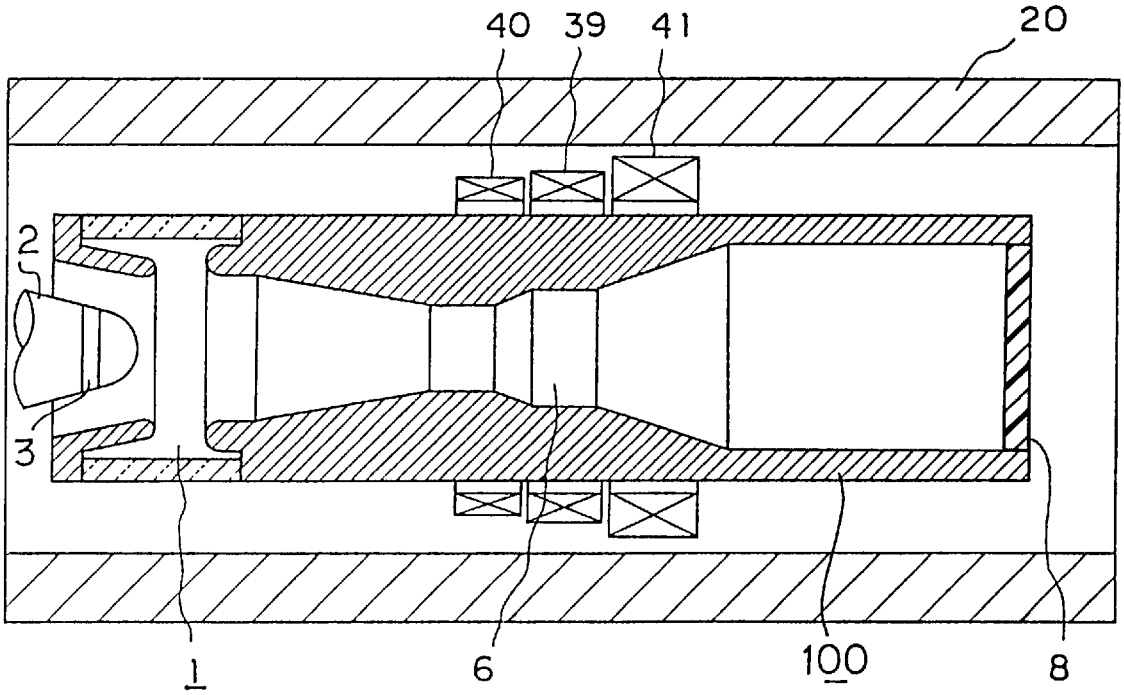
FIG. 9 is a schematic longitudinal sectional view of a gyrotron system in a still further embodiment according to the present invention.

FIG. 9 shows a gyrotron system in a still further embodiment according to the present invention, in which parts like or corresponding to those of the prior art gyrotron system are designated by the same reference characters and the description thereof will be omitted. Reference numerals 39, 40 and 41 designate main magnetic field fine adjustment electromagnets for adjusting the axial distribution of the magnetic flux density within a cavity resonator 6. It is known theoretically that the oscillation efficiency of a gyrotron 100 is higher when the magnetic flux density is distributed in a proper distribution within the cavity resonator 6 than when the magnetic flux density is distributed in a uniform distribution. For example, the oscillation efficiency increases when the magnetic flux density distribution is inclined so that the magnetic flux density at one end of the cavity resonator 6 on the side of an output window 8 is greater by a value in the range of 5 to 10% than that at the other end of the cavity resonator 6 on the side of an electron gun 1.

In this embodiment, the electromagnets 39, 40 and 41 may be magnetized individually or the electromagnets 39, 40 and 41 are formed so that the number of turns of wire of the electromagnet nearer to the output window 8 is greater than that of the electromagnet further from the output window 8 and the electromagnets 39, 40 and 41 are connected in series for simultaneous magnetization as shown in FIG. 9. The numbers of turns of wire and method of forming the coils of the electromagnets 39, 40 and 41, and method of magnetizing the electromagnets 39, 40 and 41 are optional, provided that the axial magnetic flux density distribution within the cavity resonator 6 can be formed so as to improve the oscillation efficiency of the gyrotron. The gyrotron system of FIG. 9 may be provided with an electron gun magnetic field fine adjustment electromagnet if need be.

Figure 10:
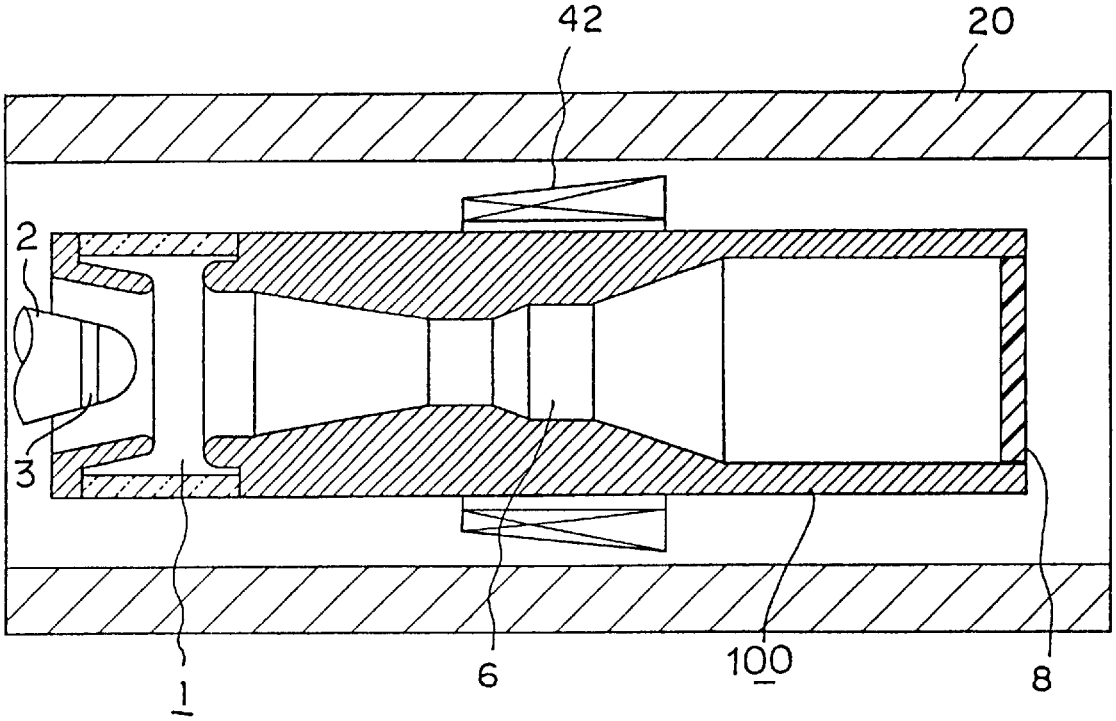
FIG. 10 is a schematic longitudinal sectional view of a gyrotron system in a still further embodiment according to the present invention.

FIG. 10 shows a gyrotron system in a still further embodiment according to the present invention, in which parts like or corresponding to those of the prior art gyrotron system are designated by the same reference characters and the description thereof will be omitted. Reference numeral 42 designates a main magnetic field fine adjustment electromagnet for adjusting the axial distribution of the magnetic flux density of a magnetic field generated in a cavity resonator 6. The main magnetic field fine adjustment electromagnet 42 replaces the main magnetic field fine adjustment electromagnets 39, 40 and 41 of the gyrotron system in the ninth embodiment shown in FIG. 9. The number of turns of wire in unit length of the coil of the main magnetic field fine adjustment electromagnet 42 increases from one end thereof on the side of an electron gun 1 in a cavity resonator 6 toward the other end thereof on the side of an output window 8.

Although the degree of freedom of shaping the axial magnetic flux density distribution is reduced, a magnetic field having a magnetic flux density distribution increasing from the side of the electron gun 1 toward the output window 8 can be generated within the cavity resonator 6 by using a single exciting power supply when the main magnetic field fine adjustment electromagnet 42 having such a axially varying turn density is used. Although the coil of the main magnetic field fine adjustment electromagnet 42 shown in FIG. 10 is formed in the aforesaid construction, the coil may be formed in any construction provided that the main magnetic field fine adjustment electromagnet 42 is capable of shaping the axial magnetic flux density of the magnetic field generated within the cavity resonator 6 so that the oscillation efficiency of the gyrotron 100 is improved. The gyrotron system may be provided with an electron gun magnetic field fine adjustment electromagnet if need be.

Figure 11:
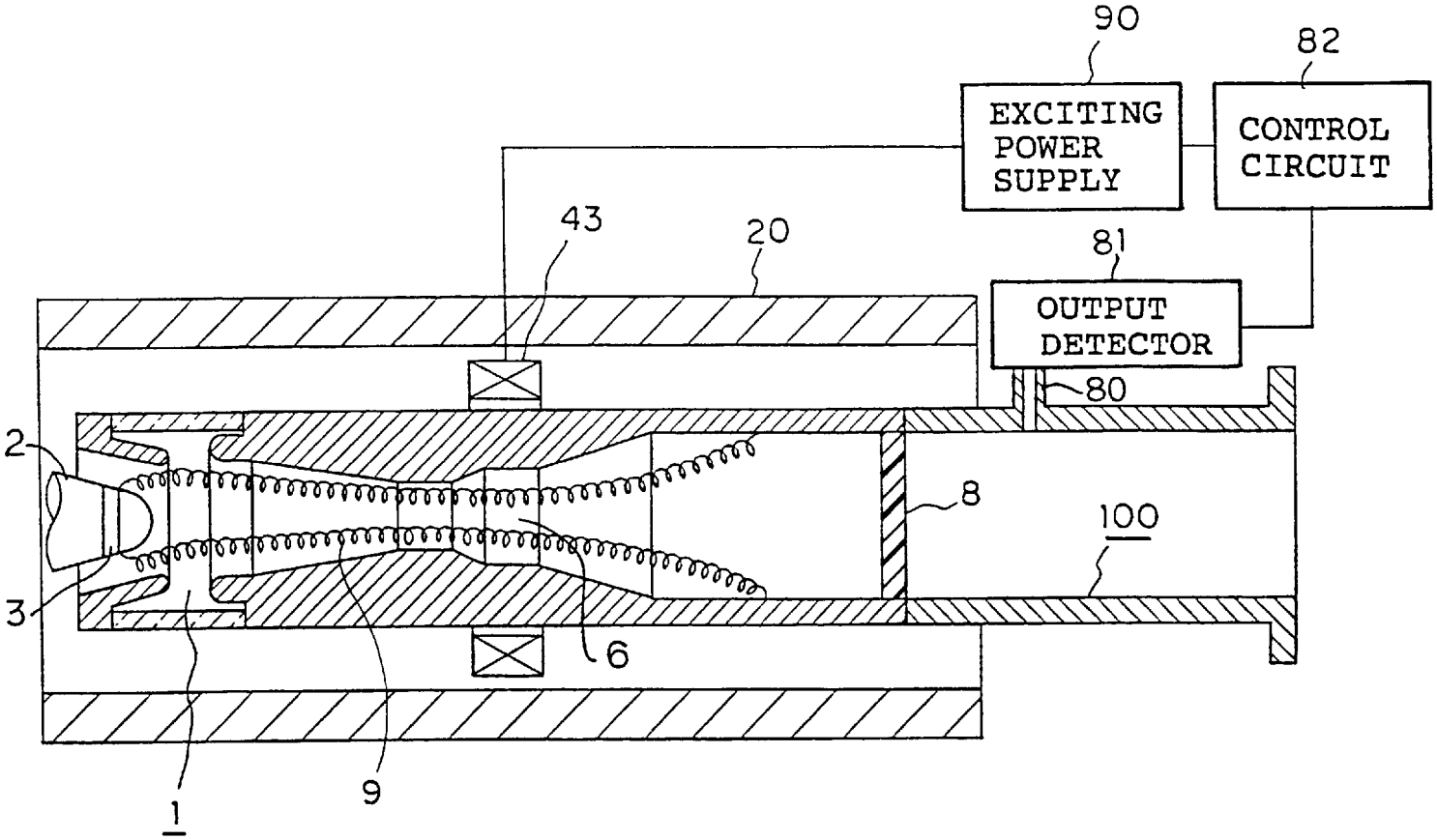
FIG. 11 is a schematic longitudinal sectional view of a gyrotron system in an still further embodiment according to the present invention.

FIG. 11 shows a gyrotron system in a still further embodiment according to the present invention, in which parts like or corresponding to those of the prior art gyrotron system are designated by the same reference characters and the description thereof will be omitted. There are shown a main magnetic field fine adjustment electromagnet 43, a gyrotron 100, a sampling hole 80 through which the output high-frequency wave of the gyrotron 100 is sampled, an output detector 81, an oscillation output measuring and control circuit 82 and an exciting power supply 90.

Generally, the oscillation output of the gyrotron 100 is adjusted by adjusting the electron beam accelerating voltage and the beam current. When the electron beam accelerating voltage or the beam current is changed, the axial magnetic flux density is changed accordingly to maintain the maximum oscillation efficiency of the gyrotron 100 because, as is known from expressions (1) and (2), the axial magnetic flux density of the magnetic field generated within the cavity resonator 6 must be readjusted because the relativistic coefficient $\gamma$ and the axial velocity $V_z$ of electrons change when the electron beam accelerating voltage is changed.

Since the electromagnetic field intensity in the natural mode resonating within the cavity resonator 6 changes when the beam current is changed to change the oscillation output, the axial magnetic field within the cavity resonator 6 needs to be readjusted to maintain an optimum coupling between the electron beam 9 and the electromagnetic field. In most conventional gyrotron systems, the magnetic field generating unit employs electromagnets, and the exciting power supply is capable of automatically increasing or decreasing the output current at a fixed rate to an appropriate set value. However, most conventional gyrotron systems require manual, final fine adjustment. Particularly, when the electromagnet is a superconducting electromagnet, the fine adjustment of the magnetic field takes a considerably long time because the superconducting electromagnet has a high inductance and the current cannot be changed at a high rate.

Furthermore, since the cathode 2 of the electron gun 1 of the gyrotron 100 is a hot cathode, the power supplied to a heater for heating the cathode 2 needs to be changed to change the temperature of the electron emitting part provided on the cathode 2, when the oscillation output power is adjusted by varying the beam current, which, generally, takes a considerably long time. Accordingly, when magnetic field adjustment is necessary to increase the oscillation efficiency to the maximum or when the adjustment of the oscillation output power through the adjustment of the magnetic field is necessary even if the oscillation efficiency is reduced to some extent, it is convenient is the gyrotron system is provided with a device capable of automatically and quickly adjusting the axial magnetic flux density. Although the average output power can be adjusted by adjusting the pulse width of the output of the power supply, such a method of adjusting the average output power requires a costly power supply. Therefore, this embodiment adjusts the oscillation output by adjusting the magnetic field.

The gyrotron system in the eleventh embodiment is provided with an arrangement for detecting the oscillation output of the gyrotron 100 and automatically adjusting the axial magnetic flux density of the magnetic field generated within the cavity resonator 6 so that the oscillation output is adjusted to the maximum output or a predetermined output. The output detector 81 detects the oscillation output of the gyrotron 100 through a sampling hole 80 and provides a signal of a magnitude proportional to the oscillation output. Upon the reception of the output signal of the output detector 81, the oscillation output measuring and control circuit 82 calculates and indicates the oscillation output and gives a control signal to the exciting power supply 90 to enhance the oscillation output or to adjust the oscillation output to a predetermined value, making reference to the history of variation of the oscillation output according to the variation of the magnetic flux density within the cavity resonator. The exciting power supply 90 changes the current supplied to the main magnetic field fine adjustment electromagnet 43 according to the control signal, so that the oscillation output of the gyrotron 100 changes. Thus, the oscillation output is controlled by this feedback loop.

A directional coupler may be used instead of the sampling hole 80. The gyrotron system may be provided with a plurality of main magnetic field fine adjustment electromagnets instead of the main magnetic field fine adjustment electromagnet 43. The requirements of the arrangement of the electromagnets and the numbers of turns of the electromagnets are the same as those previously described in connection with the foregoing embodiments. The gyrotron system in the eleventh embodiment may be provided with an electron gun magnetic field fine adjustment electromagnet, if necessary, although not shown in FIG. 11.

Figure 12:
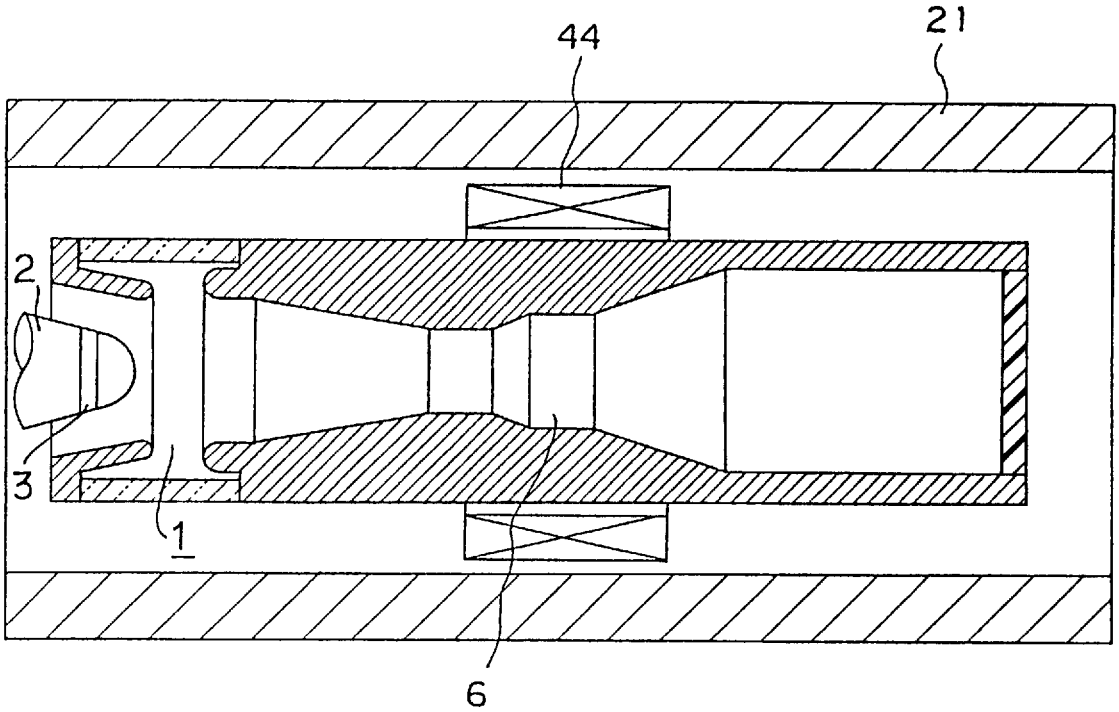
FIG. 12 is a schematic longitudinal sectional view of a gyrotron system in a still further embodiment according to the present invention.

FIG. 12 shows a gyrotron system in a still further embodiment according to the present invention, in which parts like or corresponding to those of the prior art gyrotron system are designated by the same reference characters and the description thereof will be omitted. There are shown a permanent magnet 21 and a main magnetic field fine adjustment electromagnet 44. The gyrotron system needs to be able to operate in a wide range of the electron beam accelerating voltage and a wide range of the beam current to vary the oscillation output of the gyrotron in a wide range. As mentioned above, $\gamma$=1.04 when the electron beam accelerating voltage $V_b$=20 kV and, from expression (3), $\gamma$=1.16 when $V_b$=80 kV. Therefore, from expression (2), the magnetic flux density is about 11.6 kG when the cyclotron frequency of the electron is 28 GHz.

Accordingly, from expression (1), it is necessary to generate a magnetic field of a magnetic flux density slightly smaller than about 5.8 kG within the cavity resonator 6 when the gyrotron operates in a second harmonic oscillation mode at 28 GHz. As mentioned above, since a magnetic field of a magnetic flux density slightly smaller than about 5.2 kG must be generated within the cavity resonator 6 when $V_b$=20 kV, there is the possibility that the necessary axial magnetic flux density cannot be adjusted by the main magnetic field fine adjustment electromagnet 44 when $V_b$=80 kV if the permanent magnet produces a magnetic field of a magnetic flux density of not less than 90% and not greater than 110% of the necessary axial magnetic flux density when $V_b$=20 kV to operate the gyrotron for oscillation in an electron beam accelerating voltage range of 20 kV to 80 kV.

In such a case, the ratio of the magnetic flux density of a magnetic field which can be generated by the main magnetic filed fine adjustment electromagnet 44 to the total magnetic flux density necessary for the oscillating operation of the gyrotron is increased. The capacity of the main magnetic field fine adjustment electromagnet 44 employed in this embodiment is greater than that of the main magnetic field fine adjustment electromagnet 35 employed in the seventh embodiment, and the main magnetic field fine adjustment electromagnet 44 is capable of generating a magnetic field of ±20% of the axial magnetic field to be generated in the central portion of the cavity resonator 6. Therefore, a magnetic field of an axial magnetic flux density of not smaller than 80% and not greater than 120% to be produced in the central portion of the cavity resonator 6 is produced by the permanent magnet 21. The gyrotron system may be provided with an electron gun magnetic field fine adjustment electromagnet if need be.

The gyrotron system thus constructed needs an exciting power supply of a comparatively small capacity, operates at a comparatively small power consumption and a reduced running cost, and is capable of adjusting the axial magnetic flux density necessary for the oscillating operation of the gyrotron.

While this embodiment has been described as applied to operation at an oscillation frequency of 28 GHz, the foregoing description holds good in cases where the gyrotron system operates at different oscillation frequencies. The cavity resonator 6 has a plurality of natural modes differing in resonant frequency from each other. Accordingly, the gyrotron is able to oscillate in the plurality of natural modes having different resonant frequencies when the main magnetic field fine adjustment electromagnet 44 is capable of adjusting the magnetic flux density in a wide range.

Figure 13:
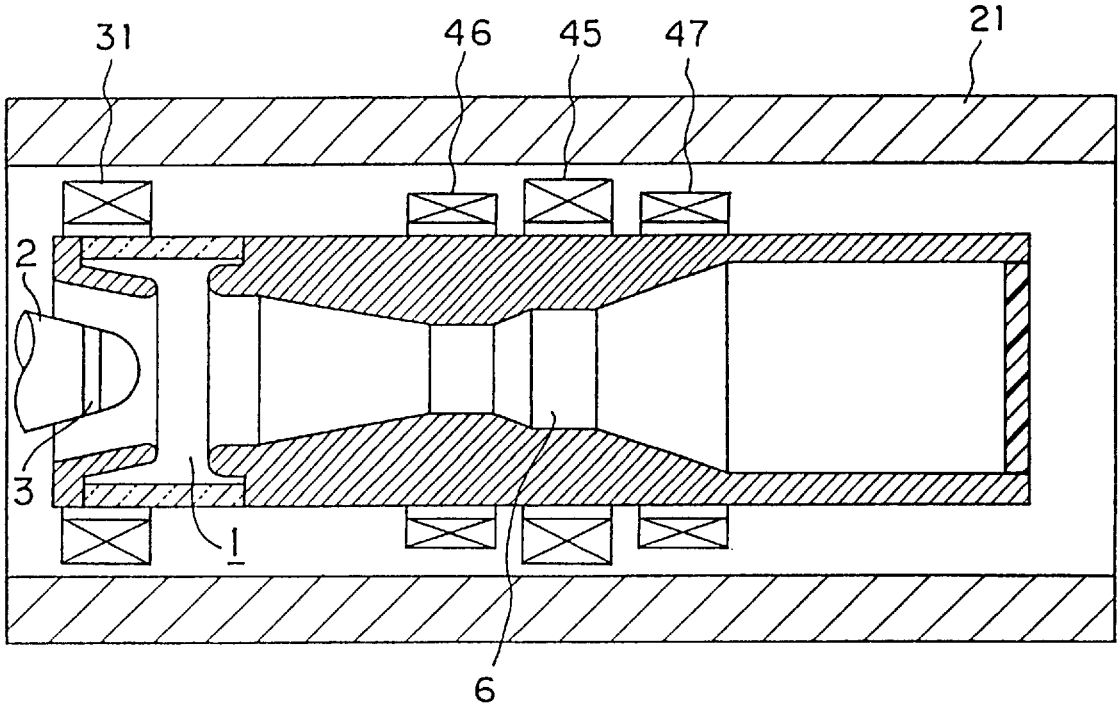
FIG. 13 is a schematic longitudinal sectional view of a gyrotron system in a still further embodiment according to the present invention.

FIG. 13 shows a gyrotron system in a still further embodiment according to the present invention, in which parts like or corresponding to those of the prior art gyrotron system are designated by the same reference characters and the description thereof will be omitted. There are provided three main magnetic field fine adjustment electromagnets 45, 46 and 47. The number of main magnetic field fine adjustment electromagnets need not necessarily be limited to three; the gyrotron system may be provided with two, four or any number of main magnetic field fine adjustment electromagnets necessary for generating and adjusting a main magnetic field necessary for the oscillation of the gyrotron. The main magnetic field fine adjustment electromagnets 45, 46 and 47 may be magnetized either individually or not individually.

Figure 14:
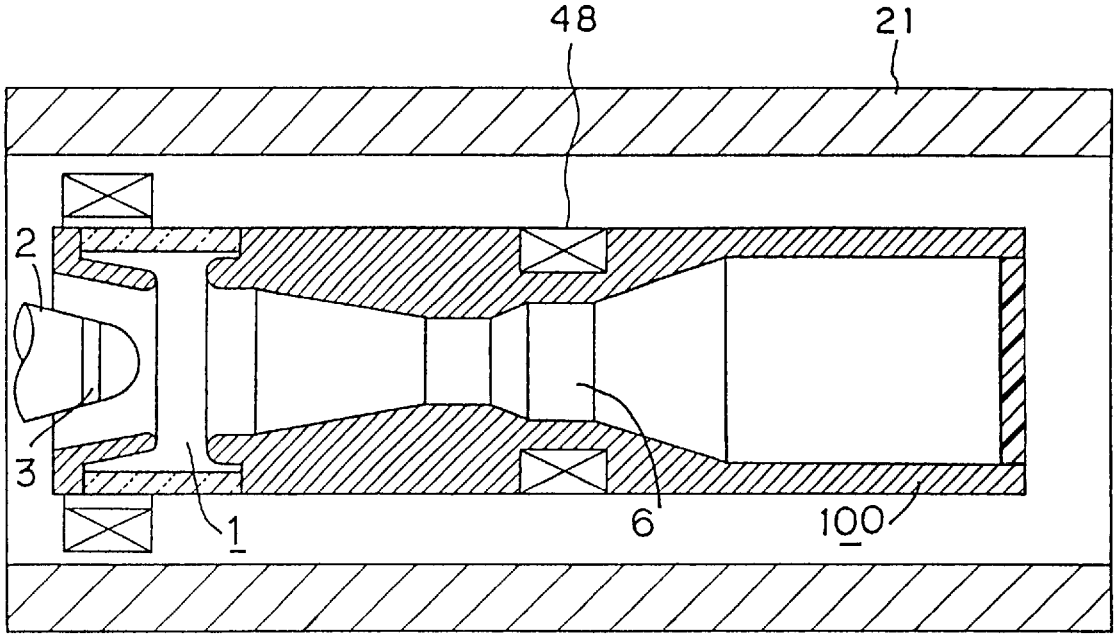
FIG. 14 is a schematic longitudinal sectional view of a gyrotron system in a still further embodiment according to the present invention.

FIG. 14 shows a gyrotron system in a still further embodiment according to the present invention, in which parts like or corresponding to those of the prior art gyrotron system are designated by the same reference characters and the description thereof will be omitted. The fourteenth embodiment is the same in construction and function as the second embodiment shown in FIG. 2, except that the gyrotron system in the fourteenth embodiment is provided with a main magnetic field fine adjustment electromagnet 48 capable of generating a magnetic field of an axial magnetic flux density of ±20% of an axial magnetic flux density necessary for the oscillating operation of the gyrotron. The permanent magnet 21 of the gyrotron system is able to produce an axial magnetic field more easily when the inside diameter of the permanent magnet 21 is smaller, and the permanent magnet 21 having a small inside diameter is small and lightweight, and can be obtained at a reduced cost. Therefore, if only a narrow space is available between the outer surface of the gyrotron 100 and the inner surface of the permanent magnet 21, the coils of the main magnetic field fine adjustment electromagnet 48 may be wound directly on the outer surface of the gyrotron 100 or the main magnetic field fine adjustment electromagnet 48 may be fitted in a groove formed in the outer surface of a cavity resonator 6 included in the gyrotron 100 as shown in FIG. 14. The smaller the inside diameter of the main magnetic field fine adjustment electromagnet 48, the less the power consumption of the main magnetic field fine adjustment electromagnet 48 for generating the same magnetic field. Therefore, the arrangement of the main magnetic field fine adjustment electromagnet 48 as shown in FIG. 14 is preferable.

Figure 15:
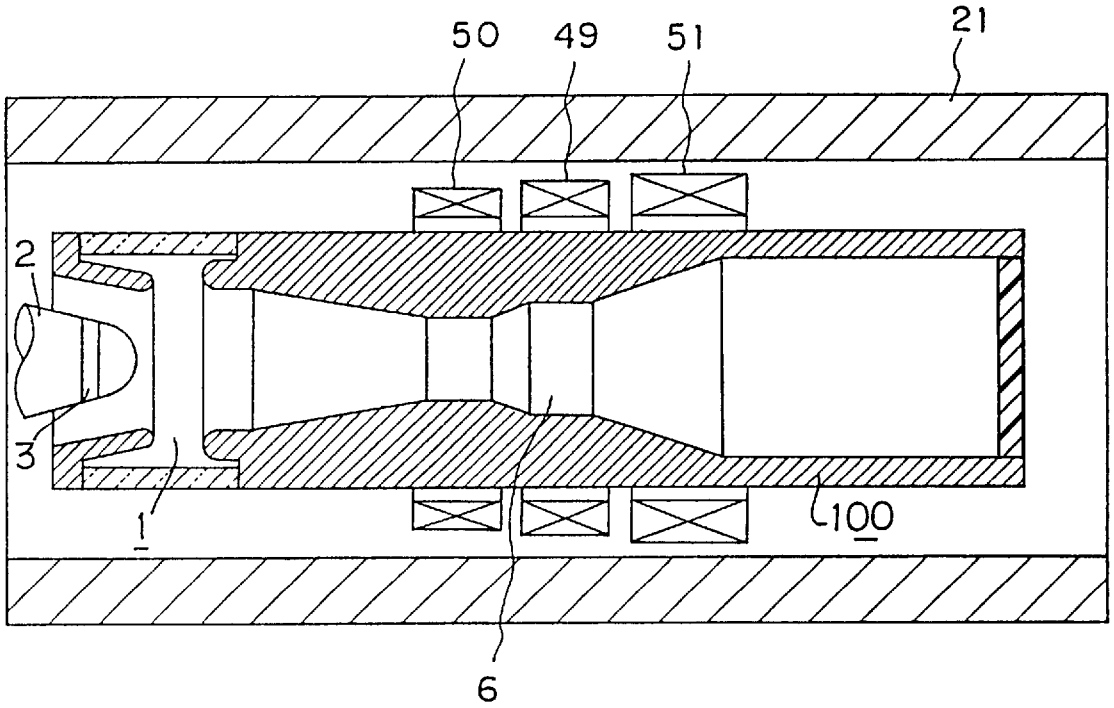
FIG. 15 is a schematic longitudinal sectional view of a gyrotron system in a still further embodiment according to the present invention.

FIG. 15 shows a gyrotron system in a still further embodiment according to the present invention, in which parts like or corresponding to those of the prior art gyrotron system are designated by the same reference characters and the description thereof will be omitted. The fifteenth embodiment is the same in construction and function as the ninth embodiment shown in FIG. 9 and is provided with main magnetic field fine adjustment electromagnets 49, 50 and 51 capable of generating a magnetic field of a magnetic flux density of ±20% of an axial magnetic flux density necessary for the oscillating operation of a gyrotron 100. The fifteenth embodiment is capable of adjusting the axial magnetic flux density in a magnetic flux density adjusting range wider than that in which the ninth embodiment is capable of adjusting the axial magnetic flux density. The gyrotron system shown in FIG. 15 may be provided with an electron gun magnetic field fine adjustment electromagnet if need be.

Figure 16:
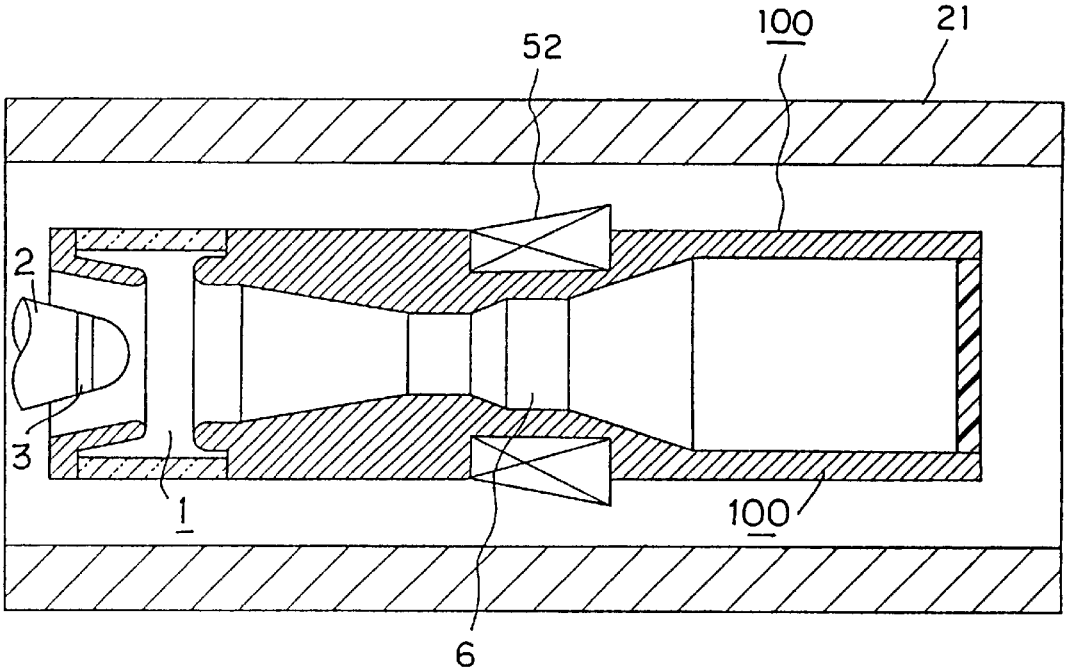
FIG. 16 is a schematic longitudinal sectional view of a gyrotron system in a still further embodiment according to the present invention.

FIG. 16 shows a gyrotron system in a still further embodiment according to the present invention, in which parts like or corresponding to those of the prior art gyrotron system are designated by the same reference characters and the description thereof will be omitted. This embodiment is the same in construction and function as the tenth embodiment shown in FIG. 10 and is provided with a main magnetic field fine adjustment electromagnet 52 capable of generating a magnetic field of a magnetic flux density of ±20% of an axial magnetic flux density necessary for the oscillating operation of a gyrotron. The sixteenth embodiment is capable of adjusting the axial magnetic flux density in a magnetic flux density adjusting range wider than that in which the tenth embodiment is capable of adjusting the axial magnetic flux density.

The coil of the main magnetic field fine adjustment electromagnet 52 is wound in a groove formed near a cavity resonator 6 included in the gyrotron 100 in the outer surface of the cavity resonator 6. However, if a sufficiently large space is available near the cavity resonator 6 between the inner surface of a permanent magnet 21 and the outer surface of the gyrotron 100, the coil of the main magnetic field fine adjustment electromagnet 52 may be wound on the outer surface of the gyrotron 100 without forming any groove in the outer surface of the gyrotron 100. The gyrotron system in FIG. 16 may be provided with an electron gun magnetic field fine adjustment electromagnet if need be.

Figure 17:
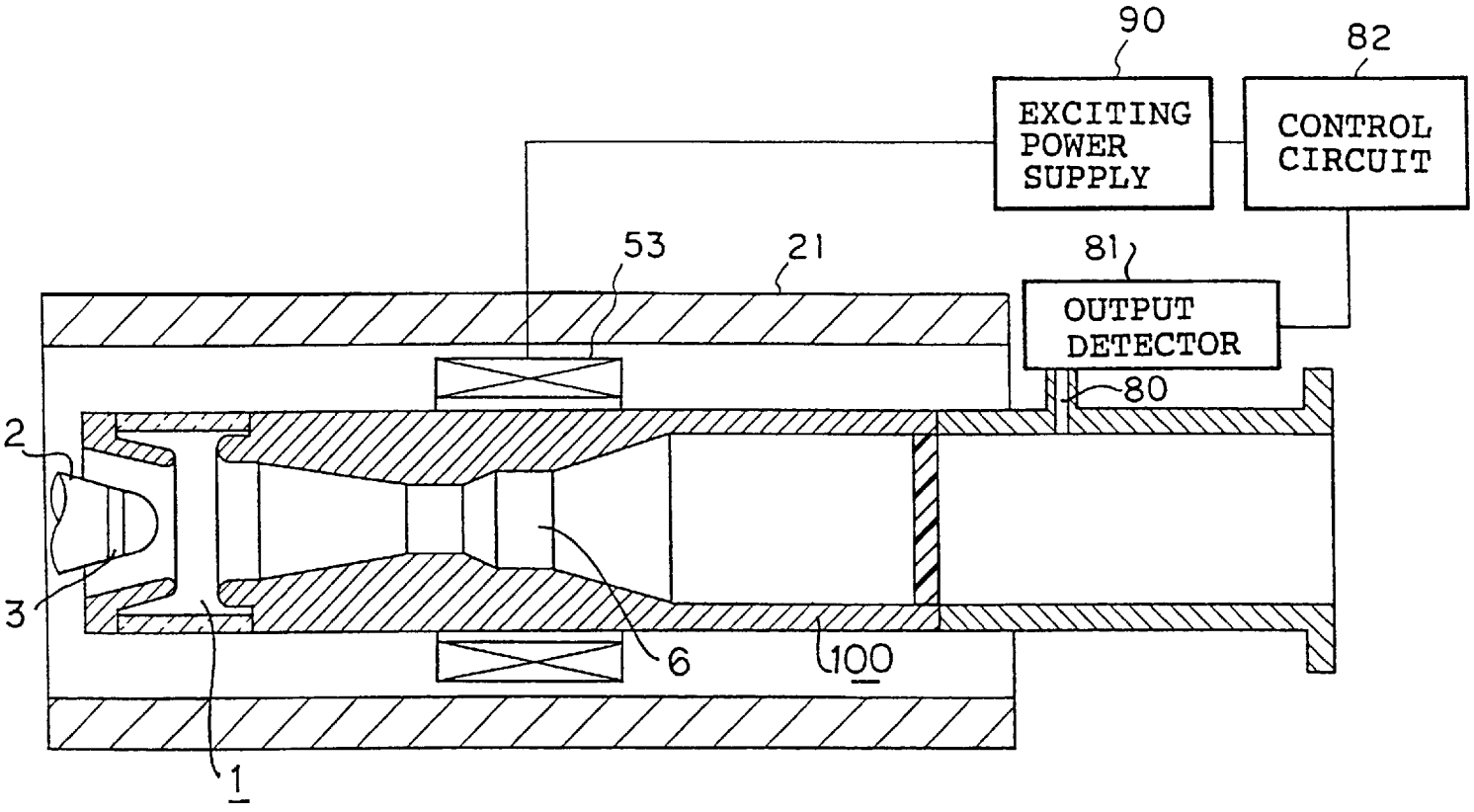
FIG. 17 is a schematic longitudinal sectional view of a gyrotron system in a still further embodiment according to the present invention.

FIG. 17 shows a gyrotron system in a still further embodiment according to the present invention, in which parts like or corresponding to those of the prior art gyrotron system are designated by the same reference characters and the description thereof will be omitted. The seventeenth embodiment is the same in construction and function as the eleventh embodiment shown in FIG. 11 and is provided with a main magnetic field fine adjustment electromagnet 53 capable of generating a magnetic field of a axial magnetic flux density of ±20% of the axial magnetic flux density necessary for the oscillating operation of a gyrotron 100. The gyrotron system is provided with an arrangement for detecting the oscillation output of the gyrotron 100 and automatically adjusting the axial magnetic flux density of the magnetic field generated within the cavity resonator 6 so that the oscillation output is adjusted to the maximum output or a predetermined output. An output detector 81 detects the oscillation output of the gyrotron 100 through a sampling hole 80 and provides a signal of a magnitude proportional to the oscillation output. Upon the reception of the output signal of the output detector 81, an oscillation output measuring and control circuit 82 calculates and indicates the oscillation output and gives a control signal to an exciting power supply 90 to enhance the oscillation output or to adjust the oscillation output to a predetermined value, making reference to the history of variation of the oscillation output according to the variation of the magnetic flux density within the cavity resonator. The exciting power supply 90 changes the current supplied to the main magnetic field fine adjustment electromagnet 53 according to the control signal, so that the oscillation output of the gyrotron 100 changes. Thus, the oscillation output is controlled by this feedback loop.

This embodiment thus constructed is capable of adjusting the axial magnetic flux density in a magnetic flux density adjusting range wider than that in which the eleventh embodiment is capable adjusting the axial magnetic flux density. The gyrotron system in the seventeenth embodiment may be provided with an electron gun magnetic field fine adjustment electromagnet, if necessary, although not shown in FIG. 17.

Figure 18:
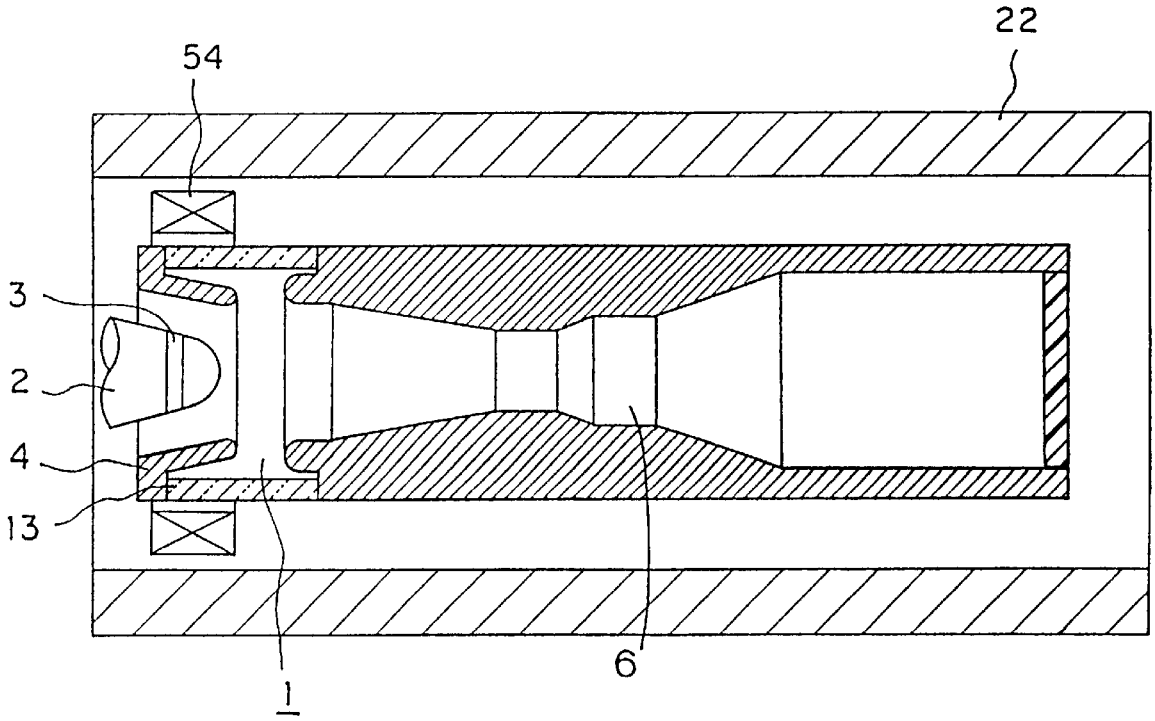
FIG. 18 is a schematic longitudinal sectional view of a gyrotron system in an still further embodiment according to the present invention.

FIG. 18 shows a gyrotron system in a still further embodiment according to the present invention, where at 22 is indicated a permanent magnet and at 54 is indicated an electron gun magnetic field fine adjustment electromagnet for the fine adjustment of a magnetic field generated around an electron emitting part 3 provided on the cathode 2 of an electron gun 1. Generally, the magnetic flux density of the magnetic field generated around the electron emitting part 3 is about ⅕ or below of the magnetic flux density of a main magnetic field. As mentioned in connection with the description of the seventh embodiment shown in FIG. 7, for example, the magnetic flux density of a magnetic field generated within a cavity resonator is about 5.2 kG for 28 GHz oscillation at the second harmonic oscillation and hence the magnetic flux density of the magnetic field generated around the electron emitting part 3 is on the order of 1.04 kG. If the permanent magnet 22 produces a magnetic field having a magnetic flux density not less than 50% and not greater than 150% of the magnetic flux density, the electron gun magnetic field fine adjustment electromagnet 54 needs to generate a magnetic field of a magnetic flux density of ±0.52 kG or below around the electron emitting part 3 and, therefore, the electron gun magnetic field fine adjustment electromagnet 54 may be small and lightweight, and is able to operate at a low power consumption and a reduced running cost.

Since voltages are applied to the cathode 2 and the first anode 4 of the electron gun 1, the gyrotron system is provided with an insulating member 13 for electrical insulation. Generally, the insulating member 13 is formed of alumina, and Kovar is brazed to the opposite ends of the alumina insulating member 13 to enable the alumina insulating member 13 to be connected to metal parts. However, there is the possibility that the magnetic field generated around the insulating member 13 is disturbed because Kovar is a magnetic substance. If a magnetic field is produced near the electron gun 1 only by the permanent magnet 22, the disturbed magnetic field distribution cannot be corrected and the disturbed magnetic field distribution may affect adversely to an electron beam 9 emitted from the electron gun 1.

The electron gun magnetic field fine adjustment electromagnet 54 is capable of correcting the disturbed magnetic field distribution. When the direction of a magnetic field generated by the main magnetic field fine adjustment electromagnet 54 is reverse to that of a magnetic field produced by the permanent magnet 22, the former magnetic field has a negative magnetic flux density. A current reverse to a current supplied to the main magnetic field fine adjustment electromagnet 54 for generating a magnetic field having the same direction as that of the magnetic field produced by the permanent magnet 22 may be supplied to the main magnetic field fine adjustment electromagnet 54 to generate a magnetic field having a negative magnetic flux density.

Figure 19:
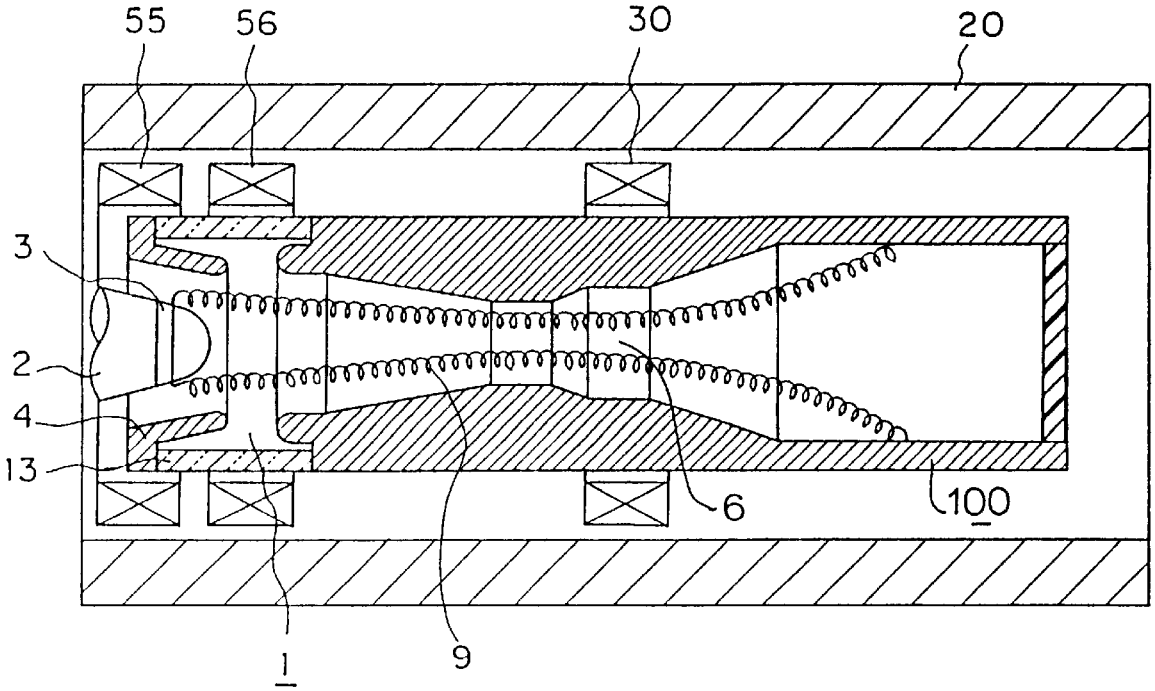
FIG. 19 is a schematic longitudinal sectional view of a gyrotron system in a still further embodiment according to the present invention.

FIG. 19 shows a gyrotron system in a still further embodiment according to the present invention, in which parts like or corresponding to those of the prior art gyrotron system are designated by the same reference characters and the description thereof will be omitted. Electron gun magnetic field fine adjustment electromagnets 55 and 56 adjust the axial distribution of the magnetic flux density of a magnetic field generated in the electron gun 1. As mentioned above, a magnetic field has an important effect on the oscillating operation of a gyrotron 100, and the absolute value and the distribution of the magnetic flux density around the electron emitting part affects greatly the characteristics of an electron beam 9 and the radial position of the electron beam 9 in a cavity resonator. The fine adjustment of the absolute value and the distribution of the magnetic flux density of a magnetic field produced by a permanent magnet 20, as compared with the fine adjustment of those of a magnetic field generated by an electromagnet, is difficult. Accordingly, when the gyrotron system is provided with the electron gun magnetic field fine adjustment electromagnets 55 and 56 as shown in FIG. 19, the absolute value and the distribution of the magnetic flux density can be readily adjusted to an optimum value and an optimum distribution to enable the gyrotron system to operate at a maximum oscillation efficiency.

Since voltages are applied to the cathode 2 and the first anode 4 of the electron gun 1, the gyrotron system is provided with an insulating member 13 for electrical insulation. Generally, the insulating member 13 is formed of alumina, and Kovar is brazed to the opposite ends of the insulating member 13 to enable the alumina insulating member 13 to be connected to metal parts. However, there is the possibility that the magnetic field generated around the insulating member 13 is disturbed because Kovar is a magnetic substance. If a magnetic field is produced near the electron gun 1 only by the permanent magnet 20, the disturbed magnetic field distribution cannot be corrected and the disturbance of the magnetic field distribution may affect adversely to an electron beam 9 emitted from the electron gun 1. The electron gun magnetic field fine adjustment electromagnets 55 and 56 are capable of correcting the disturbed magnetic field distribution. Although only the electron gun magnetic field fine adjustment electromagnets 55 and 56 are shown in FIG. 19, the gyrotron system may be provided with three or more electron gun magnetic field fine adjustment electromagnets.

Figure 20:
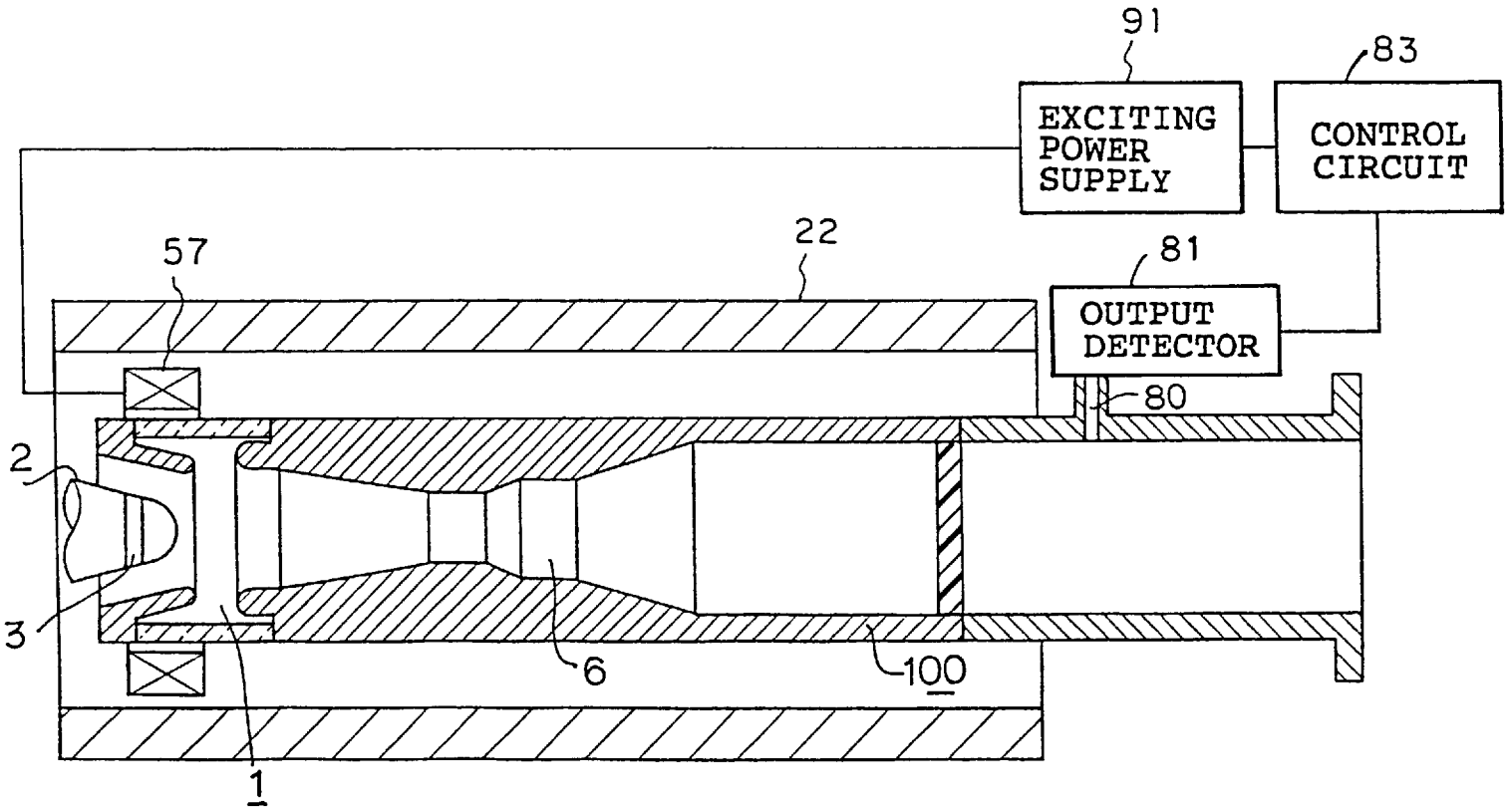
FIG. 20 is a schematic longitudinal sectional view of a gyrotron system in a still further embodiment according to the present invention.

FIG. 20 shows a gyrotron system in a still further embodiment according to the present invention, in which parts like or corresponding to those of the prior art gyrotron system are designated by the same reference characters and the description thereof will be omitted. There are shown an electron gun magnetic field fine adjustment electromagnet 57 for the fine adjustment of a magnetic field generated around an electron emitting part 3 provided on the cathode 2 of an electron gun 1, an oscillation output measuring and control circuit 83, and an exciting power supply 91 for magnetizing the electron gun magnetic field fine adjustment electromagnet 57. While the gyrotron system in the eleventh embodiment shown in FIG. 11 increases the oscillation efficiency to a maximum and adjusts the oscillation output by the main magnetic field fine adjustment electromagnet 43, the gyrotron system in this embodiment adjusts the magnetic field generated around the electron gun for the same purpose.

An output detector 81 detects part of the oscillation output of a gyrotron 100 through a sampling hole 80 and provides a signal of a magnitude proportional to the oscillation output. Upon the reception of the output signal of the output detector 81, the oscillation output measuring and control circuit 83 calculates and indicates the oscillation output and gives a control signal to the exciting power supply 91 to enhance the oscillation output or to adjust the oscillation output to a predetermined value, making reference to the history of variation of the oscillation output according to the variation of the magnetic flux density of a magnetic field generated around the electron gun 1. Then, the exciting power supply 91 changes the current supplied to the electron gun magnetic field fine adjustment electromagnet 57 according to the control signal, so that the oscillation output of the gyrotron 100 changes. Thus, the oscillation output is controlled by this feedback loop.

A directional coupler may be used instead of the sampling hole 80. The gyrotron system may be provided with a plurality of electron gun magnetic field fine adjustment electromagnets instead of the electron gun magnetic field fine adjustment electromagnet 57. Conditions stated in connection with the description of the foregoing embodiments hold good for the disposition of the electromagnet and the number of turns of the electromagnet. The gyrotron system shown in FIG. 20 may be provided with an electron gun magnetic field fine adjustment electromagnet if need be.

Figure 21:
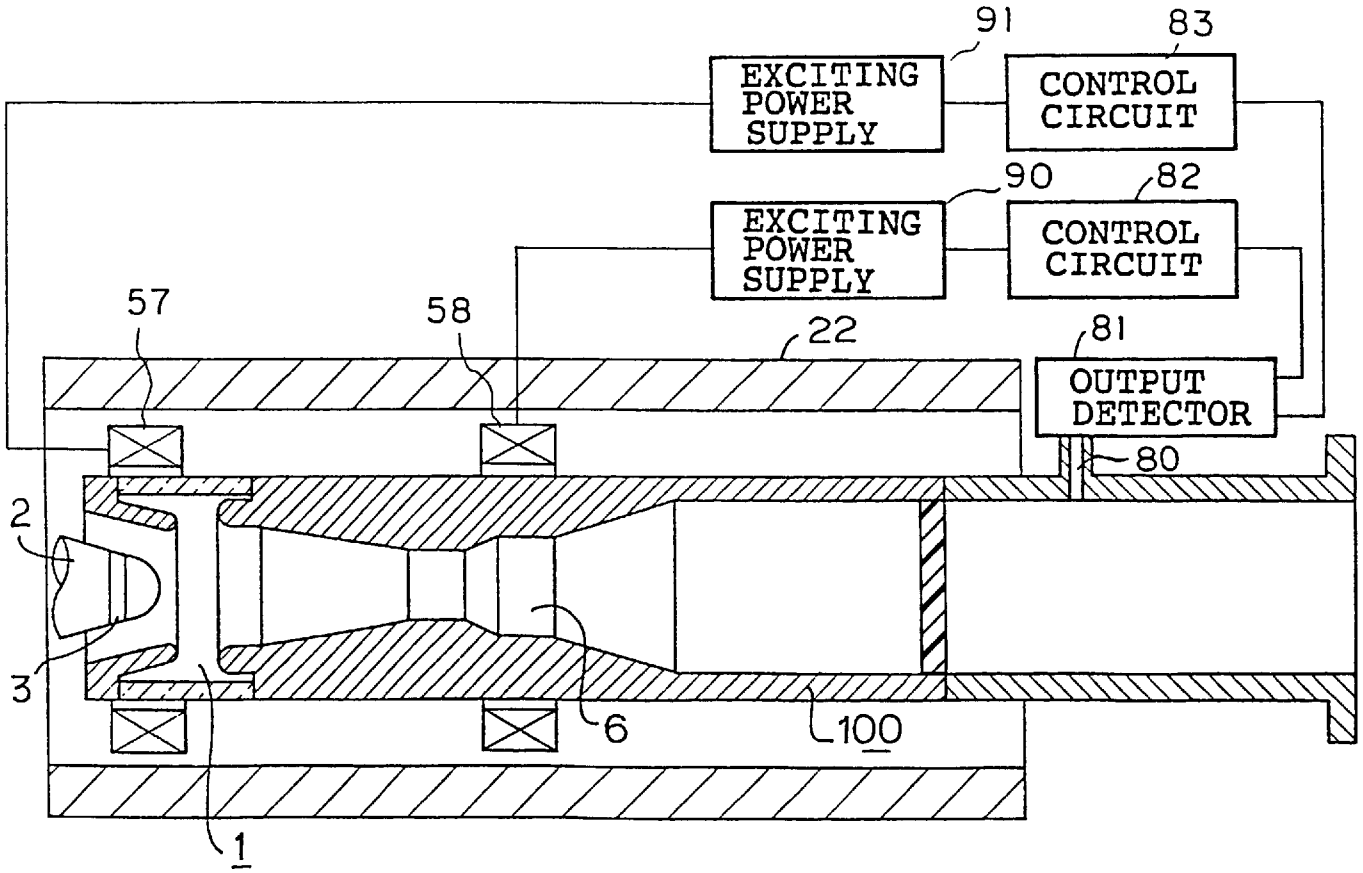
FIG. 21 is a schematic longitudinal sectional view of a gyrotron system in a still further embodiment according to the present invention.

FIG. 21 shows a gyrotron system in a still further embodiment according to the present invention, in which parts like or corresponding to those of the prior art gyrotron system are designated by the same reference characters and the description thereof will be omitted. Reference numeral 58 designates a main magnetic field fine adjustment electromagnet. In each of the embodiments previously described with reference to FIGS. 11, 17 and 20, the output detector 81 detects the oscillation output through the sampling hole 80, and the current supplied to the main magnetic field fine adjustment electromagnet or the electron gun magnetic field fine adjustment electromagnet is controlled individually according to the output signal of the output detector 81. This embodiment uses exciting power supplies 90 and 91 and oscillation output measuring and control circuits 82 and 83 in combination. The use of the two exciting power supplies 90 and 91 and the two oscillation output measuring and control circuits 82 and 83 enables the fine adjustment of the oscillation efficiency and the oscillation output through the adjustment of magnetic fields and further enhances the efficiency of oscillating operation of the gyrotron 100.

Figure 22:
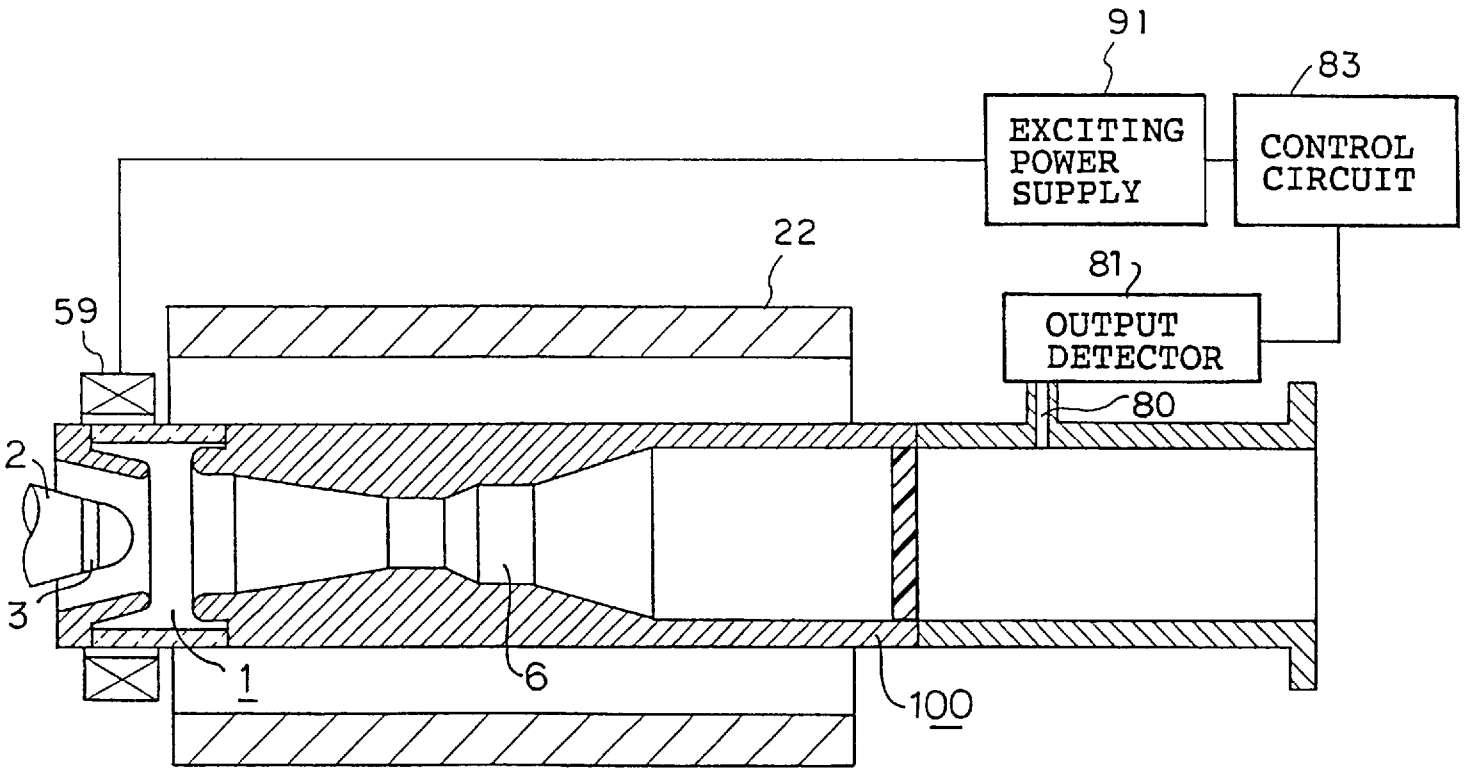
FIG. 22 is a schematic longitudinal sectional view of a gyrotron system in a still further embodiment according to the present invention.

FIG. 22 shows a gyrotron system in a still further embodiment according to the present invention, in which parts like or corresponding to those of the prior art gyrotron system are designated by the same reference characters and the description thereof will be omitted. While the electron gun 1 of the gyrotron 100 of each of the gyrotron systems shown in FIGS. 20 and 21 is contained in the central bore of the permanent magnet 22, the electron gun 1 of a gyrotron 100 included in this embodiment is disposed outside one end of a permanent magnet 22. Even though the electron gun 1 is disposed outside the permanent magnet 22, a magnetic field generated around the electron gun 1 can be effectively adjusted by an electron gun magnetic field fine adjustment electromagnet 59 disposed near the electron gun 1. The main magnetic field fine adjustment electromagnet may be disposed near a cavity resonator 6 if need be.

Figure 23:
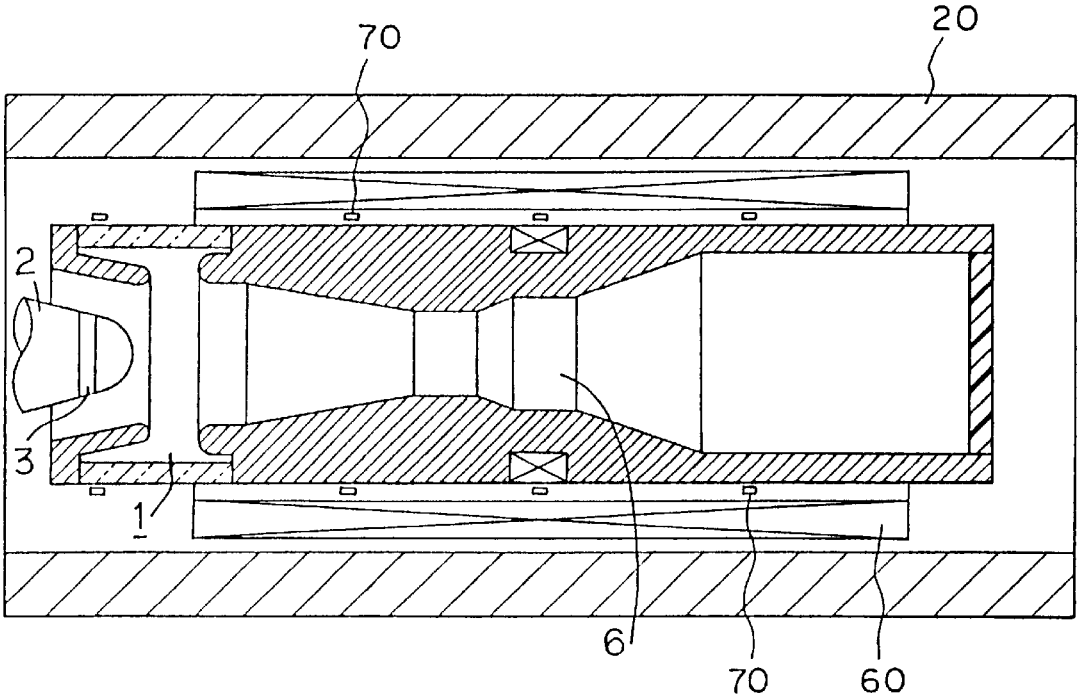
FIG. 23 is a schematic longitudinal sectional view of a gyrotron system in a still further embodiment according to the present invention.

FIG. 23 shows a gyrotron system in a still further embodiment according to the present invention, in which parts like or corresponding to those of the prior art gyrotron system are designated by the same reference characters and the description thereof will be omitted. There is shown a magnetic flux density detectors 70, such as Hall devices, to detect the variation of the magnetic flux density of the magnetic field produced by a permanent magnet 20 due to aging. Generally, the magnetic flux density of the magnetic field produced by a permanent magnet decreases with time due to aging. Therefore, in some cases, the magnetic field produced by a permanent magnet needs correction. Ordinarily, a necessary yearly correction is not greater than 1% of the magnetic flux density of the magnetic field produced by the permanent magnet when the permanent magnet is used at a room temperature. Such a correction can be satisfactorily made by a magnetic field correcting electromagnet 60 as shown in FIG. 23 or a plurality of magnetic field correcting electromagnets, and a small-capacity exciting power supply. Such a correction may be made by the main magnetic field fine adjustment electromagnet and/or the electron gun magnetic field fine adjustment electromagnet employed in each of the foregoing embodiments shown in FIGS. 1 to 22 or by the magnetic field correcting electromagnet 60 employed in this embodiment specially for compensating the time-dependent variation of the magnetic flux density due to the aging of the permanent magnet 20.

Figure 24:
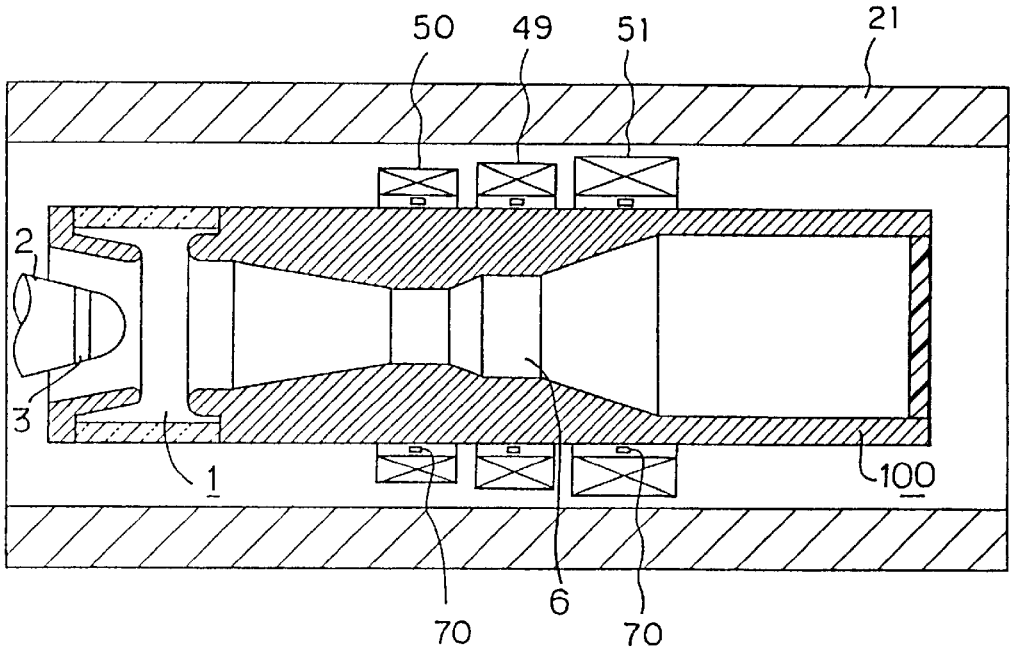
FIG. 24 is a schematic longitudinal sectional view of another gyrotron system in a still further embodiment according to the present invention.

Referring to FIG. 24, a gyrotron system in a still further embodiment according to the present invention is provided with the main magnetic field fine adjustment electromagnets 49, 50 and 51, which are described in the fifteenth embodiment shown in FIG. 15, and a permanent magnet 21. The variation of the magnetic flux density of a magnetic field produced by the permanent magnet 21 with time due to aging is compensated by the main magnetic field fine adjustment electromagnets 49, 50 and 51. This arrangement ensures the initial efficient operation of a gyrotron 100 and the initial effective control of high-frequency output regardless of the time-dependent variation of the magnetic flux density of the magnetic field produced by the permanent magnet 21 due to the aging of the permanent magnet 21. While the magnetic flux density detectors 70, such as Hall devices, are disposed between the magnetic field correcting electromagnet 60 and the gyrotron 100 and between the main magnetic field fine adjustment electromagnets 49, 50 and 51 and the gyrotron 100, respectively, in the embodiments shown in FIGS. 23 and 24, the magnetic flux density detectors 70 may be disposed between the magnetic field correcting electromagnet 60 and the permanent magnet 20 and between the main magnetic field fine adjustment electromagnets 49, 50 and 51 and the permanent magnet 21, respectively.

Figure 25:
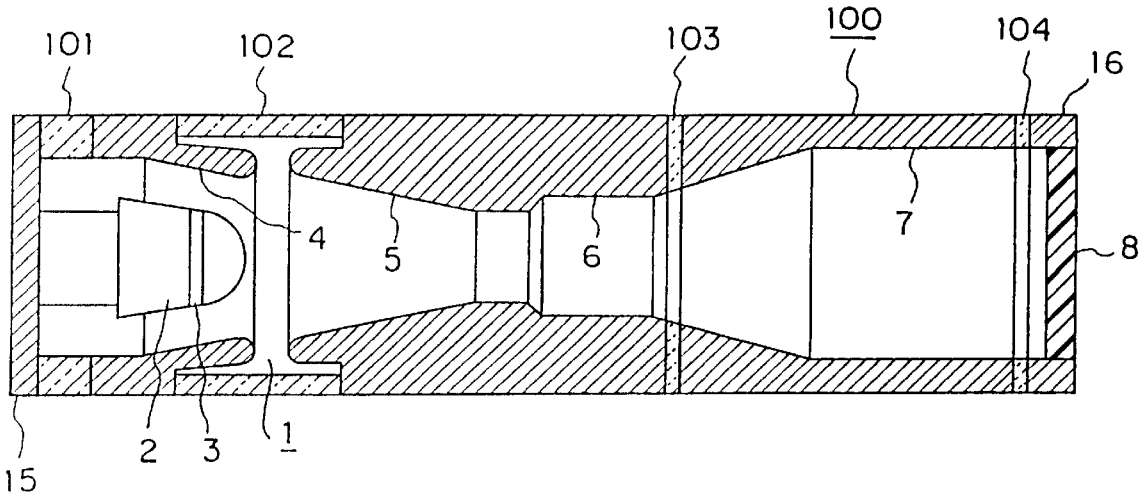
FIG. 25 is a schematic fragmentary longitudinal sectional view of a gyrotron system in a still further embodiment according to the present invention.

FIG. 25 shows a gyrotron included in a gyrotron system in a still further embodiment according to the present invention, in which parts like or corresponding to those of the prior art gyrotron system are designated by the same reference characters and the description thereof will be omitted. There are shown a cathode flange 15, a first anode 4, an insulating member 101 interposed between the cathode flange 15 and the first anode 4, a second anode 5, an insulating member 102 interposed between the first anode 4 and the second anode 5, a cavity resonator 6, a collector 7, an insulating member 103 interposed between the cavity resonator 6 and the collector 7, an output waveguide 16, and an insulating member 104 interposed between the collector 7 and the output waveguide 16. The insulating members and the metal parts are joined together with nickel-plated layers of a nonmagnetic material, such as molybdenum or tungsten, respectively. Although nickel is a magnetic substance, the influence of nickel plating on the magnetic field is insignificant. In FIG. 25, the cathode flange 15, the first anode 4, the second anode 5, the side walls of the cavity resonator 6, the collector 7 and the output waveguide 16 are metal parts.

In a gyrotron 100, generally, all or some of the joints between the adjacent parts are electrically insulated by insulating members 101, 102, 103, 104 each formed of alumina, to apply voltages across a cathode 2 and the first anode 4 and across the first anode 4 and the second anode 5 to make an electron gun 1 emit electrons, and to measure the quantities of electrons coming into the cavity resonator 6, the collector 7 and an output window 8. Kovar is brazed to the opposite ends of the alumina insulating member to enable the alumina insulating member to be connected to metal parts.

Alumina is readily available and has a high strength, and Kovar has a thermal expansion coefficient approximately equal to that of alumina and is used widely for being brazed with alumina parts. However, since Kovar is a magnetic substance, there is the possibility that a magnetic field is disturbed when such a part is placed in the magnetic field and the disturbance of the magnetic field affects the path and the characteristics of the electron beam adversely. If the magnetic field is disturbed, the electron beam will not travel along a predetermined path, oscillation in a natural mode other than a design mode may occur or oscillation efficiency may be reduced. Furthermore, the electron beam will be locally concentrated on the collector 7 to overheat the collector 7 or the electron beam will fall on the output window 8 to damage the output window 8.

The magnetic field generating unit of the conventional gyrotron system provided with only electromagnets deals with the aforesaid troubles by adjusting the currents flowing through the coils of the electromagnets. Since the range of adjustment of the absolute value of the magnetic flux density of a magnetic field and the range of adjustment of magnetic flux density distribution of the magnetic field generating unit in accordance with the present invention provided with both a permanent magnet and electromagnets in combination are not as wide as those of the conventional magnetic field generating unit, there is the possibility that the magnetic field generating unit in accordance with the present invention is unable to correct completely a disturbed magnetic field disturbed by the magnetic member placed in the magnetic field.

In this embodiment, the absolute value of the magnetic flux density of a magnetic field generated by the magnetic field generating unit is not changed, the magnetic flux density distribution is not disturbed and hence any adverse effect does not act on the characteristics and the path of the electron beam even though a gyrotron 100 is disposed within the magnetic field generating unit as shown in FIG. 1. Consequently, the electron beam travels through the cavity resonator 6 along a predetermined path, an electromagnetic wave can be generated in the design natural mode, and the oscillation efficiency is not reduced. Furthermore, since the electron beam falls at a predetermined position on the collector 7 and the collector 7 is not locally overheated, the gyrotron has a high reliability.

Figure 26:
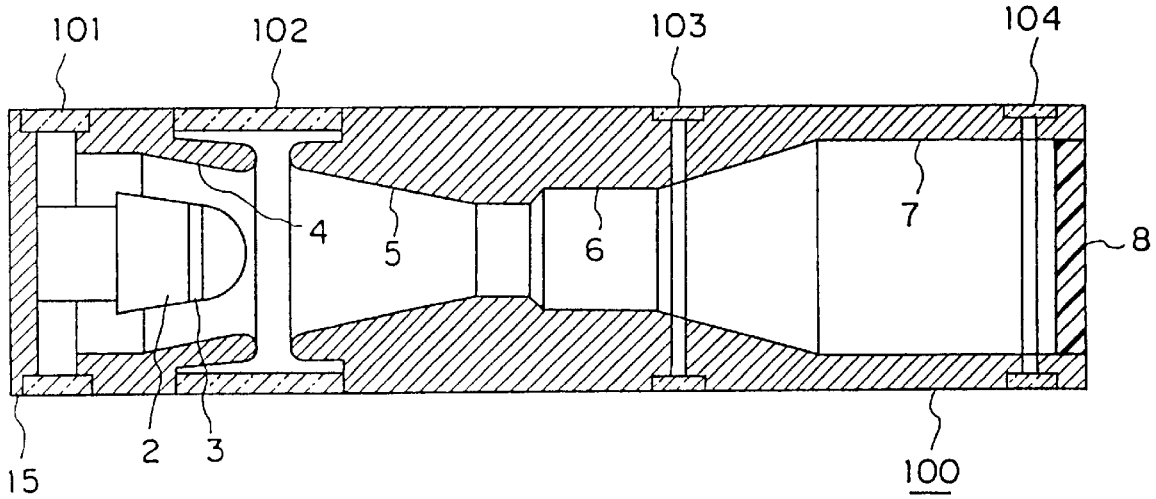
FIG. 26 is a schematic fragmentary longitudinal sectional view of a gyrotron system in a still further embodiment according to the present invention.

FIG. 26 shows a gyrotron 100 included in a gyrotron system in a still further embodiment according to the present invention, in which parts like or corresponding to those of the prior art gyrotron system are designated by the same reference characters and the description thereof will be omitted.

In this embodiment, at least the inner surfaces, axial ends and portions to be in contact with metal parts of insulating members 101, 102, 103 and 104 are finished in accurate dimensions, and the gyrotron 100 is assembled by fitting metal parts in the insulating members 101, 102, 103 and 104. The effects of the gyrotron 100 shown in FIG. 26 are the same as those of the gyrotron in the twenty-fourth embodiment shown in FIG. 25. The gyrotron 100 facilitates work for aligning the component parts when assembling the same.

Figure 27:
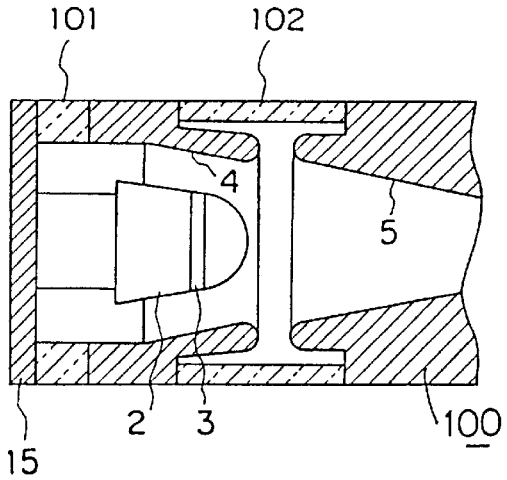
FIG. 27 is a schematic fragmentary longitudinal sectional view of a gyrotron system in a still further embodiment according to the present invention.

FIG. 27 shows a portion of a gyrotron 100 included in a gyrotron system in a still further embodiment according to the present invention, in which parts like or corresponding to those of the prior art gyrotron system are designated by the same reference characters and the description thereof will be omitted. There are shown, a cathode flange 15, a first anode 4, an insulating member 101 interposed between the cathode flange 15 and the first anode 4, a second anode 5, and an insulating member 102 interposed between the first anode 4 and the second anode 5. The insulating members and the metal parts, similarly to those of the twenty-fourth embodiment, are joined together with a nonmagnetic material to prevent adverse effects on the function of an electron gun, which is an essential component of the gyrotron 100, disturbing the absolute value and the magnetic flux density distribution of a magnetic field generated between the electron gun 1 and a cavity resonator 6 (not shown) and adverse effects on the path and the characteristics of the electron beam.

Consequently, the electron beam travels through the cavity resonator 6 along a predetermined path, an electromagnetic wave can be generated in a design natural mode and local overheating of the components does not occur. Thus, the gyrotron 100 has a high reliability. The present invention is applicable also to a gyrotron 100 having an output window which need not be electrically insulated.

Figure 28:
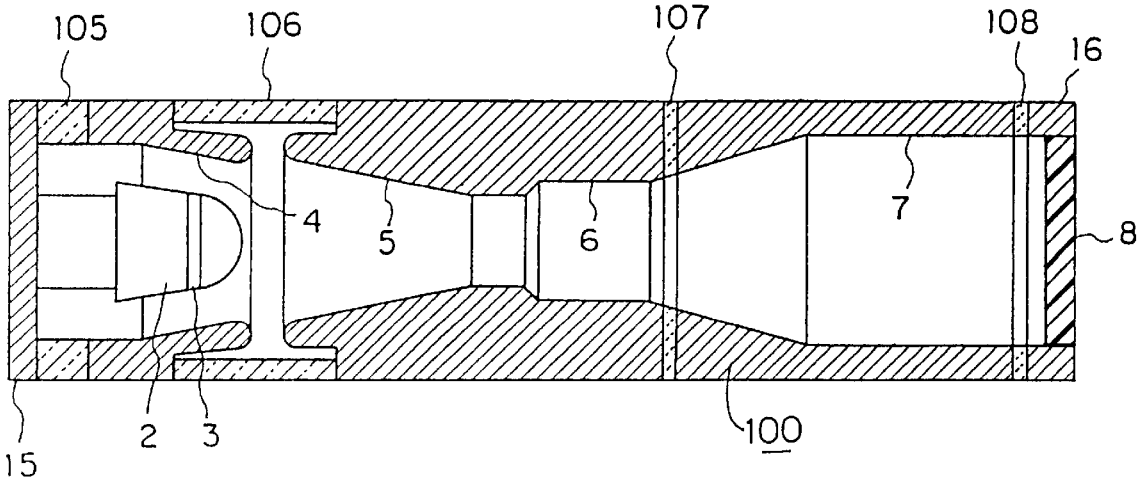
FIG. 28 is a schematic fragmentary longitudinal sectional view of a gyrotron system in a still further embodiment according to the present invention.

FIG. 28 shows a gyrotron included in a gyrotron system in a still further embodiment according to the present invention, in which parts like or corresponding to those of the prior art gyrotron system are designated by the same reference characters and the description thereof will be omitted. There are shown a cathode flange 15, a first anode 4, an insulating member 105 interposed between the cathode flange 15 and the first anode 4, a second anode 5, an insulating member 106 interposed between the first anode 4 and the second anode 5, a cavity resonator 6, a collector 7, an insulating member 107 interposed between the cavity resonator 6 and the collector 7, an output waveguide 16, and an insulating member 108 interposed between the collector 7 and the output waveguide 16. The insulating members are formed of glass. The glass insulating members are joined directly to the metal parts, i.e., the cathode flange 15, the first anode 4, the second anode 5, the cavity resonator 6, the collector 7 and the output waveguide 16, or joined to the metal parts with layers of a metal capable of being directly joined to the glass insulating members and interposed between the glass insulating members and the corresponding metal parts, respectively. The metal capable of being directly joined to the glass insulating members is a nonmagnetic material, such as copper or a stainless steel, and the part of the non-magnetic metal is joined to the glass insulating member by a housekeeper sealing process.

This construction of the gyrotron 100 does not change the absolute value of the magnetic flux density of a magnetic field generated by the magnetic field generating unit, does not disturb the magnetic flux density distribution of the magnetic field and does not affect the path and the characteristics of the electron beam adversely. Consequently, the electron beam travels through the cavity resonator along a predetermined path, an electromagnetic wave can be generated in a design natural mode, and oscillation efficiency is not reduced. Furthermore, since the electron beam is guided to a predetermined position on the collector 7 and the collector 7 is not locally overheated, the gyrotron 100 has a high reliability.

Figure 29:
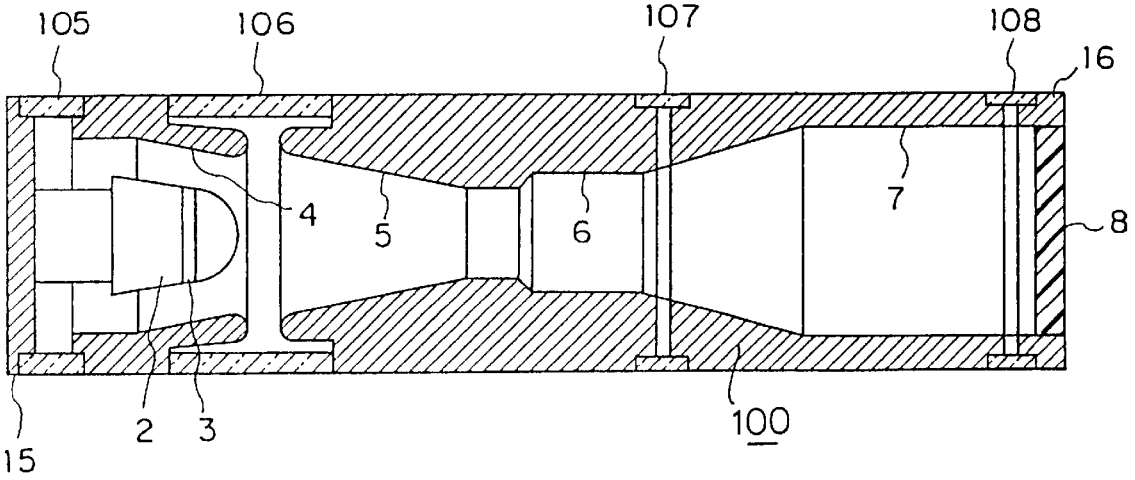
FIG. 29 is a schematic fragmentary longitudinal sectional view of a gyrotron system in a still further embodiment according to the present invention.

FIG. 29 shows a gyrotron 100 included in a gyrotron system in a still further embodiment according to the present invention, in which parts like or corresponding to those of the prior art gyrotron system are designated by the same reference characters and the description thereof will be omitted. The gyrotron 100 has insulating members 105, 106, 107 and 108. At least the inner surfaces, axial ends and portions to be in contact with metal parts of the insulating members 105, 106, 107 and 108 are finished in accurate dimensions, and the gyrotron 100 is assembled by fitting component parts in the insulating members 105, 106, 107 and 108. The effects of the gyrotron 100 in the twenty-seventh embodiment shown in FIG. 28 are the same as those of the gyrotron 100 of the twenty-eighth embodiment shown in FIG. 29, and the gyrotron 100 in this embodiment facilitates work for aligning the component parts when assembling the same.

Figure 30:
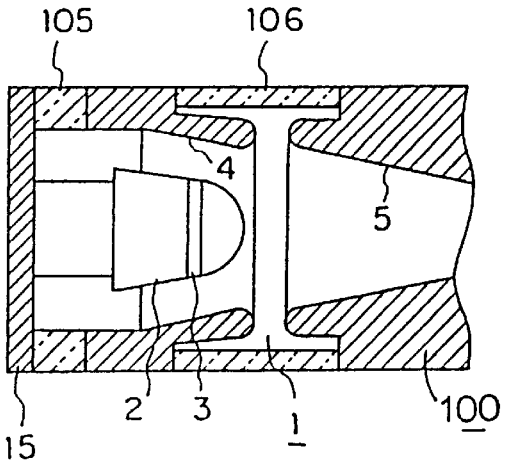
FIG. 30 is a schematic fragmentary longitudinal sectional view of a gyrotron system in a still further embodiment according to the present invention.

FIG. 30 shows a portion of a gyrotron 100 included in a gyrotron system in a still further embodiment according to the present invention, in which parts like or corresponding to those of the prior art gyrotron system are designated by the same reference characters and the description thereof will be omitted. While all the insulating members of the gyrotrons 100 shown in FIGS. 28 and 29 are formed of glass, in this embodiment, only the insulating members 105 and 106 disposed near an electron gun 1 and not required to have a very high strength are formed of glass, and the insulating members disposed near a collector and an output window and required to have a high strength sufficient to endure forces that act on the gyrotron 100 when transporting or hoisting the gyrotron 100 or when joining the gyrotron 100 to a high-frequency wave transmitting system are formed of a combination of alumina and Kovar.

When the insulating members are formed of such materials,the absolute values of the magnetic flux densities and the magnetic flux density distributions of magnetic fields generated around the electron gun 1, the functions of which are particularly important for operating the gyrotron 100, and in the space between the electron gun 1 and a cavity resonator 6 (not shown) are not disturbed, and the insulating members will not affect the path and the characteristics of an electron beam adversely. Consequently, the electron beam travels along a predetermined path, an electromagnetic wave can be generated in a design natural mode and the oscillation efficiency will not be reduced.

Figure 31:
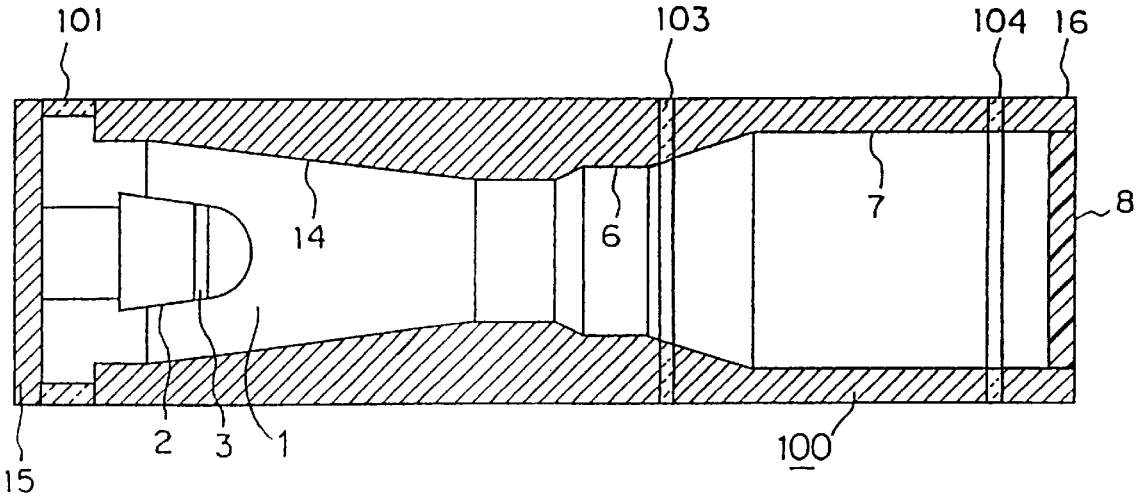
FIG. 31 is a schematic fragmentary longitudinal sectional view of a gyrotron system in a still further embodiment according to the present invention.
Figure 32:
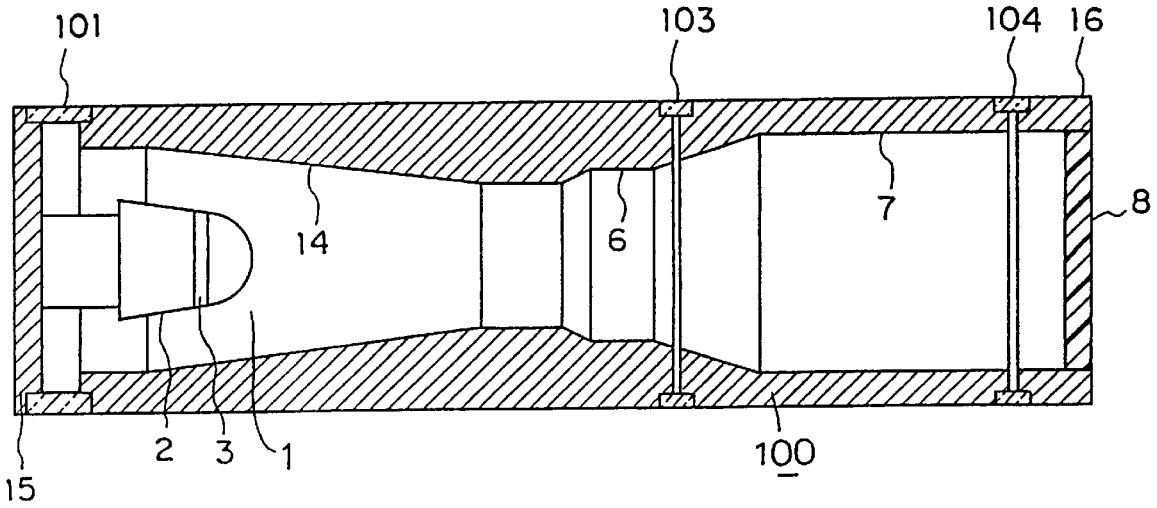
FIG. 32 is a schematic fragmentary longitudinal sectional view of a gyrotron system in a still further embodiment according to the present invention.
Figure 33:
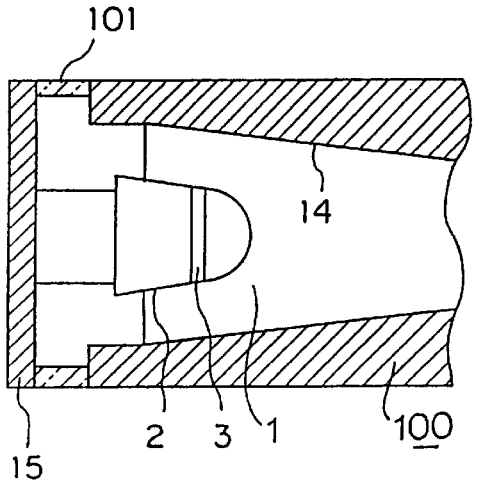
FIG. 33 is a schematic fragmentary longitudinal sectional view of a gyrotron system in a still further embodiment according to the present invention.

FIGS. 31 to 33 show gyrotron systems in still further embodiments according to the present invention, in which parts like or corresponding to those of the prior art gyrotron system are designated by the same reference characters and the description thereof will be omitted.

The electron gun employed in each of the twenty-fourth to the twenty-ninth embodiment shown in FIGS. 25 through 30 is a triode type electron gun having a cathode, a first anode and a second anode. A gyrotron 100 employed in each of these embodiments is provided with a diode type electron gun 1 having two electrodes, namely, a cathode 2 and an anode 14. Referring to FIG. 31, there are shown a cathode flange 15, the anode 14, an insulating member 101 interposed between the cathode flange 15 and the anode 14, a cavity resonator 6, a collector 7, an insulating member 103 interposed between the cavity resonator 6 and the collector 7, an output waveguide 16, an insulating member 104 interposed between the collector 7 and the output waveguide 16. The insulating members and metal parts are joined together with nickel-plated layers of a nonmagnetic material, such as molybdenum or tungsten, respectively. Although nickel is a magnetic substance, the influence of nickel plating on the magnetic field is insignificant. The cathode flange 15, the anode 14, the side walls of the cavity resonator 6, the collector 7 and the output waveguide are formed of metals, respectively.

In a gyrotron 100, generally, all or some of the joints between the adjacent parts are electrically insulated by insulating members each formed of alumina to apply a voltage across the cathode 2 and the anode 14 to make the electron gun 1 emit electrons and to measure the quantities of electrons coming into the cavity resonator 6, the collector 7 and an output window 8. Kovar is brazed to the opposite ends of alumina insulating member to enable the alumina insulating member to be connected to metal parts.

Alumina is readily available and has a high strength, and Kovar has a thermal expansion coefficient approximately equal to that of alumina and is used widely for being brazed with alumina parts. However, since Kovar is a magnetic substance, there is the possibility that a magnetic field is disturbed when such a part is placed in the magnetic field and the disturbance of the magnetic field affects the path and the characteristics of the electron beam adversely. If the magnetic field is disturbed, the electron beam will not travel along a predetermined path, oscillation in a natural mode other than a design mode may occur or oscillation efficiency may be reduced. Furthermore, the electron beam will be locally concentrated on the collector 7 to overheat the collector 7 or the electron beam will fall on the output window 8 to damage the output window.

The magnetic field generating unit of the conventional gyrotron system provided with only electromagnets deals with the aforesaid troubles by adjusting the currents flowing through the coils of the electromagnets. Since the range of adjustment of the absolute value of the magnetic flux density of a magnetic field and the range of adjustment of magnetic flux density distribution of the magnetic field generating unit in accordance with the present invention provided with both a permanent magnet and electromagnets in combination are not as wide as those of the conventional magnetic field generating unit, there is the possibility that the magnetic field generating unit in accordance with the present invention is unable to correct completely a disturbed magnetic field disturbed by the magnetic member placed in the magnetic field.

In this embodiment, the absolute value of the magnetic flux density of a magnetic field generated by the magnetic field generating unit is not changed, the magnetic flux density distribution is not disturbed and hence any adverse effect does not act on the characteristics and the path of the electron beam even though the gyrotron 100 is disposed within the magnetic field generating unit as shown in FIG. 1. Consequently, the electron beam travels through the cavity resonator 6 along a predetermined path, an electromagnetic wave can be generated in the design natural mode, and the oscillation efficiency is not reduced. Furthermore, since the electron beam falls at a predetermined position on the collector 7 and the collector 7 is not locally overheated, the gyrotron has a high reliability.

The insulating members 101, 103 and 104, similarly to the insulating members of the twenty-seventh embodiment shown in FIG. 28, are formed of glass. The glass insulating members 101, 103 and 104 may be joined directly to the corresponding metal parts, namely, the cathode flange 15, the anode 14, the side walls of the cavity resonator 6, the collector 7 and the output waveguide 16, or joined to the metal parts with layers of a metal capable of being directly joined to the glass insulating members and interposed between the glass insulating members and the corresponding metal parts, respectively. The metal capable of being directly joined to the glass insulating members is a nonmagnetic material, such as copper or a stainless steel, and the layer of the metal is joined to the glass insulating member by a housekeeper sealing process.

This construction of the gyrotron 100 does not change the absolute value of the magnetic flux density of a magnetic field generated by the magnetic field generating unit, does not disturb the magnetic flux density distribution of the magnetic field and does not affect the path and the characteristics of the electron beam adversely. Consequently, the electron beam travels through the cavity resonator 6 along a predetermined path, an electromagnetic wave can be generated in a design natural mode, and oscillation efficiency is not reduced. Furthermore, since the electron beam is guided to a predetermined position on the collector 7 and the collector 7 is not locally overheated, the gyrotron 100 has a high reliability.

In a gyrotron 100 included in the embodiment shown in FIG. 32, insulating members 101, 103 and 104 are finished similarly to the insulating members of the twenty-eighth embodiment shown in FIG. 29. At least the inner surfaces, axial ends and portions to be in contact with metal parts of the insulating members 101, 103 and 104 are finished in accurate dimensions, and the gyrotron 100 is assembled by fitting component parts in the insulating members 101, 103 and 104. The effects of the gyrotron 100 in this embodiment are the same as those of the embodiment shown in FIG. 31, and the gyrotron 100 in this embodiment facilitates work for aligning the component parts when assembling the same.

In a gyrotron 100 included in the embodiment shown in FIG. 33, similarly to the gyrotron 100 of the twenty-ninth embodiment shown in FIG. 30, only an insulating member 101 disposed near an electron gun 1 and not required to have a very high strength is formed of glass, and insulating members disposed near a collector and an output window and required to have a high strength sufficient to endure forces that act on the gyrotron 100 when transporting or hoisting the gyrotron 100 or when joining the gyrotron 100 to a high-frequency wave transmitting system are formed of a combination of alumina and Kovar.

When the insulating members are formed of such materials, the absolute value of the magnetic flux densities and the magnetic flux density distributions of magnetic fields generated around the electron gun 1, the function of which is particularly important for the oscillating operation of the gyrotron 100, and in the space between the electron gun 1 and a cavity resonator 6 are not disturbed and the insulating members will not affect the path and the characteristics of the electron beam adversely. Consequently, the electron beam travels along a predetermined path, and electromagnetic wave can be generated in a design natural mode and the oscillation efficiency will not be reduced.

Figure 34:
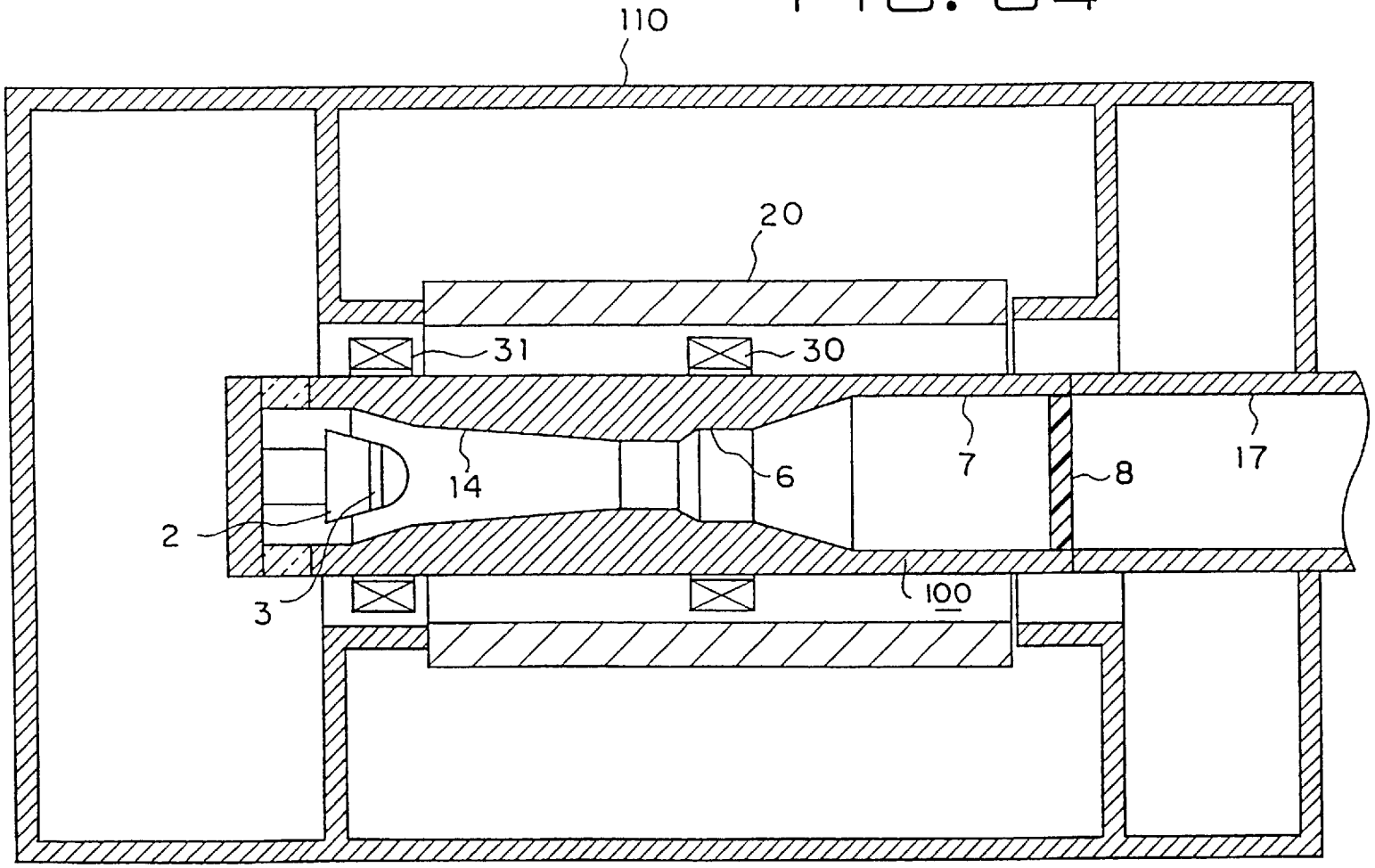
FIG. 34 is a schematic longitudinal sectional view of a gyrotron system in a still further embodiment according to the present invention.

FIG. 34 shows a gyrotron system in a still further embodiment according to the present invention, in which parts like or corresponding to those of the prior art gyrotron system are designated by the same reference characters and the description thereof will be omitted. There are shown a gyrotron 100, a waveguide 17 for guiding high-frequency waves, a frame 110 formed of a nonmagnetic material, a permanent magnet 20, a main magnetic filed fine adjustment electromagnet 30 and an electron gun magnetic field fine adjustment electromagnet 31. The frame 110 is formed so as to define a region in which the magnetic flux density of a magnetic field produced by the permanent magnet 20, the main magnetic field fine adjustment electromagnet 30 and the electron gun magnetic field fine adjustment electromagnet 31 is 5 G or above. The magnetic field generating unit of the gyrotron 100 provided with the permanent magnet 20 produces a magnetic field continuously even while the gyrotron 100 is not in operation, which may cause various difficulties. For example, the magnetic field may be hazardous to human. Such a continuous magnetic field has a serious influence on a person carrying a pacemaker. If a magnetic field is generated in the gyrotron 100, tools may be attracted to the permanent magnet 20 and may possibly collide against the parts around the permanent magnet 20.

According to advice in the United States Food and Drug Administration, a region in which the magnetic flux density of a leakage magnetic flux is 5 G is a criterion for magnetic shielding. This embodiment is provided with the frame 110 and hence the magnetic field outside the frame 110 is very weak. Therefore the permanent magnet 20 will not affect a person carrying a pacemaker, magnetic materials will not be attracted to the permanent magnet 20 and the gyrotron 100 is safe. Even if the permanent magnet 20 is enclosed by a magnetic shield, the permanent magnet 20 may be contained in the frame to prevent hazards attributable to leakage flux.

Figure 35:
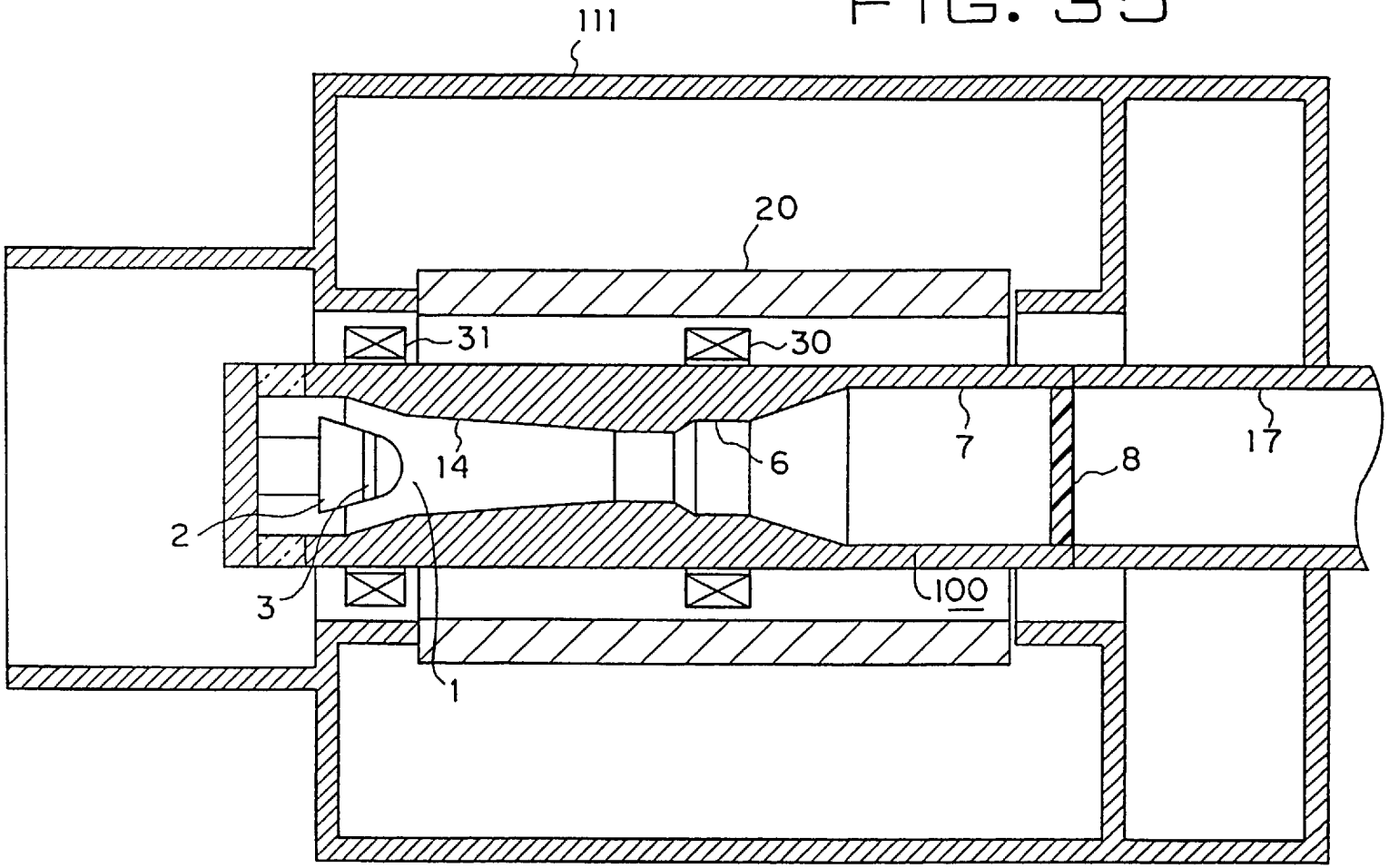
FIG. 35 is a schematic longitudinal sectional view of a gyrotron system in a still further embodiment according to the present invention.
Figure 36:
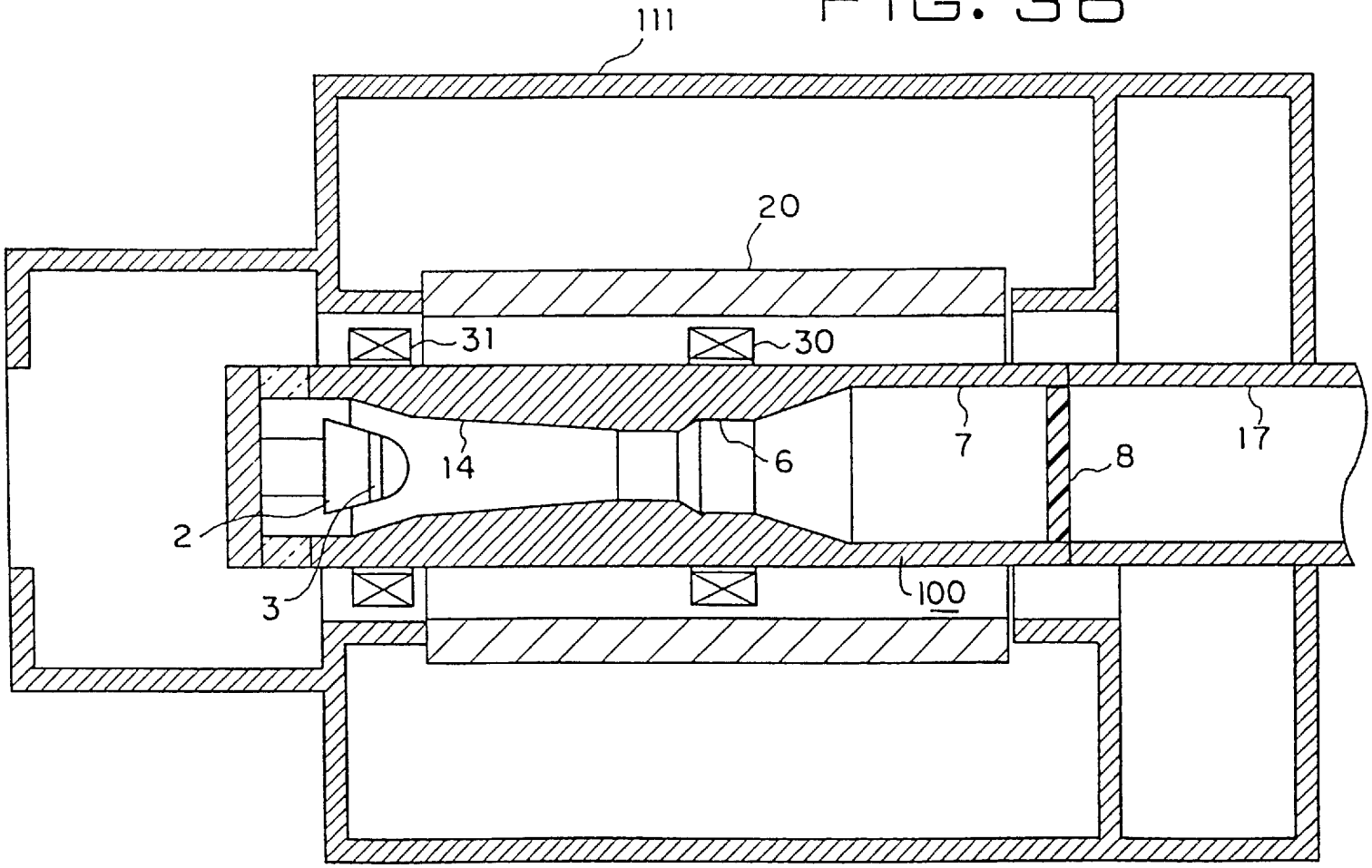
FIG. 36 is a schematic longitudinal sectional view of a gyrotron system in a still further embodiment according to the present invention.

FIGS. 35 and 36 show gyrotron systems in still further embodiments according to the present invention. Gyrotrons 100 included in the gyrotron systems shown in FIGS. 35 and 36 are similar to the gyrotron 100 of the thirty-first embodiment shown in FIG. 34, in which parts like or corresponding to those of the prior art gyrotron system are designated by the same reference characters and the description thereof will be omitted. The frame 110 of the thirty-first embodiment shown in FIG. 34 covers the sides of the magnetic field generating unit and the axial end behind the electron gun 1 as well. Since the electron gun 1 needs to be connected electrically to an external power circuit, each of frames 111 shown in FIGS. 35 and 36 is provided with an opening in its axial end wall behind the electron gun 1.

Figure 37:
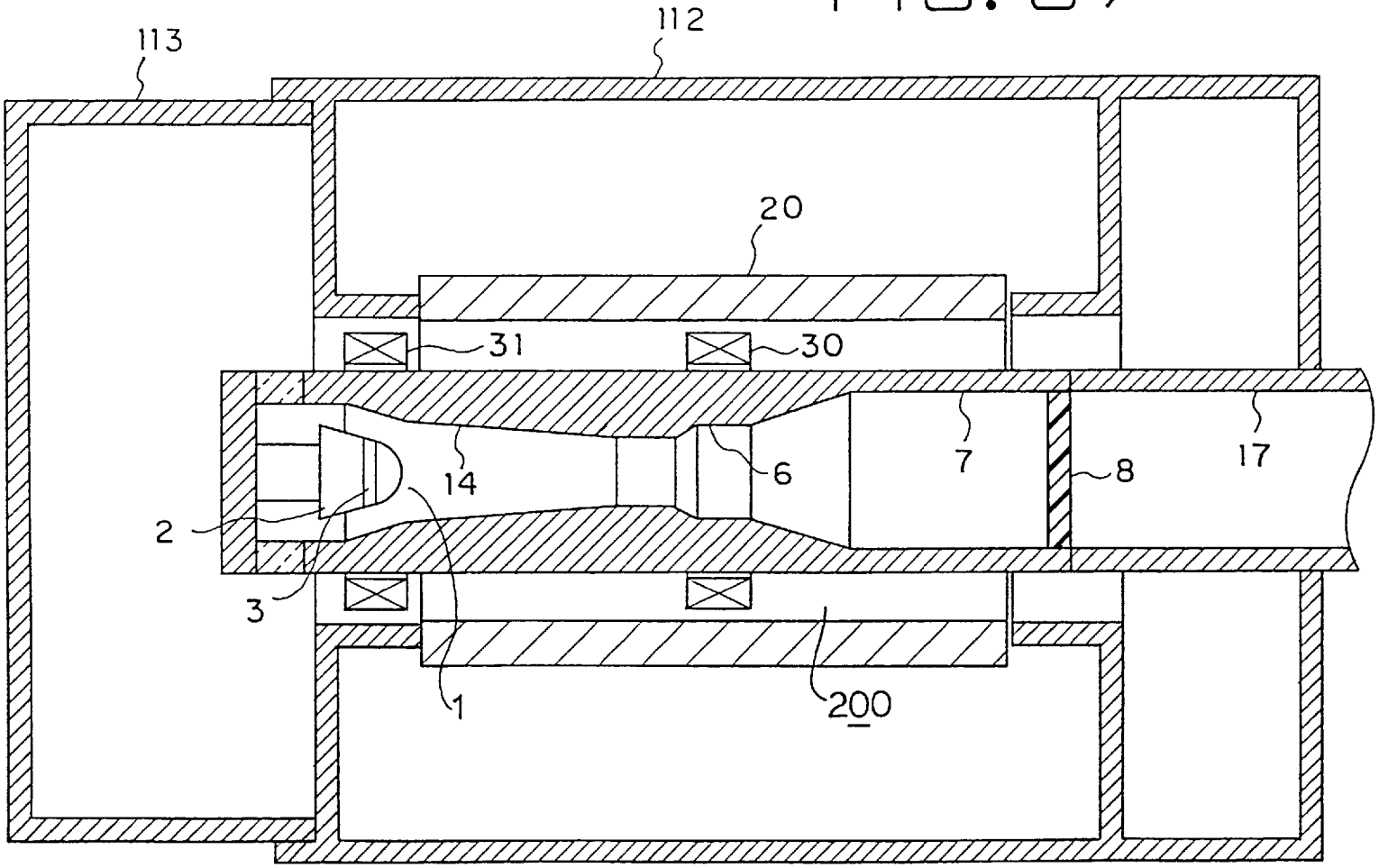
FIG. 37 is a schematic longitudinal sectional view of a gyrotron system in a still further embodiment according to the present invention.
Figure 38:
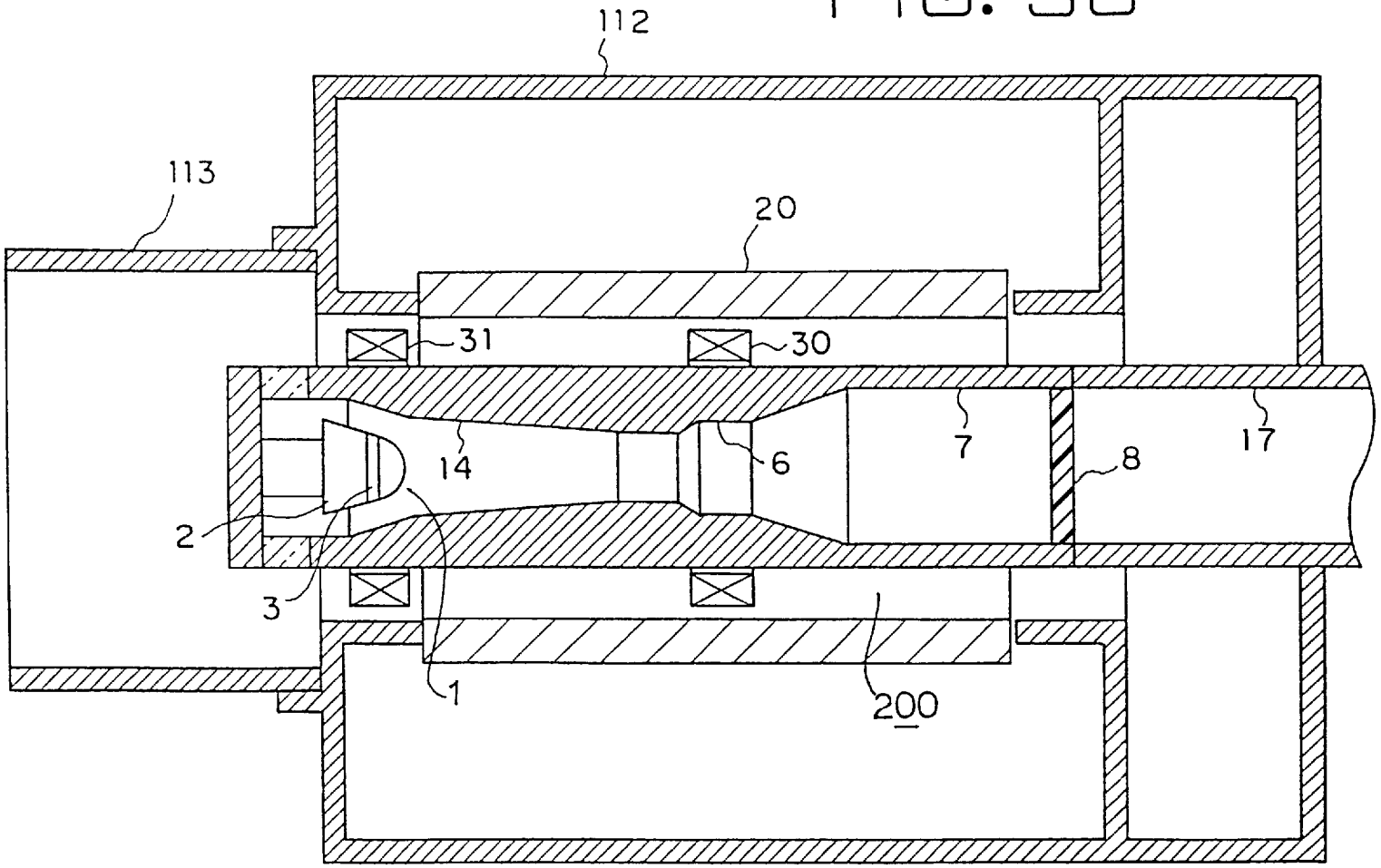
FIG. 38 is a schematic longitudinal sectional view of a gyrotron system in a still further embodiment according to the present invention.
Figure 39:
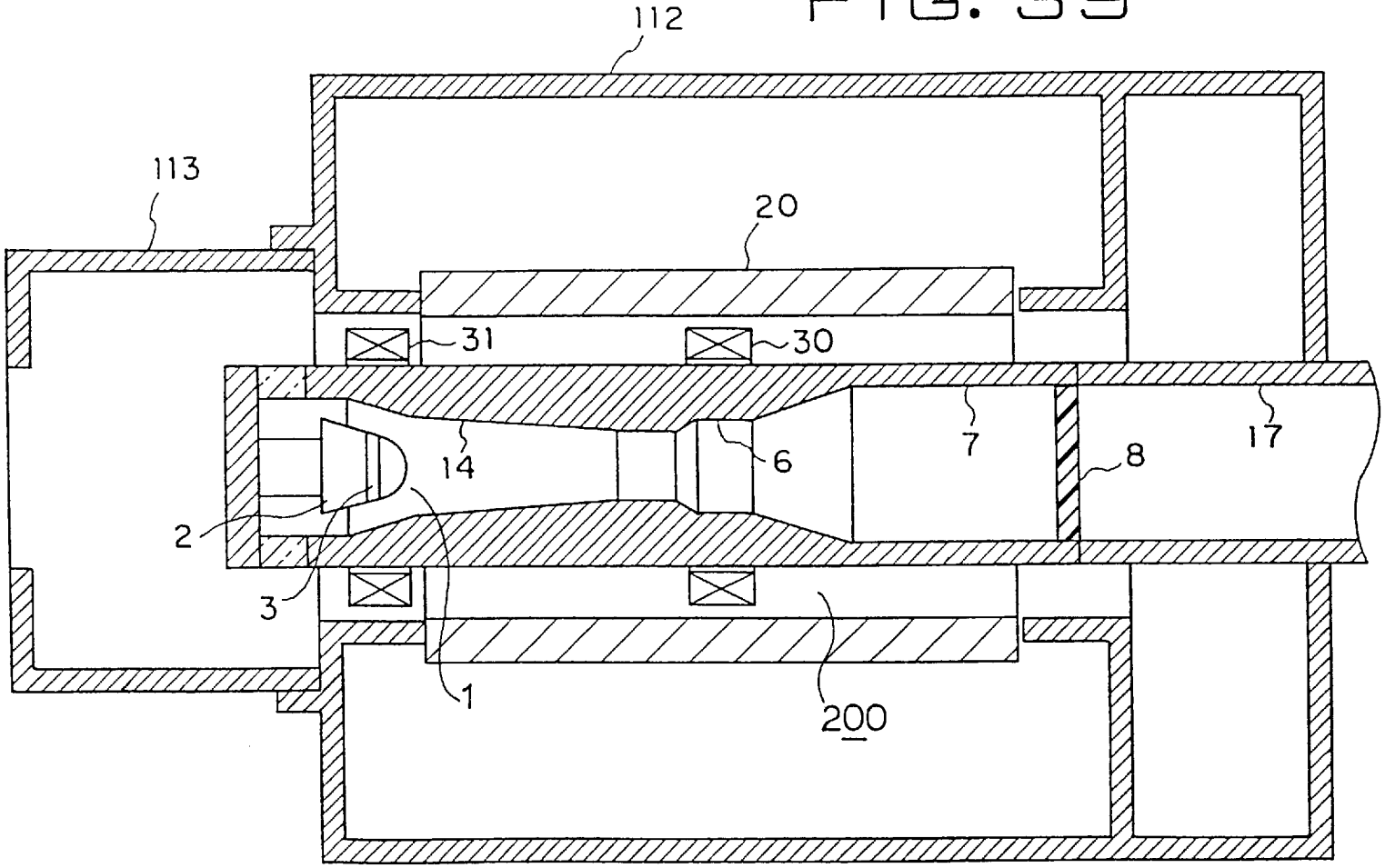
FIG. 39 is a schematic longitudinal sectional view of a gyrotron system in a still further embodiment according to the present invention.

FIGS. 37 to 39 show gyrotron systems in still further embodiments according to the present invention, in which parts like or corresponding to those of the prior art gyrotron system are designated by the same reference characters and the description thereof will be omitted, each provided with a first frame 112 covering the main portion of the gyrotron system, and a second frame 113 detachably combined with the first frame 112 so as to cover an electron gun 1 included in the gyrotron system 200. The detachably combined frames 112 and 113 facilitate work for connecting the electron gun 1 to an external power circuit and work for transporting the gyrotron system 200, with the same effect as in the thirty-first embodiment.

Figure 40:
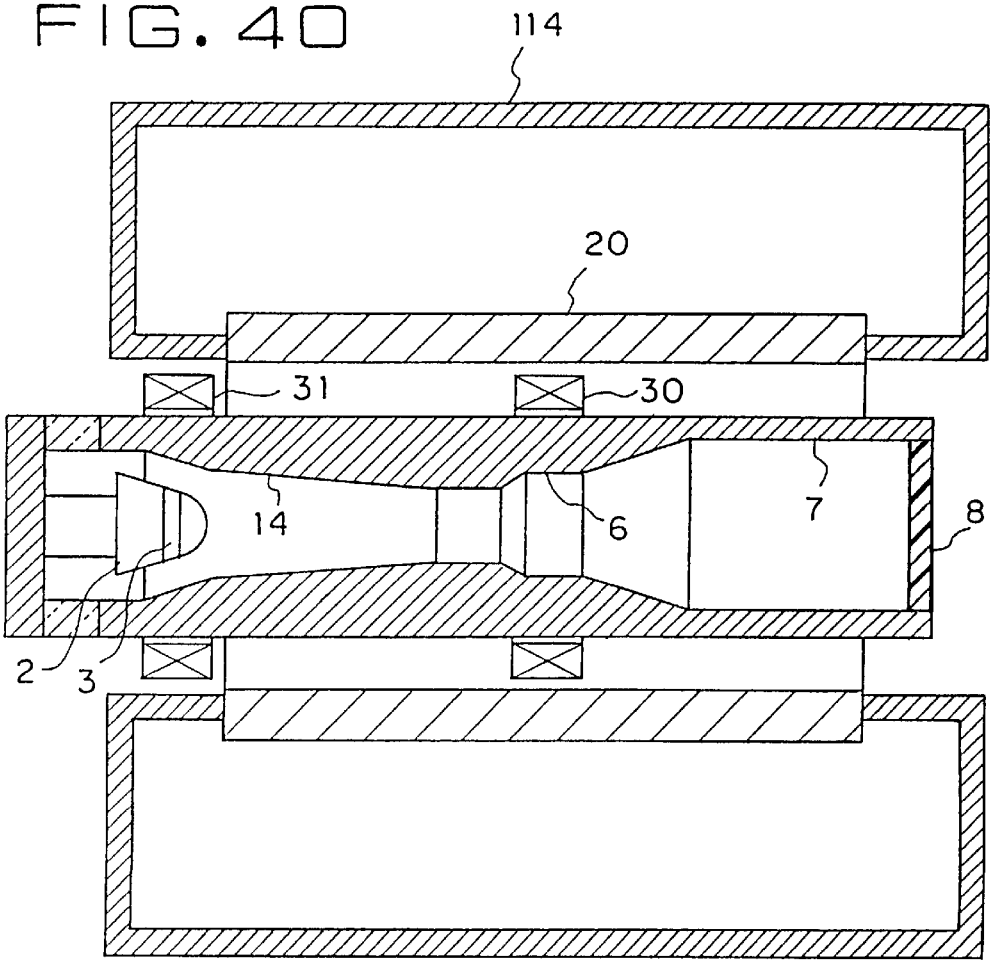
FIG. 40 is a schematic longitudinal sectional view of a gyrotron system in a still further embodiment according to the present invention.

FIG. 40 shows a gyrotron system in a still further embodiment according to the present invention, in which parts like or corresponding to those of the prior art gyrotron system are designated by the same reference characters and the description thereof will be omitted. In this embodiment, a frame 114 surrounds a region in which the magnetic flux density of an intensive magnetic field produced by a permanent magnet 20 included in a hybrid magnetic field generating unit is 5 G or above. The frame 114 is smaller than the frames shown in FIGS. 34 to 39 and is easy to handle. The frame 114 encloses the region in which the magnetic flux density is 5 G or above to secure safety.

Figure 41:
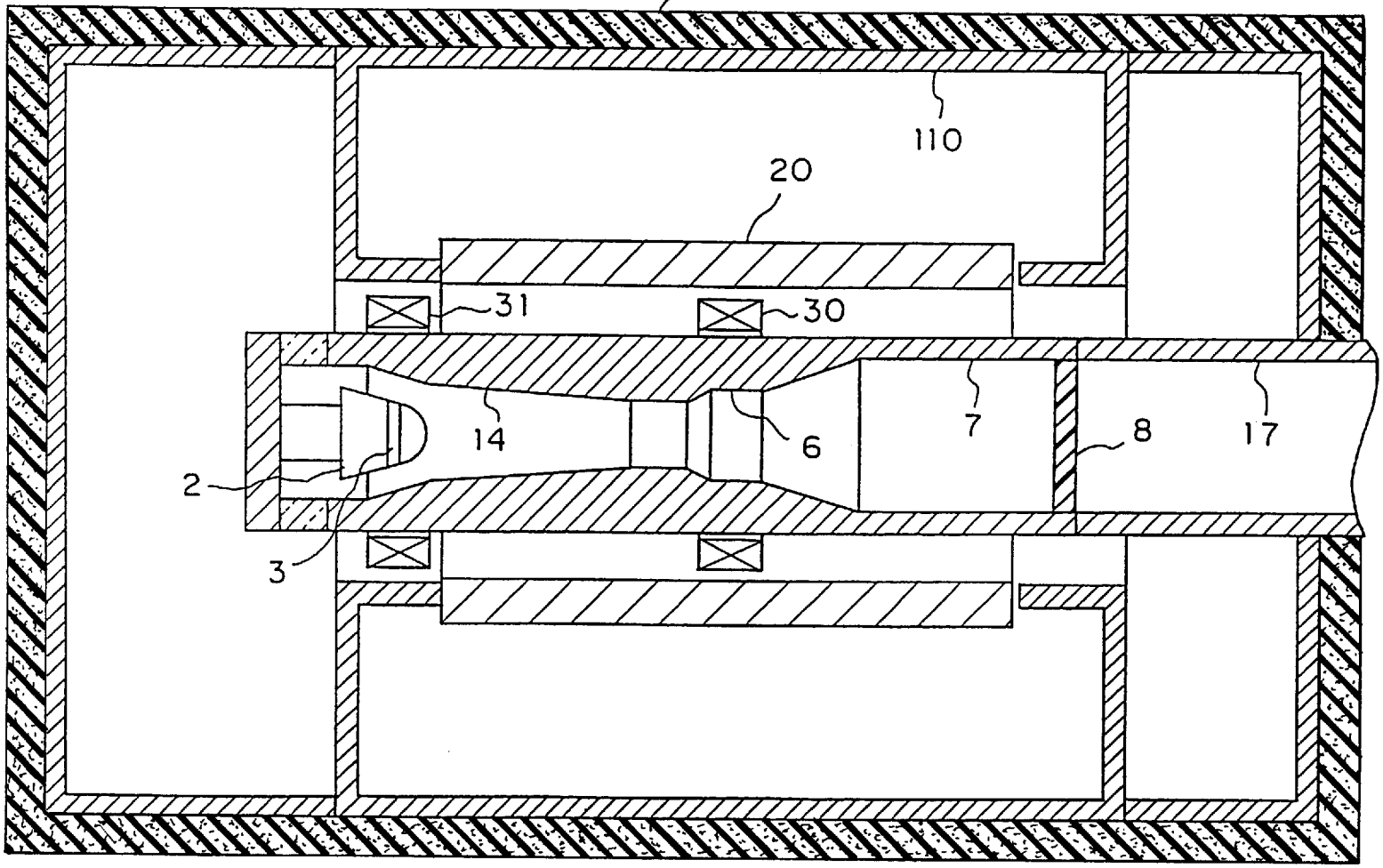
FIG. 41 is a schematic longitudinal sectional view of a gyrotron system in a still further embodiment according to the present invention.

FIG. 41 shows a gyrotron system in a still further embodiment according to the present invention, in which parts like or corresponding to those of the prior art gyrotron system are designated by the same reference characters and the description thereof will be omitted. A frame 110 is covered with a cushioning member 115 of urethane foam, sponge, styrene foam, felt, glass wool, paper or wood. The cushioning member 115 may be a pneumatic cap. The cushioning member 115 may be put on any frame capable of surrounding a region in which the magnetic flux density is 5 G or above. Even if tools or the like are attracted by the magnetic field to the gyrotron system, the cushioning member protects the gyrotron system from damage.

Figure 42:
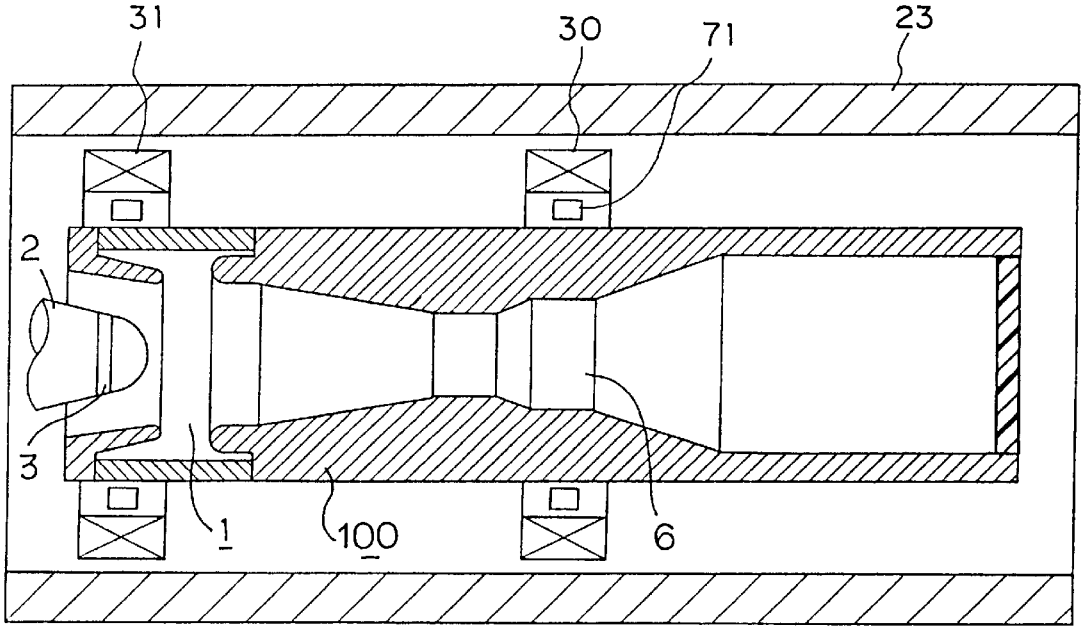
FIG. 42 is a schematic longitudinal sectional view of a gyrotron system in a still further embodiment according to the present invention.

FIG. 42 shows a gyrotron system in a still further embodiment according to the present invention, in which parts like or corresponding to those of the prior art gyrotron system are designated by the same reference characters and the description thereof will be omitted. The gyrotron system is provided with magnetic flux density detectors 71, such as Hall devices, for detecting the magnetic flux density of a magnetic field generated by a permanent magnet 23 to determine the temperature variation of the magnetic flux density. The temperature variations of the magnetic flux density of the magnetic field produced by the permanent magnet 23 in regions around a cavity resonator 6 and an electron gun 1 are compensated by a main magnetic field fine adjustment electromagnet 30 and an electron gun magnetic field fine adjustment electromagnet 31, respectively.

Generally, the magnetic flux density of a magnetic field produced by a permanent magnet changes with the temperature of the permanent magnet. The residual magnetic flux density temperature coefficient, which determines the temperature variation of magnetic flux density, of a neodymium magnet is on the order of −0.1%/° C., and that of a samarium magnet is −0.03%/° C. As mentioned previously, the magnetic flux density of the central portion of the cavity resonator 6 must be about 5.2 kG to generate an oscillation of 28 GHz at the second harmonic oscillation mode. The magnetic flux density decreases at about 5.2 G/° C. when the temperature of the neodymium permanent magnet increases and increases at about 5.2 G/° C. when the temperature of the permanent magnet decreases. Therefore, the range of variation of the magnetic flux density is on the order of ±104 G when the temperature of the permanent magnet varies in a temperature range of about ±20° C. The variation of the magnetic flux density in the range of such an order can be compensated by one or a plurality of magnetic field fine adjustment electromagnets and a small-capacity exciting power supply.

The magnetic field fine adjustment electromagnets 30 and 31 may be similar to those employed by the embodiments shown in FIGS. 1 to 22. This embodiment may be provided with a magnetic field correcting electromagnet similar to the magnetic field correcting electromagnet 60 employed in the twenty-third embodiment shown in FIG. 23. While the magnetic flux density detectors 71, i.e., Hall devices, for detecting the magnetic flux density and determining the temperature variation of the magnetic flux density are disposed between the main magnetic field fine adjustment electromagnet 30 and a gyrotron 100 and between the electron gun magnetic field fine adjustment electromagnet 31 and the gyrotron 100, respectively in FIG. 42, the magnetic flux density detectors 71 may be disposed at any suitable positions within the magnetic field other than the positions shown in FIG. 42.

The gyrotron is able to operate efficiently and the high-frequency output can be controlled even if the magnetic flux density of the magnetic field produced by the permanent magnet changes due to the variation of the temperature of the permanent magnet caused by the variation of the environmental conditions.

Figure 43A:
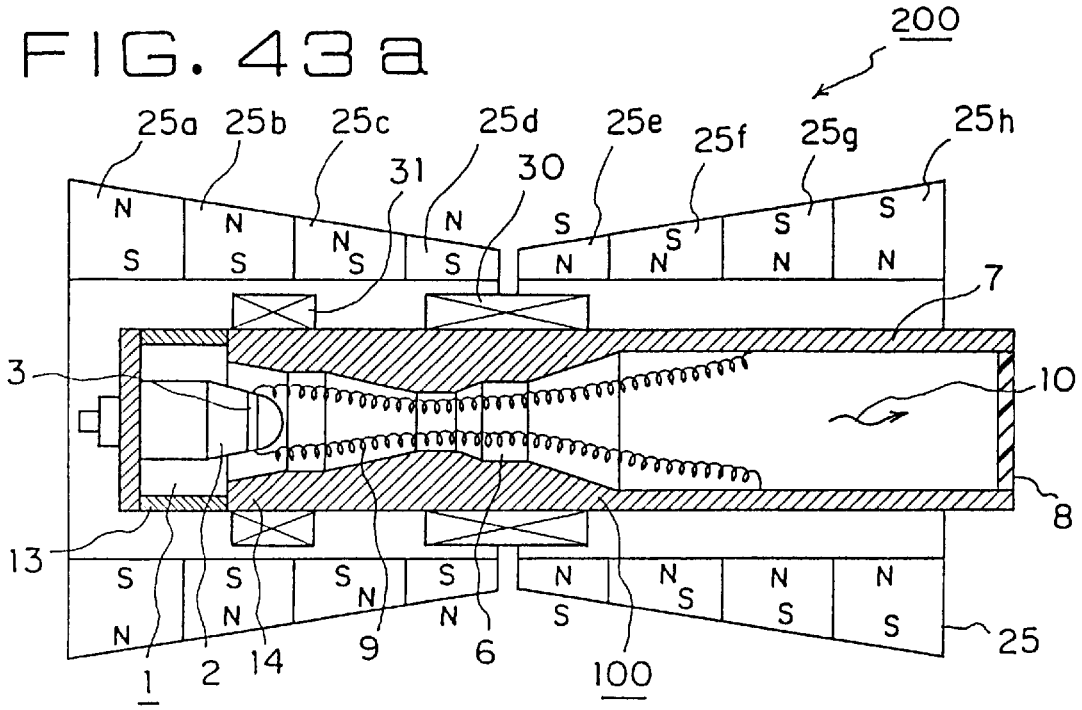
FIG. 43*a* is a schematic longitudinal sectional view of a gyrotron system in a still further embodiment according to the present invention.
Figure 43B:
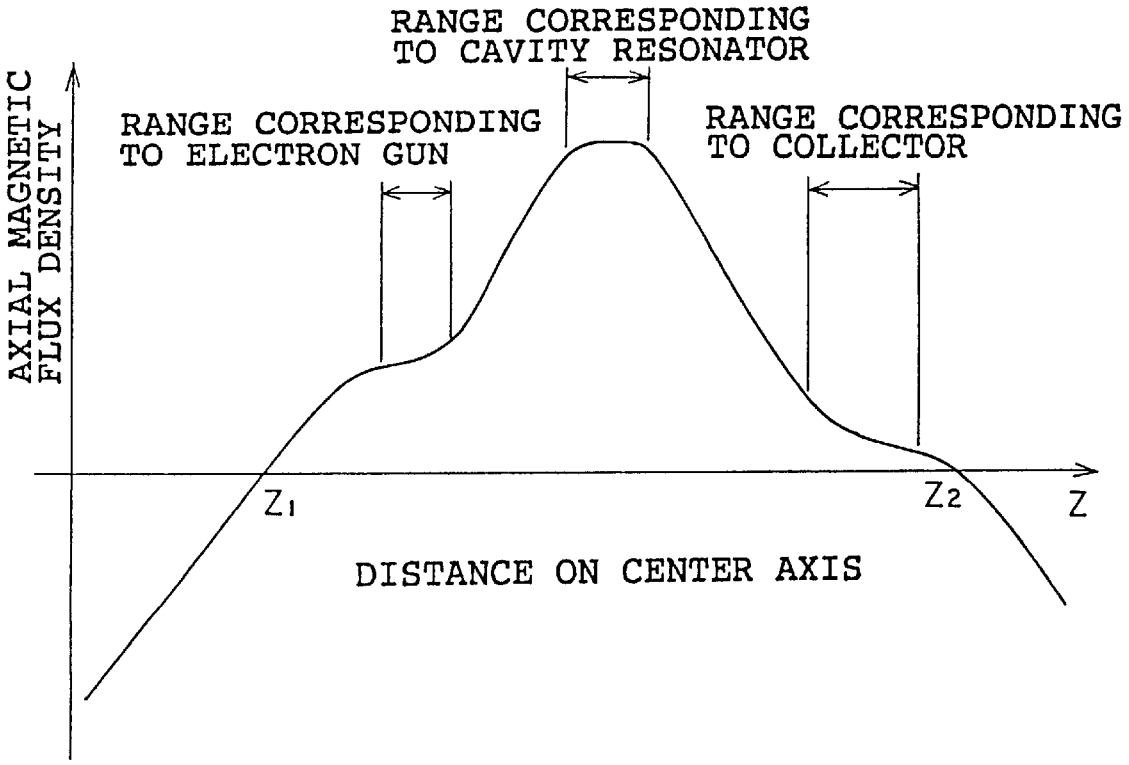
FIG. 43*b* is a graph showing an axial magnetic flux density distribution in the gyrotron system of FIG. 43*a;*

FIG. 43*a* shows a gyrotron system in a still further embodiment according to the present invention, in which parts like or corresponding to those of the prior art gyrotron system are designated by the same reference characters and the description thereof will be omitted, and FIG. 43*b* is a graph showing the axial magnetic flux density distribution on the center axis of the gyrotron system. The gyrotron system is provided with a cylindrical magnetic field generating unit 25. An axial magnetic field can be produced by an axial arrangement of a plurality of ring-shaped permanent magnets 25*a*, 25*b*, 25*c*, 25*d*, 25*e*, 25*f*, 25*g*, 25*h* having a substantially radial direction of magnetization. Each of the ring-shaped permanent magnets 25*a* to 25*h* having a substantially radial direction of magnetization is formed by radially magnetizing a plurality of trapezoidal magnetic segments, and assembling the magnetized magnetic segments in the shape of a polygonal ring. Each of the ring-shaped permanent magnets 25*a* to 25*h* has a substantially polygonal outer surface and a substantially polygonal inner surface. Each of the ring-shaped permanent magnets 25*a* to 25*h* may be formed by magnetizing sectorial magnetic segments and assembling the magnetized sectorial magnetic segments in an annular shape. Each of the permanent magnets 25*a* to 25*h* thus formed has a circular outer surface and a circular inner surface. Each of the ring-shaped permanent magnets 25*a* to 25*h* may be formed by assembling magnetized magnetic segments of any suitable shape, provided that the ring-shaped permanent magnet has a substantially radial direction of magnetization. In the space within the cylindrical magnetic field generating unit 25 in this embodiment, the direction of the axial magnetic field is inverted at some positions, for example, at axial positions $z_1$ and $Z_2$ in FIG. 43*b*.

The velocity of a hollow electron beam 9 emitted from an electron emitting member 3 on the cathode 2 of an electron gun 1 included in a gyrotron 100 is dependent on an electric field on the surface of the electron emitting member 3 and the magnetic field. The electron beam 9 advances along a spiral path toward a cavity resonator 6 as shown in FIG. 43*a* while the velocity of the electron beam 9 normal to the direction of the magnetic field increases. Since the velocities of electrons immediately after the electrons are emitted from the electron emitting member 3 is dependent on the electric field and the magnetic field generated around the electron emitting member 3, the electron gun 1 is able to function effectively even if the electron emitting member 3 is positioned on the left side of the position $z_1$ shown in FIG. 43*b*.

However, since the intensity of the magnetic field decreases with axial distance in this arrangement, the radius of the spiral path increases gradually and the radius of the hollow electron beam 9 increases. Therefore, the electrons impinge on an anode 14, and are deflected so that they do not reach the cavity resonator 6. Consequently, the gyrotron 100 is unable to oscillate normally. This is a problem particular to a case where an axial magnetic field is produced in the gyrotron system 200 by the cylindrical magnetic field generating unit 25 formed by axially arranging the ring-shaped permanent magnets 25*a* to 25*h* each having a substantially radial direction of magnetization.

This problem can be solved by placing the electron emitting member 3 on the right side of the position $z_1$ shown in FIG. 43*b*. When the electron emitting member 3 is placed on the right side of the position $z_1$, the radius of the spiral path decreases and the radius of the hollow electron beam 9 decreases with the distance of travel and the electron beam 9 emitted from the electron emitting member 3 is able to reach the cavity resonator 6 to enable normal oscillation.

Figure 49:
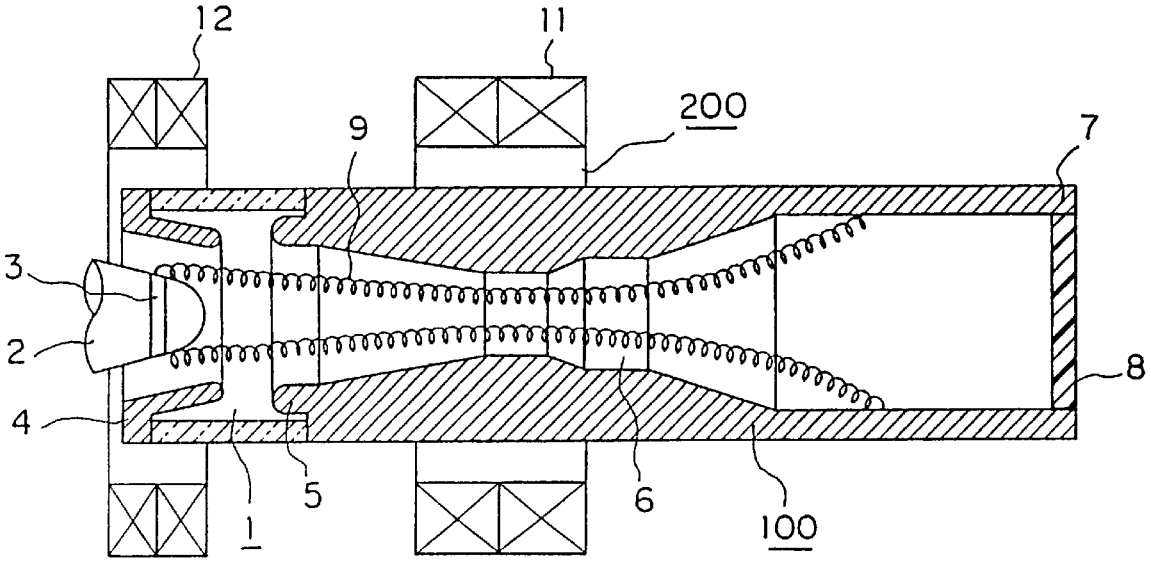
FIG. 49 (PRIOR ART)
FIG. 49 is a schematic longitudinal sectional view of a prior art gyrotron system.

Since the conventional gyrotron system 200 shown in FIG. 49 employs a solenoid to generate an axial magnetic field, there is no position where the direction of the axial magnetic field is inverted in the space in which the gyrotron is installed and in the extension of the space and hence the aforesaid problem does not arise in the conventional gyrotron system 200.

Figure 44:
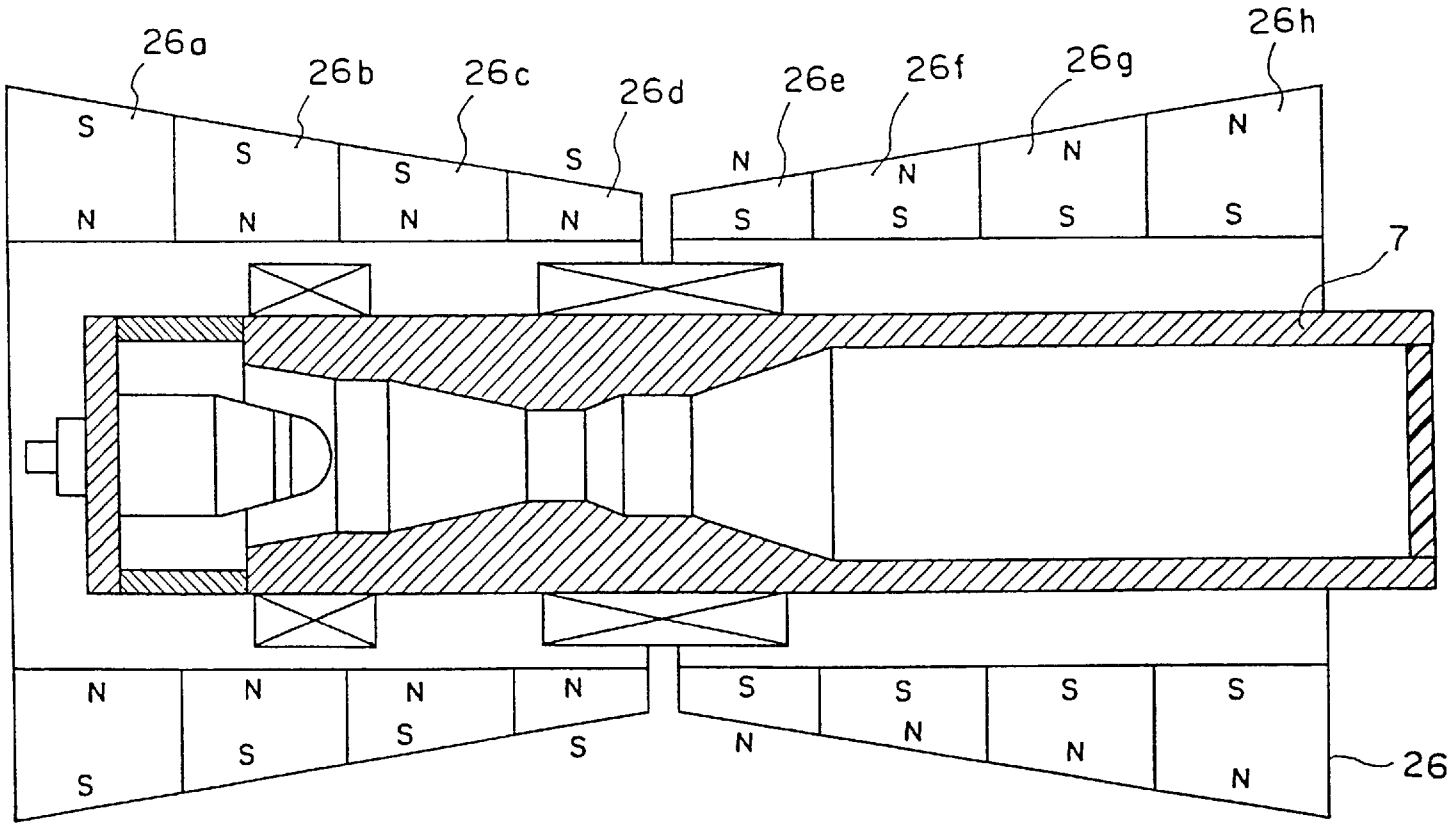
FIG. 44 is a schematic longitudinal sectional view of a gyrotron system in a still further embodiment according to the present invention.

FIG. 44 shows a gyrotron system in a still further embodiment according to the present invention, in which parts like or corresponding to those of the prior art gyrotron system are designated by the same reference characters and the description thereof will be omitted. In the cylindrical magnetic field generating unit 25 of the embodiment shown in FIG. 43*a*, the ring-shaped permanent magnets 25*a* to 25*d* disposed on the side of the electron gun 1 have S-poles on the inner side, and the ring-shaped permanent magnets 25*e* to 25*h* on the side of the collector 7 have N-poles on the inner side, which may be reversed. When ring-shaped permanent magnets 26*a*, 26,*b*, 26*c*, and 26*d* on the side of a electron gun 1 have N-poles on the inner side, and ring-shaped permanent magnets 26, 26*f*, 26*g*, 26*h* on the side of a collector 7 have S-poles on the inner side as shown in FIG. 44, the direction of the axial magnetic field is inverted at certain positions, and the problem in the embodiment shown in FIG. 43*a* arises also in this embodiment.

Figure 45:
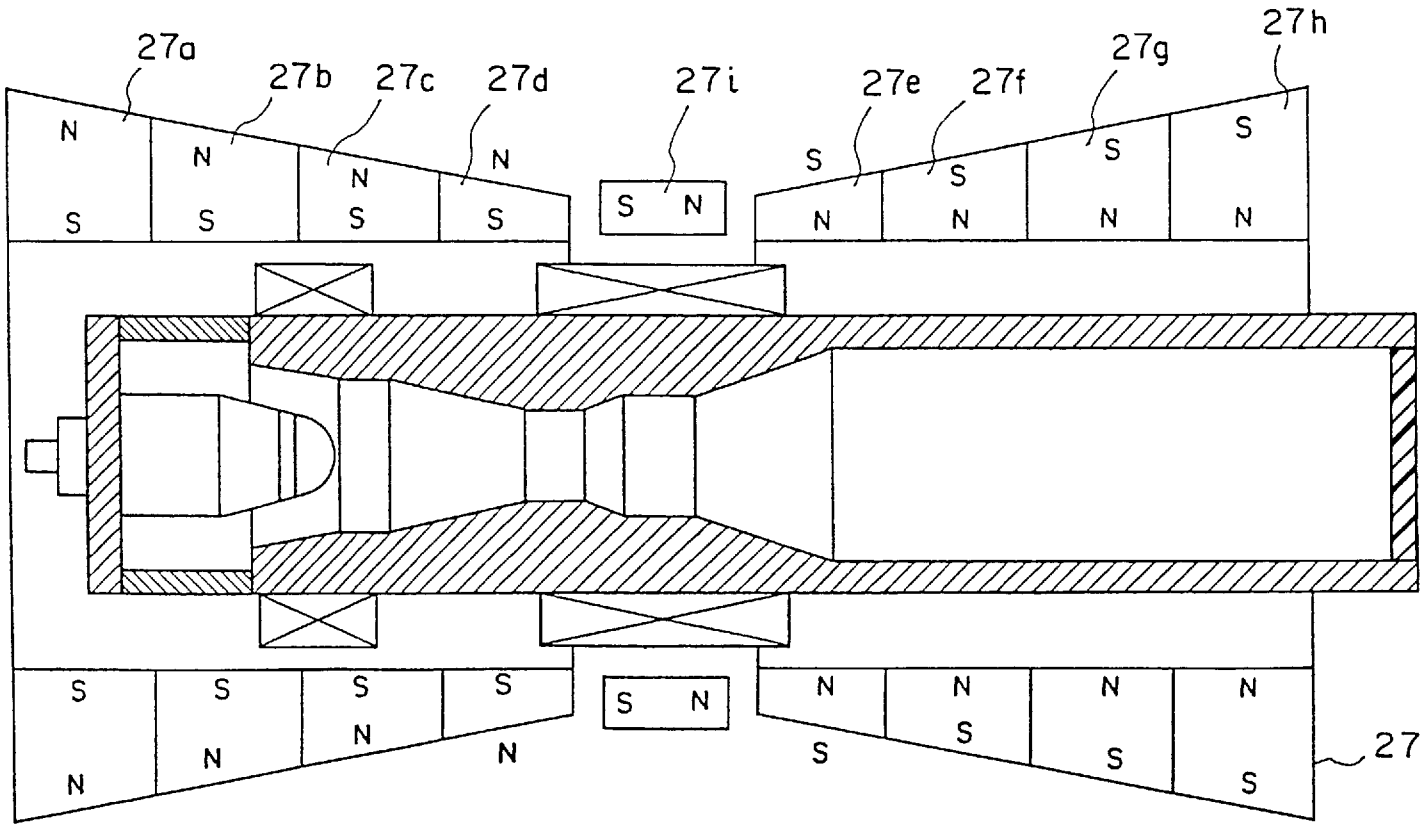
FIG. 45 is a schematic longitudinal sectional view of a gyrotron system in a still further embodiment according to the present invention.

FIG. 45 shows a gyrotron system in a still further embodiment according to the present invention, in which parts like or corresponding to those of the prior art gyrotron system are designated by the same reference characters and the description thereof will be omitted. The gyrotron systems shown in FIGS. 43*a* and 44 are provided with the cylindrical magnetic field generating units 25 and 26 formed by assembling the ring-shaped permanent magnets 25*a* to 25*h* and 26*a* to 26*h* having a substantially radial direction of magnetization. An axial magnetic field having a flat magnetic flux density distribution as shown in FIG. 43*b* can be produced around the cavity resonator 6 by a ring-shaped permanent magnet 27*i* having a substantially axial direction of magnetization as shown in FIG. 45. Since ring-shaped permanent magnets employed in this embodiment and disposed near an electron gun have a substantially radial direction of magnetization, the magnetic flux density distribution on the center axis is similar to that shown in FIG. 43*b*, and the functions of the gyrotron system in this embodiment is similar to those of the gyrotron system shown in FIG. 43*a*.

Figure 46:
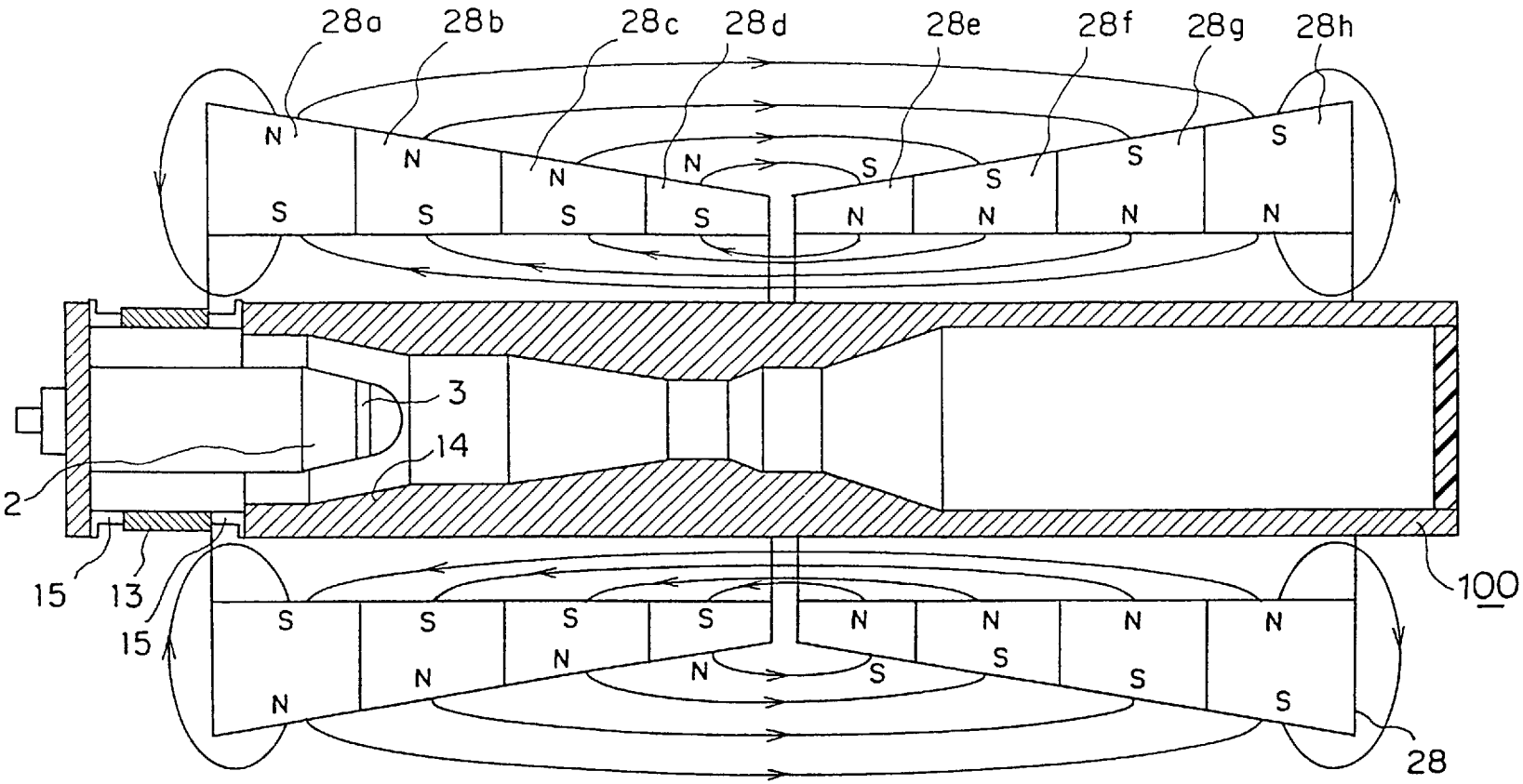
FIG. 46 is a schematic longitudinal sectional view of a gyrotron system in a still further embodiment according to the present invention.

FIG. 46 shows a gyrotron system in a still further embodiment according to the present invention, in which parts like or corresponding to those of the prior art gyrotron system are designated by the same reference characters and the description thereof will be omitted. The gyrotron system is provided with a cylindrical magnetic field generating unit 28 comprising ring-shaped permanent magnets 28*a*, 28*b*, 28*c*, 28*d*, 28*e*, 28*f*, 28*g*, and 28*h* having a substantially radial direction of magnetization. Lines with arrows directed from the N-poles toward the S-poles of the ring-shaped permanent magnets 28*a* to 28*h* are magnetic lines of force. Since the cylindrical magnetic field generating unit 28 is similar in construction to that of the gyrotron system shown in FIG. 43*a*, the axial magnetic flux density distribution of the magnetic field produced by the cylindrical magnetic field generating unit 28 is inverted at certain positions as shown in FIG. 43*b*, and it is known from FIG. 46 that a position corresponding to the position $z_1$ in FIG. 43*b* lies near the S-pole of the ring-shaped permanent magnet 28*a* in FIG. 46. In the same manner, it is known that a position corresponding to the position $z_2$ in FIG. 43*b* lies near the N-pole of the ring-shaped permanent magnet 28*h* in FIG. 46.

Since a voltage of several tens kilovolt is applied across the cathode 2 and the anode 14 of an electron gun 1 included in a gyrotron 100, an insulating member 13 is interposed between the cathode 2 and the anode 14. The insulating member 13 is formed of a ceramic material, such as alumina, and joining parts for joining the insulating member 13 to metal parts are brazed to the opposite ends of the insulating member 13, respectively. Generally, the joining parts are formed of Kovar and the Kovar joining parts are welded to metal parts. Since Kovar is a magnetic substance, there is the possibility that the Kovar joining parts disturb the magnetic field produced by the permanent magnet. As a result, harmful influence may be exerted on the characteristics of an electron beam emitted from an electron emitting member 3 provided on the cathode 2. Therefore, there is the possibility that harmful influence is exerted on the oscillating operation of the gyrotron 100. In some cases, such adverse effects cannot be eliminated by the electron gun magnetic field fine adjustment electromagnet 31 employed in the gyrotron system shown in FIG. 43*a*. In FIG. 46, an electron gun magnetic field fine adjustment electromagnet is omitted. To solve the problem, the Kovar joining parts are disposed on the left side of the position where the axial magnetic field is inverted so that an axial magnetic field of a direction reverse to that of the axial magnetic field produced around the electron emitting member 3 is applied to the Kovar joining members to reduce the influence of the Kovar joining parts on the axial magnetic field produced around the electron emitting member 3 and, consequently, the gyrotron 100 is able to oscillate efficiently. The gyrotron system of FIG. 46 may be provided with a main magnetic field fine adjustment electromagnet if need be. The gyrotron system of FIG. 46 may employ the cylindrical magnetic field generating unit of FIG. 44 or 45. When the cylindrical magnetic field generating unit of FIG. 44 or 45 is used, the Kovar joining parts are disposed on the side opposite the side on which the electron emitting member 3 is disposed with respect to the position where the axial magnetic field is inverted. Naturally, when the joining parts are formed of a magnetic material other than Kovar, the same disposition of the joining parts provides the same effects.

Figure 47:
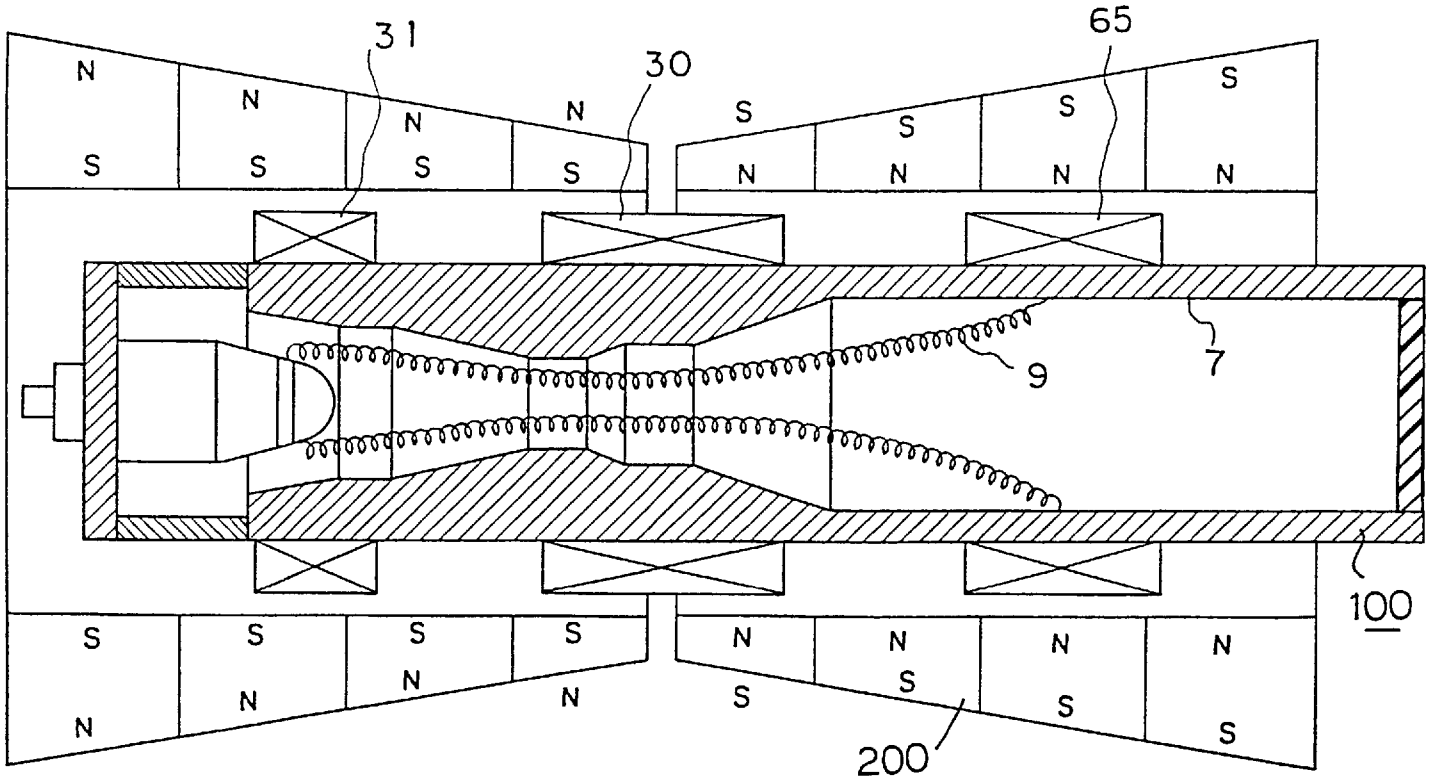
FIG. 47 is a schematic longitudinal sectional view of a gyrotron system in a still further embodiment according to the present invention.

FIG. 47 shows a gyrotron system 200 in a still further embodiment according to the present invention, in which parts like or corresponding to those of the prior art gyrotron system are designated by the same reference characters and the description thereof will be omitted. In the gyrotron system 200, the interior of a gyrotron 100 must be maintained in a high vacuum to secure the stable oscillation of the gyrotron 100. Therefore, a collector 7 must be subjected to sufficient aging for degassing by moving the electron beam 9 over a wide area on the collector 7 to maintain the interior of the gyrotron 100 in a high vacuum. Although the electron beam 9 can be moved in a comparatively narrow region on the collector 7 by an electron gun magnetic field fine adjustment electromagnet 31 and a main magnetic field fine adjustment electromagnet 30 in the gyrotron system 200 provided with a magnetic field generating unit using a permanent magnet, it is difficult to move the electron beam 9 over a wide region on the collector 7.

The gyrotron system 200 shown in FIG. 47 is provided with a collector magnetic field generating electromagnet 65 disposed near the collector 7 of the gyrotron 100 to move the electron beam 9 in a wider region on the collector 7, which enables effective aging to be achieved in a comparatively short time. The number of turns of the coil of the electromagnet, the way of winding the coil and the exciting current to be supplied to the coil are determined selectively to increase the area of a region on the collector 7 to be irradiated by the electron beam 9, which reduces heat flux on the collector 7 and enhances the reliability of the gyrotron system.

Figure 48:
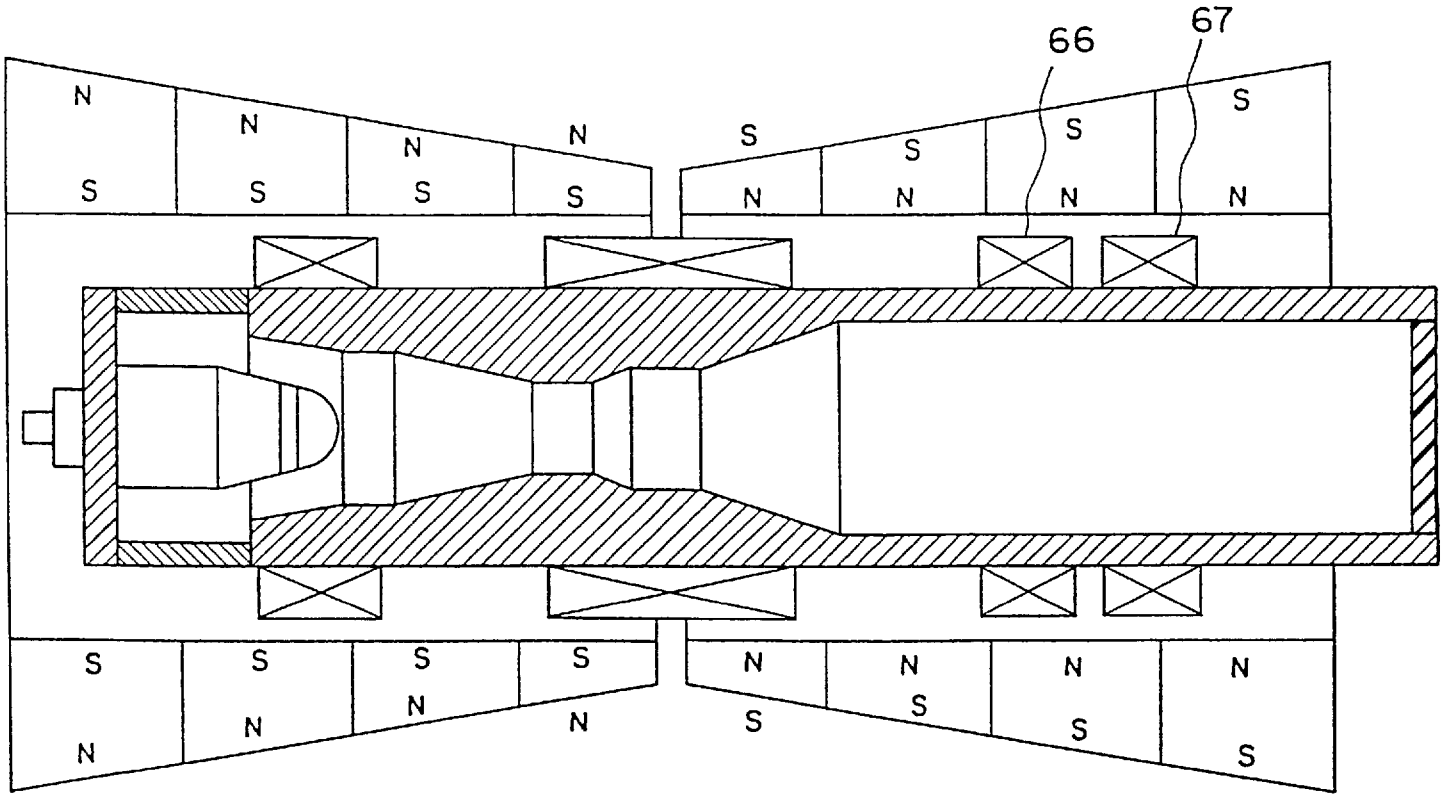
FIG. 48 is a schematic longitudinal sectional view of a gyrotron system in a still further embodiment according to the present invention.

FIG. 48 shows a gyrotron system in a forty-eighth embodiment according to the present invention provided with two collector magnetic field generating electromagnets 66 and 67. The gyrotron system may be provided with more than two collector magnetic field generating electromagnets. Since this configuration increases the degree of freedom of the magnetic flux density distribution of an axial magnetic field generated by the electromagnets, the aging can be more effectively achieved and heat flux on a collector 7 can be further reduced.

As is apparent from the foregoing description, the present invention has the following advantages.

The magnetic field generating unit of the gyrotron system, comprising the permanent magnet and the electromagnets can be formed in a small size, is easy to operate, can be fabricated at a comparatively low cost and operates at comparatively low running costs.

Since the permanent magnet produces a magnetic field of a magnetic flux density of not less than 90% and not greater than 110% of the axial magnetic flux density of the axial magnetic field necessary for operating the gyrotron in the central portion of the cavity resonator of the gyrotron during the oscillation of the gyrotron, the gyrotron system can be formed in a small size, is easy to operate, can be fabricated at a comparatively low cost and operates at comparatively low running costs.

Since the permanent magnet produces a magnetic field of a magnetic flux density of not less than 80% and not greater than 120% of the axial magnetic flux density of the axial magnetic field necessary for operating the gyrotron in the central portion of the cavity resonator of the gyrotron during the oscillation of the gyrotron, the gyrotron system can be formed in a small size, is easy to operate, can be fabricated at a comparatively low cost and operates at a comparatively low running cost. Furthermore, the axial magnetic flux density necessary for operating the gyrotron can be adjusted for the electron beam accelerated by the accelerating voltage variable in a wider range.

Since the main magnetic filed fine adjustment electromagnet adjusts the axial magnetic flux density in the cavity resonator of the gyrotron, the oscillation efficiency can be enhanced or the oscillation output can be adjusted.

Since the output of the gyrotron is detected by the detector, the detection signal provided by the detector is fed back to the control circuit for controlling the exciting power supply for magnetizing the main magnetic field fine adjustment electromagnet to regulate the magnetic field generated by the electromagnet by adjusting the current flowing through the coil of the electromagnet, the oscillation output of the gyrotron can be automatically adjusted to a maximum or a predetermined value.

Since the permanent magnet produces a magnetic field of a magnetic flux density of not less than 50% and not greater than 150% of the total axial magnetic flux density around the electron emitting member on the cathode of the electron gun of the gyrotron while the gyrotron is in oscillating operation, the gyrotron system can be formed in a small size, is easy to operate, can be fabricated at a comparatively low cost and operates at a comparatively low running cost.

Since the electron gun magnetic field fine adjustment electromagnet adjusts the axial magnetic flux density distribution around the electron emitting member on the cathode of the electron gun, the oscillation efficiency can be enhanced or the oscillation output can be adjusted. Furthermore, the disturbed magnetic flux density distribution around the electron gun can be corrected by the electromagnet.

Since the output of the gyrotron is detected by the detector, the detection signal provided by the detector is fed back to the control circuit for controlling the exciting power supply for magnetizing the electron gun magnetic field fine adjustment electromagnet to adjust the magnetic field generated by the electromagnet by adjusting the current flowing through the coil of the electromagnet, the oscillation output of the gyrotron can be automatically adjusted to a maximum or a predetermined value.

Since the time-dependent variation of the magnetic field produced by the permanent magnet due to the aging of the permanent magnet is detected by the magnetic flux density detectors and the time-dependent variation of the magnetic field produced by the permanent magnet due to the aging of the permanent magnet is compensated, the initial performance of the gyrotron system or the initial mode of control of the gyrotron system can be secured to enhance the reliability.

The use of the nonmagnetic material as a material for joining together the insulating member and the metal parts in the essential portion of the gyrotron enhances the reliability of the gyrotron.

The use of the joining parts of a nonmagnetic material for joining together the component parts of the electron gun enhances the reliability of the gyrotron system.

The use of the insulating members formed of an insulating material that can be directly joined to nonmagnetic metal parts for insulating the component parts of the gyrotron enhances the reliability of the gyrotron system.

Since the magnetic field generating unit comprising the permanent magnet and the electromagnets is provided with the frame that surrounds a region in which the magnetic flux density of the magnetic field generated by the magnetic field generating unit is 5 G or above, hazards and troubles attributable to the magnetic field continuously maintained by the permanent magnet can be prevented.

Since the magnetic field generating unit comprising the permanent magnet and the electromagnets is provided with the frame that surrounds a region in which the magnetic flux density of the magnetic field produced by the permanent magnet of the magnetic field generating unit is 5 G or above, hazards and troubles attributable to the magnetic field continuously maintained by the magnetic field generating unit can be prevented.

The cushioning member covering the frame prevents hazards and troubles attributable to the magnetic field continuously maintained by the magnetic field generating unit.

Since the variation of the magnetic flux density of the magnetic field produced by the permanent magnet due to the variation of the temperature of the permanent magnet is detected by the magnetic flux density detector and the variation of the magnetic flux density of the magnetic field due to the variation of the temperature of the permanent magnet is compensated, the gyrotron is able to operate efficiently and the high-frequency output can be controlled even if the magnetic flux density of the magnetic field produced by the permanent magnet changes due to the variation of the temperature of the permanent magnet caused by the variation of the environmental conditions, and hence the reliability of the gyrotron system is enhanced.

When the direction of the axial magnetic field produced by the permanent magnet of the magnetic field generating unit is inverted at some position, the electron emitting member on the cathode of the electron gun of the gyrotron is disposed on the side of the cavity resonator with respect to the position where the direction of the magnetic field is inverted. Therefore, electrons emitted from the electron emitting member form a hollow electron beam, the radius of the electron beam is reduced gradually as the electron beam travels toward the cavity resonator and the hollow electron beam having a reduced radius travels through the cavity resonator, so that normal oscillating operation can be carried out.

Since the insulating member for insulating the component parts of the electron gun of the gyrotron is disposed so that the magnetic parts brazed to the opposite ends of the insulating member are positioned on the side opposite the side on which the cavity resonator is disposed with respect to the position where the direction of the axial magnetic field is inverted, the influence of the magnetic parts on the magnetic flux density distribution of the magnetic field around the electron beam emitting member is reduced and the gyrotron is able to operate efficiently for oscillation.

Since the electromagnet capable of generating an axial magnetic field is disposed near the collector of the gyrotron, the electron beam can be moved in a wider region on the collector, the time necessary for aging can be reduced, the aging effect is enhanced, and the heat flux of the electron beam on the collector can be reduced.

What is claimed is:

1. In a gyrotron system comprising:

an electron gun that produces an electron beam;

a magnetic field generating unit for generating an axial magnetic field oriented relative to a propagation direction of the electron beam and being capable of driving electrons emitted from the electron gun for revolving motion, said magnetic field generating unit comprising a permanent magnet that produces a magnetic field of a magnetic flux density equal to a majority portion of a desired magnetic flux density associated with the axial magnetic field, and at least one electromagnet for adjusting the magnetic flux density of the axial magnetic field;

a cavity resonator that causes cyclotron resonance maser interaction between the revolving electrons and a high-frequency electromagnetic field resonating in a natural mode therein;

a collector for collecting the electron beam traveled through the cavity resonator; and an output window through which a high-frequency wave generated in the cavity resonator by the cyclotron resonance maser interaction propagates.

2. A gyrotron system according to claim 1, wherein the at least one electromagnet adjusts an axial distribution of the magnetic flux density in the cavity resonator.

3. A gyrotron system according to claim 1, wherein the at least one electromagnet adjusts an axial distribution of the magnetic flux density around an electron emitting member located on a cathode of the electron gun.

4. A gyrotron system according to claim 1, wherein the at least one electromagnet of the magnetic field generating unit includes a electromagnet for adjusting an axial distribution of the magnetic flux density in the cavity resonator, and an electromagnet for adjusting the axial distribution of the magnetic flux density around an electron emitting member located on a cathode of the electron gun.

5. A gyrotron system according to claim 2, further comprising: an output detector for detecting the output of the high-frequency wave propagating through the output window; and a feedback means for adjusting the magnetic flux density of the magnetic field generated by the electromagnet by feeding back a detection signal provided by the output detector to a control circuit that controls a power supply that supplies a current to the electromagnet, and adjusting the current flowing through the electromagnet to adjust the output to a maximum output or a predetermined value.

6. A gyrotron system according to claim 3, further comprising: an output detector for detecting the output of the high-frequency wave propagating through the output window; and a feedback means for adjusting the magnetic flux density of the magnetic field generated by the electromagnet by feeding back a detection signal provided by the output detector to a control circuit that controls a power supply that supplies a current to the electromagnet, and adjusting the current flowing through the electromagnet to adjust the output to a maximum output or a predetermined value.

7. A gyrotron system according to claim 4, further comprising: an output detector for detecting the output of the high-frequency wave propagating through the output window; and a feedback means for adjusting the magnetic flux density of the magnetic field generated by the electromagnet by feeding back a detection signal provided by the output detector to a control circuit that controls a power supply that supplies a current to the electromagnet, and adjusting the current flowing through the electromagnet to adjust the output to a maximum output or a predetermined value.

8. A gyrotron system according to any one of claims 1 to 7, further comprising a detecting means for detecting the variation of the magnetic flux density of the magnetic field due to the aging of the permanent magnet, wherein the variation of the magnetic flux density of the magnetic field due to the aging of the permanent magnet is compensated by the electromagnet.

9. A gyrotron system according to any one of claims 1 to 7, further comprising a detecting means for detecting the variation of the magnetic flux density of the magnetic field due to the variation of the temperature of the permanent magnet, wherein the variation of the magnetic flux density of the magnetic field due to the variation of the temperature of the permanent magnet is compensated by the electromagnet.

10. A gyrotron system according to any one of claims 1, 2, 4, 5, and 7, wherein the magnetic flux density of the magnetic field produced by the permanent magnet is not less than 90% and not greater than 110% of the axial magnetic flux density in the central portion of the cavity resonator while the gyrotron is in oscillating operation.

11. A gyrotron system according to claim 10, wherein the magnetic flux density of the magnetic field produced by the permanent magnet is not less than 80% and not greater than 120% of the axial magnetic flux density in the central portion of the cavity resonator while the gyrotron is in oscillating operation.

12. A gyrotron system according to any one of claims 1 to 7, wherein the magnetic flux density of the permanent magnet is not less than 50% and not greater than 150% of the axial magnetic flux density in a region around the electron emitting member on the cathode of the electron gun while the gyrotron is in oscillating operation.

13. A gyrotron system according to any one of claims 1 to 7, further comprising an electromagnet that generates an axial magnetic field around the collector.

14. A gyrotron system according to claim 1, wherein principal materials joining together metal parts of principal components of a gyrotron comprising the electron gun, the cavity resonator, the collector and the output window, and the insulating members insulating the principal components from each other and interconnecting the principal components are nonmagnetic materials.

15. A gyrotron system according to claim 1, wherein principal materials comprising joining members joining together component parts of the electron gun are nonmagnetic materials.

16. A gyrotron system according to claim 14, wherein the insulating members insulating the principal components of the gyrotron comprising the electron gun, the cavity resonator, the collector and the output window from each other and interconnecting the principal components are of an insulating material which is directly joined to abutting nonmagnetic metal parts.

17. A gyrotron system according to claim 1, further comprising a frame that encloses a region in which the magnetic flux density of the magnetic field generated by the magnetic field generating unit is at least 5 Gauss.

18. A gyrotron system according to claim 1, further comprising a frame that encloses a region in which the magnetic flux density of the magnetic field produced by the permanent magnet is at least 5 Gauss.

19. A gyrotron system according to claim 17 or 18, wherein an outer surface of the frame is covered by a cushioning member.

20. A gyrotron system according to claim 1, wherein, when there is a position where a direction of the magnetic field is inverted in an axial magnetic flux density distribution of the magnetic field produced by the permanent magnet, an electron emitting member on a cathode of the electron gun is disposed on a side of the cavity resonator with respect to the position where the direction of the magnetic field is inverted.

21. A gyrotron system according to claim 1, wherein parts of a magnetic material, brazed to opposite ends of an insulating member which insulate components of the electron gun from each other, are disposed opposite the cavity resonator with respect to a position where a direction of the axial magnetic field is inverted.

22. A magnetic field generating unit for generating a magnetic field in a gyrotron system having an electron gun and a cavity resonator, the magnetic field generating unit comprising:

a permanent magnet for producing a predominant component of the magnetic field;

at least one electromagnet, each electromagnet disposed at a respective location with respect to the gyrotron system for adjusting a respective magnetic field component at the respective location; and a power supply for supplying a respective excitation current, that is controllable for adjusting the respective magnetic field component, to each electromagnet.

23. The magnetic field generating unit according to claim 22 wherein a first electromagnet of the at least one electromagnet is disposed near the cavity resonator of the gyrotron system for adjusting a magnetic field component at the cavity resonator.

24. The magnetic field generating unit according to claim 23 wherein a second electromagnet of the at least one electromagnet is disposed near the electron gun of the gyrotron system for adjusting a magnetic field component at the electron gun.

25. The magnetic field generating unit according to claim 22 wherein the permanent magnet includes:

a first portion for providing a first predominant component of the magnetic field at a first part of the gyrotron system, the first predominant component having a first direction; and a second portion for providing a second predominant component of the magnetic field at a second part of the gyrotron system, the second predominant component having a second direction that is an inversion of the first direction.

26. The magnetic field generating unit according to claim 22 wherein the at least one electromagnet is disposed near the cavity resonator of the gyrotron system for adjusting a magnetic field component at the cavity resonator.

27. The magnetic field generating unit according to claim 22 wherein the at least one electromagnet is disposed near the electron gun of the gyrotron system for adjusting a magnetic field component at the electron gun.

28. The magnetic field generating unit according to claim 22 wherein the gyrotron system provides a high frequency output to an output window, the magnetic field generating unit further comprising:

an output detector, coupled to the output window, for sensing the high frequency output;

a measuring circuit, coupled to the output detector, that determines a deviation of the high frequency output from a predetermined output; and a control circuit, coupled to the measuring circuit and the power supply, for adjusting the respective excitation current of each electromagnet to minimize the deviation.

29. The magnetic field generating unit according to claim 22 further comprising:

a magnetic flux density detector for sensing a change in a flux density of the magnetic field with aging of the gyrotron system; and a control circuit, coupled to the magnetic flux density detector and the power supply, for adjusting the respective excitation current of each electromagnet to minimize the change.

30. The magnetic field generating unit according to claim 22 further comprising:

a magnetic flux density detector for sensing a change in a flux density of the magnetic field with temperature variation in the gyrotron system; and a control circuit, coupled to the magnetic flux density detector and the power supply, for adjusting the respective excitation current of each electromagnet to minimize the change.

31. The magnetic field generating unit according to claim 22 wherein the gyrotron system has a collector for collecting electrons generated by the electron gun, the magnetic field generating unit further comprising at least one collector electromagnet, coupled to the power supply and disposed at the collector, for controlling locations on the collector for collecting the electrons.

32. The magnetic field generating unit according to claim 22 further comprising a frame for shielding the magnetic field generating unit to reduce the magnetic field in an environment outside the frame.

33. The magnetic field generating unit according to claim 32 further comprising a cushioning for covering the frame to protect the magnetic field generating unit from objects that are attracted to the magnetic field generating unit by the magnetic field.

34. A gyrotron system for providing a high frequency output, the gyrotron system comprising:

an electron gun for providing a beam of electrons that revolves in a path;

a cavity resonator, disposed in the path of the beam of electrons, that causes cyclotron resonance maser interaction between the electrons and an electromagnetic field within the cavity resonator when the electrons enter the cavity resonator, the cyclotron resonance maser interaction producing a high frequency electromagnetic wave;

a collector, coupled to the cavity resonator, for collecting the electrons after the electrons travel through the cavity resonator;

an output window, disposed as an opening in the collector, allowing the high frequency electromagnetic wave to pass through; and a magnetic field generating unit for generating a magnetic field in the gyrotron system including the magnetic field within the cavity resonator, the magnetic field generating unit including:

a permanent magnet for producing a predominant component of the magnetic field;

at least one electromagnet, each electromagnet disposed at a respective location on the gyrotron system for adjusting a respective magnetic field component at the respective location; and a power supply for supplying a respective excitation current, that is controllable for adjusting the respective magnetic field component, to each electromagnet.

35. The gyrotron system according to claim 34 wherein a material joining a first portion of the gyrotron system to a second portion of the gyrotron system is nonmagnetic.

36. The gyrotron system according to claim 34 wherein a first electromagnet of the at least one electromagnet is disposed at the cavity resonator.

37. The gyrotron system according to claim 36 wherein a second electromagnet of the at least one electromagnet is disposed at the electron gun.

38. The gyrotron system according to claim 34 further comprising an insulating member for insulating a first component of the gyrotron system from a second component of the gyrotron system, and wherein, the insulating member is comprised of glass.

39. The gyrotron system according to claim 34 wherein the at least one electromagnet is disposed at the cavity resonator.

40. The gyrotron system according to claim 34 wherein the at least one electromagnet is disposed at the electron gun.

41. The gyrotron system according to claim 34 further comprising:

an output detector, coupled to the output window, for sensing the high frequency output;

a measuring circuit, coupled to the output detector, for determining a deviation of the high frequency output from a predetermined output; and a control circuit, coupled to the measuring circuit and the power supply, for adjusting the respective excitation current of each electromagnet to minimize the deviation.

42. The gyrotron system according to claim 34 further comprising:

a magnetic flux density detector for sensing a change in a flux density of the magnetic field with aging of the gyrotron system; and a control circuit, coupled to the magnetic flux density detector and the power supply, for adjusting the respective excitation current of each electromagnet to minimize the change.

43. The gyrotron system according to claim 34 further comprising:

a magnetic flux density detector for sensing a change in a flux density of the magnetic field with temperature variation in the gyrotron system; and a control circuit, coupled to the magnetic flux density detector and the power supply, for adjusting the respective excitation current of each electromagnet to minimize the change.

44. The gyrotron system according to claim 34 further comprising at least one collector electromagnet, coupled to the power supply and disposed at the collector, for controlling locations on the collector for collecting the electrons.

45. The gyrotron system according to claim 34 further comprising a frame for shielding the gyrotron system to reduce the magnetic field in an environment outside the frame.

46. The gyrotron system according to claim 45 further comprising a cushioning for covering the frame to protect the frame from objects that are attracted to the gyrotron system by the magnetic field.

47. The gyrotron system according to claim 34 wherein the permanent magnet includes:

a first portion for providing a first predominant component of the magnetic field at a first part of the gyrotron system, the first predominant component having a first direction; and a second portion for providing a second predominant component of the magnetic field at a second part of the gyrotron system, the second predominant component having a second direction that is an inversion of the first direction.

48. A method for generating a desired magnetic field in a gyrotron system providing a predetermined high frequency electromagnetic wave, the method including steps of:

A. providing a predominant component of the desired magnetic field by a first magnetic field generator; and B. adjusting at least one magnetic field component of the predominant component to obtain the desired magnetic field using at least one second magnetic field generator to provide the high frequency electromagnetic wave, each magnetic field component having a respective location on the gyrotron system.

49. The method of claim 48 wherein the step of adjusting includes steps of:

measuring the high frequency output to determine a deviation of the high frequency output from the predetermined output; and adjusting each magnetic field component to minimize the deviation.

50. The method of claim 48 wherein the step of adjusting includes steps of:

detecting a change in magnetic flux density of the magnetic field caused by one of aging of the gyrotron system and a temperature variation; and adjusting each magnetic field component to compensate for the change.

51. The method of claim 48 wherein the adjusting step includes adjusting a magnetic field component located at an electron gun of the gyrotron system.

52. The method of claim 48 wherein the adjusting step includes adjusting a magnetic field component located at a cavity resonator of the gyrotron system.

53. A magnetic field generating unit for generating a magnetic field in a gyrotron system, the magnetic field generating unit comprising:

a permanent magnet for producing a predominant component of the magnetic field; and means for controlling the magnetic field substantially near at least one location on the gyrotron system such that the high frequency output is substantially a predetermined output.

54. The magnetic field generating unit according to claim 53 further comprising means for protecting the gyrotron system from objects that are attracted to the gyrotron system by the magnetic field.

55. The magnetic field generating unit according to claim 53 further comprising means for shielding the gyrotron system to reduce the magnetic field in an environment surrounding the gyrotron system.

56. The magnetic field generating unit according to claim 53 further comprising means for compensating for a change in the magnetic field caused by one of aging of the gyrotron system and a temperature variation.

* * * * *